US008889324B2

(12) United States Patent
Arai et al.

(10) Patent No.: US 8,889,324 B2
(45) Date of Patent: Nov. 18, 2014

(54) IMAGE BEARING MEMBER, IMAGE FORMING METHOD, IMAGE FORMING APPARATUS, AND PROCESS CARTRIDGE

(75) Inventors: Ryota Arai, Shizuoka-ken (JP); Tomoyuki Shimada, Shizuoka-ken (JP)

(73) Assignee: Ricoh Company, Ltd., Tokyo (JP)

( * ) Notice: Subject to any disclaimer, the term of this patent is extended or adjusted under 35 U.S.C. 154(b) by 753 days.

(21) Appl. No.: 13/023,089

(22) Filed: Feb. 8, 2011

(65) Prior Publication Data

US 2011/0200925 A1 Aug. 18, 2011

(30) Foreign Application Priority Data

Feb. 10, 2010 (JP) ..... 2010-027442
Jul. 22, 2010 (JP) ..... 2010-164952

(51) Int. Cl.
*G03G 5/04* (2006.01)
*G03G 5/06* (2006.01)

(52) U.S. Cl.
CPC ..... *G03G 5/0651* (2013.01); *G03G 5/0609* (2013.01); *G03G 5/065* (2013.01); *G03G 5/0629* (2013.01); *G03G 2215/00957* (2013.01); *G03G 5/0616* (2013.01); *G03G 5/0642* (2013.01); *G03G 5/0605* (2013.01)
USPC ..... 430/58.5; 430/58.85; 430/78; 399/159

(58) Field of Classification Search
USPC ..... 430/78, 58.5, 58.85; 399/159
See application file for complete search history.

(56) References Cited

U.S. PATENT DOCUMENTS

| | | | | |
|---|---|---|---|---|
| 3,784,376 | A * | 1/1974 | Fox | 430/78 |
| 2007/0231720 | A1* | 10/2007 | Mori et al. | 430/58.7 |
| 2007/0248901 | A1* | 10/2007 | Shimoyama et al. | 430/78 |
| 2009/0180804 | A1* | 7/2009 | Kurimoto et al. | 399/159 |

FOREIGN PATENT DOCUMENTS

| | | |
|---|---|---|
| JP | 60-196768 | 10/1985 |
| JP | 2732697 | 12/1997 |
| JP | 2884353 | 2/1999 |
| JP | 2000-231204 | 8/2000 |
| JP | 4101676 | 3/2008 |
| JP | 4132571 | 6/2008 |

OTHER PUBLICATIONS

Akihiko Itami et al., "The Effects of Nitrogen Oxide on the Resolution of Organic Photoconductors," Konica Technical Report, vol. 13, 2000, p. 37-40 (with English Summary).

D.W. Jones, "Reaction of Phtalimidonitreme with Furans," Journal of Chemical Society Perkin 1, 1972, p. 2728-2731.

* cited by examiner

*Primary Examiner* — Peter Vajda
*Assistant Examiner* — Olatunji Godo
(74) *Attorney, Agent, or Firm* — Oblon, Spivak, McClelland, Maier & Neustadt, L.L.P.

(57) ABSTRACT

An image bearing member including an electroconductive substrate, and a photosensitive layer provided overlying the electroconductive substrate, the photosensitive layer containing at least one charge transport materials selected from the group consisting of a naphthalene tetracarboxylic acid diimide-isoindol derivative represented by the following chemical structure 1, a naphthalimide-isoindol derivative represented by the following chemical structure 2, and a triphenyl amine-isoindol derivative represented by the following chemical structure 3, Chemical structure 1

(1)

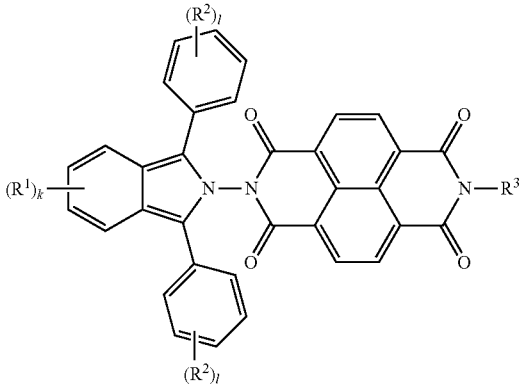

where $R_1$ and $R_2$ independently represent a hydrogen atom, a substituted or non-substituted alkyl group, an alkoxy group, a substituted or non-substituted aromatic hydrocarbon group, a halogen atom, and a nitro group, k represents an integer of 1 to 4, and l represents an integer of from 1 to 5 and $R_3$ represents a substituted or non-substituted alkyl group, a substituted or non-substituted cycloalkyl group, and a substituted or non-substituted aromatic hydrocarbon group, Chemical structure 2

(2)

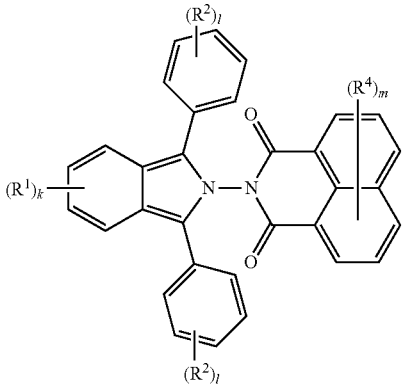

where $R_1$, $R_2$, and $R_4$ independently represent a hydrogen atom, a substituted or non-substituted alkyl group, an alkoxy group, a substituted or non-substituted aromatic hydrocarbon group, a halogen atom, and nitro group, and k represents an integer of 1 to 4, l represents an integer of from 1 to 5, and m represents an integer of 1 to 6, and Chemical structure 3

(3)

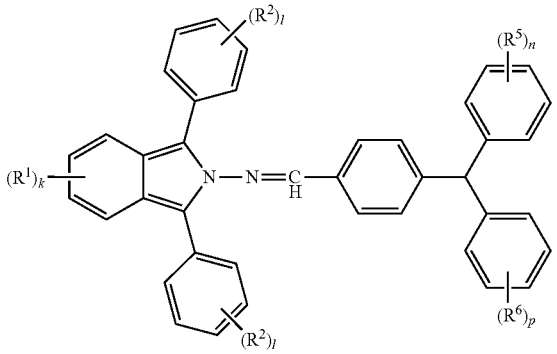

where $R_1$, $R_2$, $R_5$, and $R_6$ independently represent a hydrogen atom, a substituted or non-substituted alkyl group, an alkoxy group, a substituted or non-substituted aromatic hydrocarbon group, a halogen atom, and nitro group, and k represents an integer of 1 to 4, and l, n, and p represent integers of from 1 to 5.

20 Claims, 5 Drawing Sheets

IMAGE BEARING MEMBER, IMAGE FORMING METHOD, IMAGE FORMING APPARATUS, AND PROCESS CARTRIDGE

BACKGROUND OF THE INVENTION

1. Field of the Invention

The present invention relates to an image bearing member and an image forming method, an image forming apparatus, and a process cartridge using the image bearing member.

2. Description of the Background Art

Recent development of data processing systems employing electrophotogtaphy has been of note. In particular, laser printers and digital photocopiers that conduct recording using light by converting data into digital signals have markedly improved in terms of image quality and reliability.

Furthermore, coupled with high speed printing technology, these have been applied to machines such as laser printers and digital photocopiers that are able to produce full-color images.

In light of these developments, image bearing members (photoreceptors, photoconductors) that have a good combination of image quality and durability are particularly preferable.

Given their advantages in terms of the cost, productivity, and pollution, image bearing members made of organic photosensitive materials are widely used for laser printers and digital photocopiers employing electrophotography.

Such organic photoconductors (OPC) are classified into two types, a single-layer structure type and a functionally separated laminate structure type. The first commercialized organic photoconductors were PVK-TNF charge transfer complex type photoconductors, which were of the single-layer structure type.

On the other hand, in 1968, Hayashi and Refensburger independently invented a PVK-a-Se laminate image bearing member. Melz, etc. in 1977 and Schlosser in 1978 made a laminate image bearing member having a photosensitive layer formed of an organic pigment dispersion layer and an organic low molecular weight dispersion polymer layer, with the photosensitive layer made entirely of organic materials.

These laminated image bearing members are also referred to as functionally separated type image bearing members, because the photosensitive layer is separated into a charge generation layer (CGL) that generates charges by absorbing light and a charge transfer layer (CTL) that receives and transfers the charges generated by the CGL to neutralize surface charges.

However, organic image bearing members are vulnerable to abrasion caused by repetitive use in comparison with inorganic image bearing members. Thus, as the surface abrasion of such an organic image bearing member progresses, the image bearing member tends to have problems such that the charge voltages decreases, the photosensitivity deteriorates, background fouling occurs due to scarring on the surface of the image bearing member, image density decreases, and overall image quality deteriorates. Durability has been a large problem for the organic image bearing members.

Moreover, in recent years, the size of the image bearing member has shrunk as printing speeds have increased and image forming apparatuses have become more compact, making good durability an even more pressing problem.

Approaches such as imparting lubricity to the photosensitive layer, curing the photosensitive layer, providing fillers therein, or using a charge transport polymer instead of a charge transport material having a low molecular weight dispersed in the polymer layer are widely known to improve the durability of the image bearing member.

Although successful in preventing abrasion of the photosensitive layer, these approaches cause new problems.

That is, ozone, NOx, and other acidic gases that are produced during repetitive use or depending on surrounding conditions are attached to the surface of the photosensitive layer with repetitive use and depending on use conditions, thereby reducing the resistance of the uppermost surface layer of the image bearing member, resulting in problems such as image flow (image blur). Typically, these materials causing such image flow are scraped away little by little together with the photosensitive layer, so that such problems can be avoided to some degree.

However, new approaches are needed to meet demand for higher resolution and better durability as described above. Heating an image bearing member by a heater is one conceivable approach to reduce the impact of such problems but is not preferable in terms of size reduction of the device and power consumption. Furthermore, adding additives such as antioxidants is also effective, but since simple additives have no photoconductivity, addition of additives in large amounts leads to deterioration of electrophotography characteristics such as sensitivity and an increase in the residual voltage.

As described above, a highly durable image bearing member or one which is less vulnerable to abrasion (achieved by process designing around the image bearing member) has inevitable side-effects on image quality, such as image flow and reduction in resolution. Therefore, making an image bearing member having both good durability and with an ability to produce high-quality images has been thought to be difficult to achieve. This is because a high resistance is preferable to reduce the occurrence of image flow whereas a low resistance is preferable to reduce an increase in the residual voltage.

In addition, almost all of the image bearing members currently on the market are of the functionally separated laminate structure type, in which the charge generation layer and the charge transfer layer are laminated on an electroconductive substrate. In addition, the charge transfer material contained in the charge transfer layer is a positive hole transfer material. This arrangement is used in a negative charging electrophotography process.

Furthermore, a charging system using corona discharging is reliable in the electrophotography, and for that reason is employed in most photocopiers and printers. However, as is known, scorotron charging systems are employed because negative corona discharging is not as stable as positive discharging. Therefore, the cost increases. Also, negative corona discharging produces a larger amount of ozone, which causes chemical damage. Therefore, problems easily arise such that ozone produced during charging degrades the binder resin and the charge transfer material contained in the photosensitive layer by oxidization, and ionized compounds produced during charging such as nitrogen oxide ions, sulfur oxide ions, and ammonium ions accumulate on the surface, which has an adverse impact on the image quality. Therefore, most printers and photocopiers employing the negative charging system have ozone filters to prevent the ozone from being discharged to the outside. This also increases the cost. Furthermore, ozone produced in large amounts is environmentally damaging.

To solve such problems, a positive charging image bearing member has been researched and developed. A positive charging image bearing member can reduce the amount of ozone, nitrogen oxides, and the like that is produced. In addition, a positive charging image bearing member used with a currently widely used two-component development agent produces reliably good images with little environment-induced change. This is another advantage of the positive charging image bearing member over the negative.

However, in a positive charging image bearing member having a single layer structure or a reverse laminate structure, the charge generation material, which is extremely susceptible to oxidizing substances such as ozone, nitrogen oxide ions, and the like, is present on or around the surface of the image bearing member and is significantly affected by emission gases from blue heaters, automobiles, etc.

As described above, the negative charging image bearing member is preferable to the positive charging image bearing member for high-speed photocopying processes.

The reason is that almost all of the organic materials having a high charge transferability sufficient for high-speed photocopying processes are currently positive hole transfer materials having only positive hole transfer characteristics. Therefore, the charging property of an image bearing member having a regularly arranged laminate structure in which a charge transfer layer formed of a positive hole transfer material is provided on the surface side is limited to negative charging in principle.

As described above, with regard to the charging polarity, an image bearing member that can be both negatively and positively charged has a wider applicability and is advantageous in terms of cost reduction by reducing the kinds of manufactured image bearing members and in terms of the ability to execute high-speed processing.

Japanese patent no. 2732697 (hereinafter referred to as JP-2732697-B) describes an image bearing member that can be both negatively and positively charged. Although successful in some degree, since the charge transport materials of diphenoquinone derivatives are somewhat slow in terms of charge transferability, the obtained characteristics of the image bearing member are not sufficient for high-speed processing and compact photocopiers and printers. To make matters worse, with repetitive use a machine using this image bearing member produces abnormal images having image flow.

In addition, Japanese patent application publication no. 2000-231204 (hereinafter referred to as JP-2000-231204-A) describes usage of an acid remover consisting of an aromatic compound having a dialkyl amino group for an image bearing member. This compound is preferable in terms of maintaining image quality for an extended period of time. However, this compound has a low charge transport power so that it is difficult to meet the demand for high sensitivity and high-speed processing. Therefore, there is a limit to the addition amount of the compound.

Furthermore, KONICA Technical report vol. 13 (37 page, published in 2000, authored by Itami, et al) describes that stilbene compounds having a dialkyl amino group described in JP-S60-196768-A, JP-2884353-B, etc. are effective to reduce image flow caused by oxidizing gases. However, since this has a dialkyl amino group as a substitution group having a strong mesomeric effect (+M effect) at the resonance portion of the triaryl amine structure serving as the charge transfer site, the overall ionization potential value is extremely small.

Therefore, the charge holding power of the photosensitive layer using the compound as the only positive hole transport material is inferior from the start or deteriorates with repetitive use. This is a fatal defect for commercial viability. If the compound is used in combination with other charge transport materials, since the stiblene compound has a considerably smaller ionization potential than those of the other materials, the stilbene compound serves as a hole trap site for the transported charge, thereby degrading the sensitivity and increasing the residual voltage.

JP-2004-258253-A describes an image bearing member that has improved durability and environment resistance to acidic gases, etc. by containing a stilbene compound and a specific diamine compound without causing deterioration of the sensitivity. However, the image bearing member is not sufficient to achieve high-speed processing or size reduction of the printers, which use an image bearing member having a smaller diameter.

Journal of the Chemical Society, Perkin Transactions 1: Organic and Bio-Organic Chemistry, 21, 2728 (1972), authored by D. W. Jones describes synthesis methods of 1,3-diphenyl-2-phthalimide isoindol with regard to naphtalene tetracarbonic acid diimide-isoindol derivatives and naphthalimide-isoindol derivatives, but there is no mention of applying the synthesized material to an image bearing member.

For these reasons, the present inventors recognize that a need exists for an image bearing member that reliably produces high-quality images while maintaining good durability against repetitive use for an extended period of time and reducing deterioration of image quality caused by a decrease in image density or occurrence of image blur, an image bearing member that can be charged negatively or positively, and an image formation method, an image forming apparatus, and a process cartridge using the image bearing member to improve the speed of printing, achieve overall apparatus size reduction, and reliably produce quality images for an extended period of time with repetitive use.

SUMMARY OF THE INVENTION

Accordingly, an object of the present invention is to provide an image bearing member that stably produce quality images while maintaining a durability against repetitive use for an extended period of time and reducing deterioration of the image quality caused by decrease of the image density or occurrence of image blur, and an image bearing member that can be charged negatively or positively, and an image formation method, an image forming apparatus, and a process cartridge using the image bearing member to improve the speed of printing, achieve size reduction, and stably produce quality images for an extended period of time for repetitive use.

Briefly this object and other objects of the present invention as hereinafter described will become more readily apparent and can be attained, either individually or in combination thereof, by an image bearing member having an electroconductive substrate and a photosensitive layer provided overlying the electroconductive substrate, the photosensitive layer containing at least one of charge transport material selected from the group consisting of a naphthalene tetracarboxylic acid diimide-isoindol derivative represented by the following chemical structure 1, a naphthalimide-isoindol derivative represented by the following chemical structure 2, and a triphenyl amine-isoindol derivative represented by the following chemical structure 3, Chemical structure 1

(1)

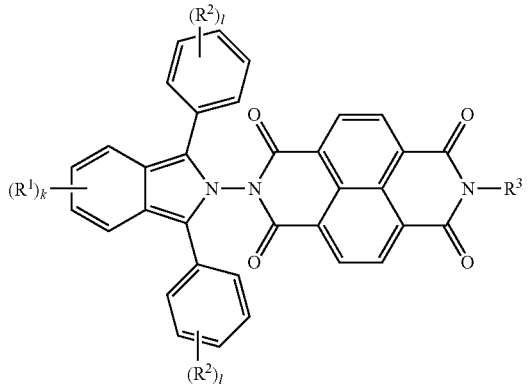

where $R_1$ and $R_2$ independently represent a hydrogen atom, a substituted or non-substituted alkyl group, an alkoxy group, a substituted or non-substituted aromatic hydrocarbon group, a halogen atom, and a nitro group, k represents an integer of 1 to 4, and l represents an integer of from 1 to 5 and $R_3$ represents a substituted or non-substituted alkyl group, a substituted or non-substituted cycloalkyl group, and a substituted or non-substituted aromatic hydrocarbon group, Chemical structure 2

(2)

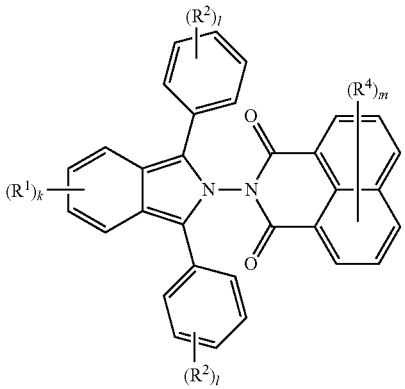

where $R_1$, $R_2$, and $R_4$ independently represent a hydrogen atom, a substituted or non-substituted alkyl group, an alkoxy group, a substituted or non-substituted aromatic hydrocarbon group, a halogen atom, and nitro group, and k represents an integer of 1 to 4, l represents an integer of from 1 to 5, and m represents an integer of 1 to 6, and Chemical structure 3

(3)

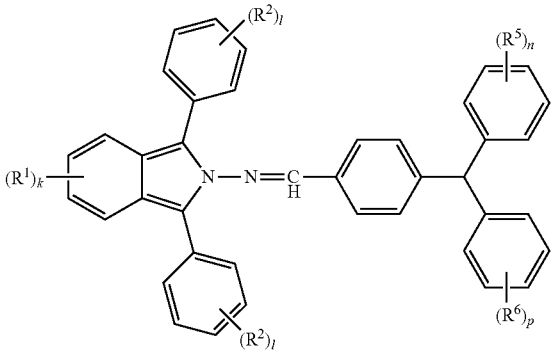

where $R_1$, $R_2$, $R_5$, and $R_6$ independently represent a hydrogen atom, a substituted or non-substituted alkyl group, an alkoxy group, a substituted or non-substituted aromatic hydrocarbon group, a halogen atom, and nitro group, and k represents an integer of 1 to 4, and 1, n, and p represent integers of from 1 to 5.

It is preferred that the image bearing member mentioned above can be positively or negative charged.

It is still further preferred that, in the image bearing member mentioned above, the photosensitive layer further contains an additional charge transport material.

It is still further preferred that, in the image bearing member mentioned above, the additional charge transport material is a derivative represented by the following chemical structure 4, Chemical structure 4

(4)

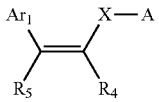

where X represents a single bond or a vinylene group, $R_4$ represents a hydrogen atom, a substituted or non-substituted alkyl group, or a substituted or non-substituted aromatic hydrocarbon group, $Ar_1$ represents a substituted or non-substituted aromatic hydrocarbon group, $R_5$ represents a hydrogen atom, a substituted or non-substituted alkyl group, or a substituted or non-substituted aromatic hydrocarbon group, and $Ar_1$ and $R_5$ optionally share bond connectivity to form a ring, and A represents a compound represented by the following chemical structure 5, a compound represented by the following chemical structure 6, 9-anthryl group, or a substituted or non-substituted carbazolyl group, Chemical structure 5

(5)

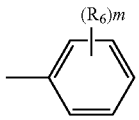

Chemical structure 6

(6)

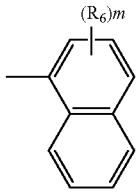

$R_6$ represents a hydrogen atom, an alkyl group, an alkoxy group, a halogen atom, or a compound represented by the following chemical structure 7, Chemical structure 7

(7)

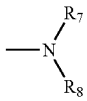

where $R_7$ and $R_8$ represent a substituted or non-substituted alkyl group or a substituted or non-substituted aromatic hydrocarbon group, and optionally share bond connectivity to form a ring, and m represents an integer of from 1 to 3 and $R_6$ can be the same or different when m is 2 or 3.

It is still further preferred that, in the image bearing member mentioned above, the additional charge transport material is a derivative represented by the following chemical structure 8, Chemical structure 8

(8)

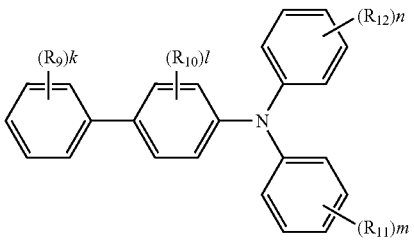

where $R_9$, $R_{11}$, and $R_{12}$ represent a hydrogen atom, amino group, an alkoxy group, a thioalkoxy group, an aryloxy group, methylene dioxy group, a substituted or non-substituted alkyl group, a halogen atom, or a substituted or non-substituted aromatic hydrocarbon group, $R_{10}$ represent a hydrogen atom, an alkoxy group, a substituted or non-substituted alkyl group, or a halogen atom, k, l, m, and n represent integers of from 1, 2, 3, or 4, and $R_9$, $R_{10}$, $R_{11}$, and $R_{12}$ can be the same or different when each of them is 2, 3, or 4.

It is still further preferred that, in the image bearing member mentioned above, the additional charge transport material is an another derivative represented by the following chemical structure 9, Chemical structure 9

(9)

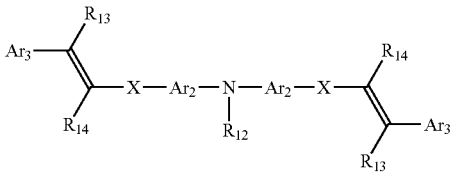

where X represents a single bond or a vinylene group, $R_{13}$ represents a hydrogen atom, a substituted or non-substituted alkyl group, or a substituted or non-substituted aromatic hydrocarbon group, $Ar_3$ represents a substituted or non-substituted aromatic hydrocarbon group, $R_{14}$ represents a hydrogen atom, a substituted or non-substituted alkyl group, or a substituted or non-substituted aromatic hydrocarbon group, and $Ar_3$ and $R_{13}$ optionally share bond connectivity to form a ring, $Ar_2$ represents a compound represented by the following chemical structure 10 or 11, Chemical structure 10

(10)

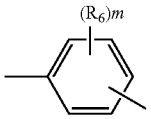

Chemical structure 11

(11)

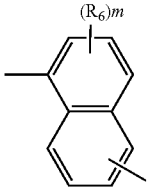

where $R_6$ represents a hydrogen atom, an alkyl group, an alkoxy group, or a halogen atom, m represent an integer of from 1 to 3 and $R_6$ can be the same or different when m is 2 or 3, and $R_{12}$ represents a substituted or non-substituted alkyl group, or a substituted or non-substituted aromatic hydrocarbon group.

It is still further preferred that, in the image bearing member mentioned above, the additional transport material is a derivative represented by the following chemical structure 12, Chemical structure 12

(12)

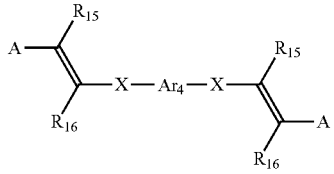

where X represents a single bond or a vinylene group, $R_{15}$ represents a hydrogen atom, a substituted or non-substituted alkyl group, or a substituted or non-substituted aromatic hydrocarbon group, $Ar_4$ represents a substituted or non-substituted divalent aromatic hydrocarbon group, $R_{16}$ represents a hydrogen atom, a substituted or non-substituted alkyl group, or a substituted or non-substituted aromatic hydrocarbon group, and A represents a compound represented by the chemical structure 5, a compound represented by the following chemical structure 6, 9-anthryl group, or a substituted or non-substituted carbazolyl group, Chemical structure 5

(5)

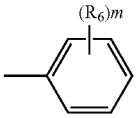

Chemical structure 6

(6)

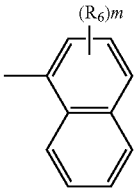

$R_6$ represents a hydrogen atom, an alkyl group, an alkoxy group, a halogen atom, or a compound represented by the following chemical structure 7, Chemical structure 7

(7)

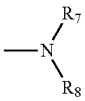

where $R_7$ and $R_8$ independently represent a substituted or non-substituted alkyl group or a substituted or non-substituted aromatic hydrocarbon group and optionally share bond connectivity to form a ring, and m represents an integer of from 1 to 3 and when m is 2 or 3, $R_6$ can be the same or different.

It is still further preferred that, in the image bearing member mentioned above, the additional charge transport material is a derivative represented by the following chemical structure 13, Chemical structure 13

(13)

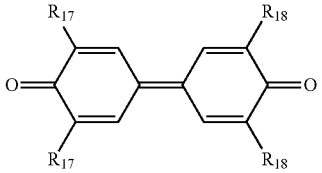

where $R_{17}$ and $R_{18}$ independently represent a hydrogen atom, a substituted or non-substituted alkyl group, or a substituted or non-substituted aromatic hydrocarbon groups.

It is still further preferred that, in the image bearing member mentioned above, the additional charge transport material is a derivative represented by the following chemical structure 14, Chemical structure 14

(14)

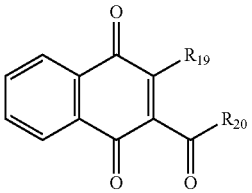

where $R_{19}$ represents a hydrogen atom, a substituted or non-substituted alkyl group, or a substituted or non-substituted aryl group and $R_{20}$ represents a substituted or non-substituted alkyl group, a substituted or non-substituted aromatic hydrocarbon group, or a group represented by the chemical structure 15, Chemical structure 15

$$—O—R_{21} \quad (15)$$

where $R_{21}$ represents a substituted or non-substituted alkyl group or a substituted or non-substituted aryl group.

It is still further preferred that, in the image bearing member mentioned above, the additional charge transport material is a derivative represented by the following chemical structure 16, Chemical structure 16

(16)

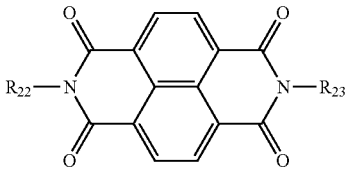

where $R_{22}$ and $R_{23}$ independently represent a hydrogen atom, a substituted or non-substituted alkyl group, or a substituted or non-substituted aromatic hydrocarbon group.

It is still further preferred that, in the image bearing member mentioned above, the additional charge transport material is a derivative represented by the following chemical structure 17, Chemical structure 17

(17)

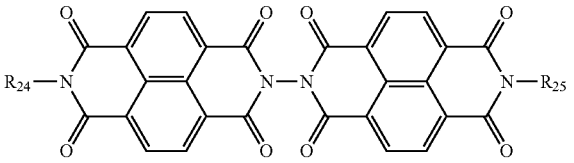

where $R_{24}$ and $R_{25}$ independently represent a hydrogen atom, a substituted or non-substituted alkyl group, or a substituted or non-substituted aromatic hydrocarbon group.

It is still further preferred that, in the image bearing member mentioned above, the photosensitive layer includes charge transport layer laminated on a charge generation layer.

It is still further preferred that, in the image bearing member mentioned above, the photosensitive layer includes a charge generation layer laminated on a charge transport layer.

It is still further preferred that, in the image bearing member mentioned above, the photosensitive layer has a single-layered structure.

As another aspect of the present invention, a method of forming images is provided which includes charging the image bearing member mentioned above, irradiating the image bearing member with light according to image data to form a latent electrostatic image on the image bearing member, developing the latent electrostatic image with a development agent containing toner to obtain a visualized image, and transferring the visualized image to a recording medium.

As another aspect of the present invention, an image forming apparatus is provided which includes the image bearing member mentioned above, a charger that charges the image bearing member, an irradiator that irradiates the image bearing member with light to form a latent electrostatic image on a surface of the image bearing member, a development device that develops the latent electrostatic image with a development agent comprising toner to obtain a visualized image, and a transfer device that transfers the visualized image to a recording medium.

As another aspect of the present invention, a process cartridge is provided which includes the image bearing member mentioned above and at least one of a charger, an irradiator, a development device, and a cleaner.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE PRESENT DISCLOSURE

Figure 1:
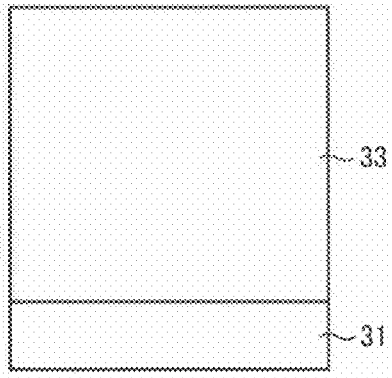
FIG. 1 is a diagram illustrating a cross section of an example of the image bearing member of the present invention.

As a result of inventive studies made by the present inventors, the present inventors have found that an image bearing member having a photosensitive layer that can be positively or negatively charged is obtained by containing at least one compounds (charge transport materials) of a naphthalene tetracarboxylic acid diimide-isoindol derivative represented by the chemical structure 1, a naphthalimide-isoindol derivative represented by the chemical structure 2, and a triphenyl amine-isoindol derivative represented by the chemical structure 3 to solve problems such as image flow caused by an image blur causing material such as oxidizing gas.

Chemical structure 1

(1)

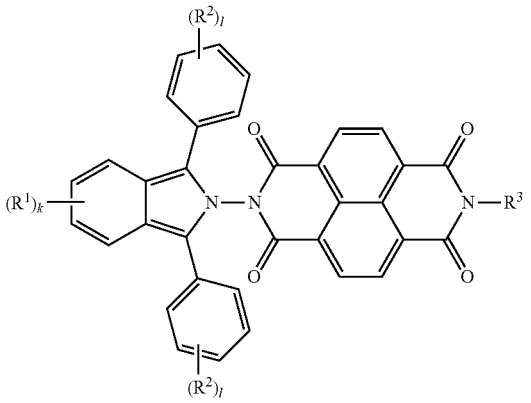

In the chemical structure 1, $R^1$ and $R^2$ independently represent a hydrogen atom, a substituted or non-substituted alkyl group, an alkoxy group, a substituted or non-substituted aromatic hydrocarbon group, a halogen atom, and nitro group.

"k" represents an integer of 1 to 4, and "1" represents an integer of from 1 to 5.

$R^3$ represents a substituted or non-substituted alkyl group, a substituted or non-substituted cycloalkyl group, and a substituted or non-substituted aromatic hydrocarbon group.

Chemical structure 2

(2)

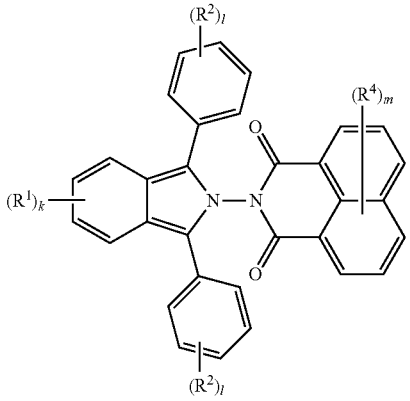

In the chemical structure 2, $R^1$, $R^2$, and $R^4$ independently represent a hydrogen atom, a substituted or non-substituted alkyl group, an alkoxy group, a substituted or non-substituted aromatic hydrocarbon group, a halogen atom, and nitro group.

"k" represents an integer of 1 to 4, "1" represents an integer of from 1 to 5, and "m" represents an integer of 1 to 6.

Chemical structure 3

(3)

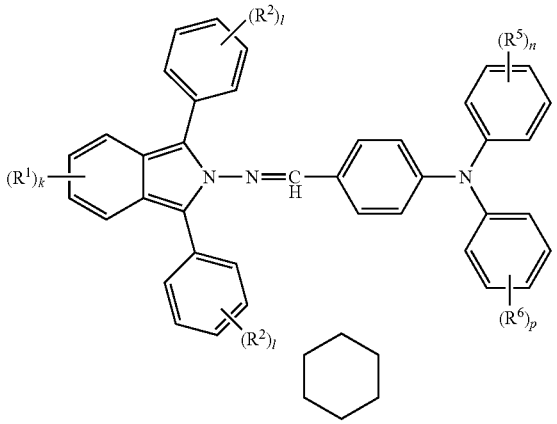

In the chemical structure 3, $R^1$, $R^2$, $R^5$, and $R^6$ independently represent a hydrogen atom, a substituted or non-substituted alkyl group, an alkoxy group, a substituted or non-substituted aromatic hydrocarbon group, a halogen atom, and nitro group. "k" represents an integer of 1 to 4, "1", "n", and "p" independently represent integers of from 1 to 5.

Although the mechanism is not clear, naphthalene tetracarboxylic acid diimide-isoindol derivatives, naphthalimide-isoindol derivatives, and triphenyl amine-isoindol derivatives are good to maintain the image quality over a repetitive use. It is conferred that amine groups contained in their chemical structures of naphthalene tetracarboxylic acid diimide-isoindol derivative and naphthalimide-isoindol derivative are strong basic groups and thus have an electrical neutralization effect for oxidizing gases considered as the root cause of image blur.

In addition, with regard to triphenyl amine-isoindol derivative, since the indol group contained in the chemical structure thereof is a strong basic group, the group is inferred to have an electrical neutralization effect for oxidizing gases considered as the root cause of image blur.

In addition, a combinational use of naphthalene tetracarboxylic acid diimide-isoindol derivative, naphthalimide-isoindol derivative, and triphenyl amine-isoindol derivative in the present disclosure with other charge transport materials increases the sensitivity and stability against an extended period of time.

In addition, since naphthalene tetracarboxylic acid diimide-isoindol derivative, naphthalimide-isoindol derivative, and triphenyl amine-isoindol derivative in the present disclosure are both polarity transport materials, an image bearing member using such materials are able to deal with both negative and positive charging irrespective of the kind of the layer structure and the mixture of the charge transport materials.

Thus, the present inventors provide an image bearing member that can be charged positively or negatively and stably produce quality images for an extended period of time with a good combination of durability and the image quality and an image formation method, an image forming apparatus, and a process cartridge that can stably produce quality images for an extended period of time by using the image bearing member.

The image bearing member, the image formation method, the image forming apparatus, and the process cartridge of the present disclosure are described in detail below.

First, naphthalene tetracarboxylic acid diimide-isoindol derivative represented by the chemical structure 1 contained in the photosensitive layer is described in detail.

Chemical structure 1

(1)

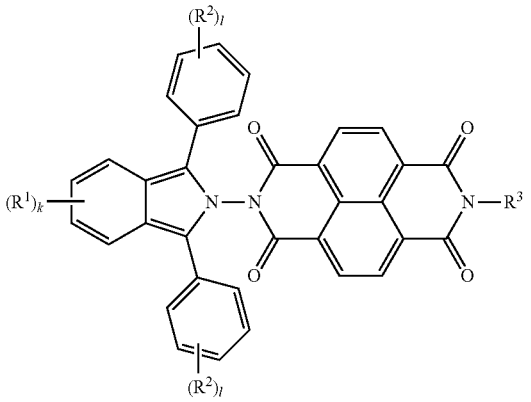

In the chemical structure 1, $R^1$ and $R^2$ independently represent a hydrogen atom, a substituted or non-substituted alkyl group, an alkoxy group, a substituted or non-substituted aromatic hydrocarbon group, a halogen atom, and nitro group. "k" represents an integer of 1 to 4, and "1" represents an integer of from 1 to 5. $R^3$ represents a substituted or non-substituted alkyl group, a substituted or non-substituted cycloalkyl group, and a substituted or non-substituted aromatic hydrocarbon group.

Naphthalene tetracarboxylic acid diimide-isoindol derivative represented by the chemical structure 1 can be manufactured by an application method of the method described in Journal of the Chemical Society, Perkin Transactions 1: Organic and Bio-Organic Chemistry, 21, 2728 (1972), authored by D. W. Jones.

To be specific, for example, naphthalene tetracarboxylic acid diimide-isoindol derivative represented by the chemical structure 1 can be manufactured by reacting N-amino-4,5-dimethyl-2,7-diphenyl isoindol derivative and naphthalene tetra carboxylic acid monoimide derivative in the first process.

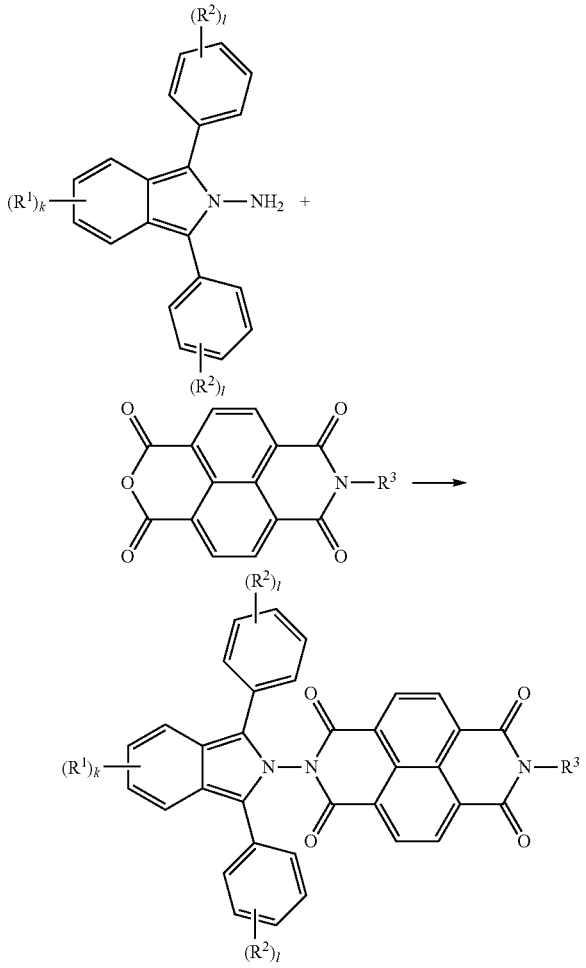

Although there is no specific limit to the selection of the solvents, benzene, toluene, xylene, chloronaphthalene, acetic acid, pyridine, methylpyridine, N,N-dimethylformamide, N,N-dimethylacetoamide, and carbon tetrachloride are specifically suitable.

The heating temperature is preferably 100° C. or higher.

Specific examples of alkyl group contained in the chemical structure 1 include, but are not limited to, methyl group, ethyl group, propyl group, butyl group, pentyl group, hexyl group, heptyl group, and undecanyl group.

Specific examples of the aromatic hydrocarbons include, but are not limited to, aromatic ring groups such as benzene, biphenyl, naphthalene, anthracene, fluorene, and pyrene and aromatic heterocyclic ring groups such as pyridine, quinoline, thiophene, furan, oxazole, oxadiazole, and carbazole. Specific examples of halogen atoms include, but are not limited to, fluorine atom, chlorine atom, bromine atom, and iodine atom.

Specific examples of the substitution groups for these include, but are not limited to, alkyl groups specified above, alkoxy groups such as methoxy group, ethoxy group, propoxy group, and buthoxy group, or halogen atoms specified above, dialkylamino group, diphenyl amino group, nitro group, aromatic hydrocarbon groups specified above, and heterocyclic ring groups such as pyrrolidine, piperidine, and piperazine.

Preferable specific examples of the compound represented by the chemical structure 1 include the following.

However, the present disclosure is not limited thereto.

In Table 1, two $R^2$'s in the chemical structure 1 are independently the group specified in Table 1 and substituted just the same.

TABLE 1

(1)

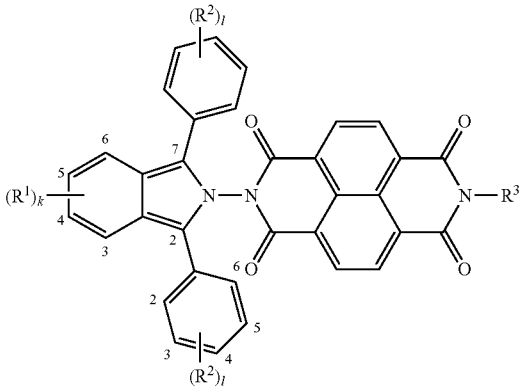

| No. | $R^1$ | $R^2$ | $R^3$ |
|---|---|---|---|
| 1 | H | H | 4-Heptyl |
| 2 | H | 4-Methyl | 4-Heptyl |
| 3 | H | 4-Methoxy | 4-Heptyl |
| 4 | H | 4-Phenyl | 4-Heptyl |
| 5 | H | 4-Chloro | 4-Heptyl |
| 6 | H | 4-Nitro | 1,2-Dimethylpropyl |
| 7 | H | 2,3,4,5,6-pentafluoro | 2-Heptyl |
| 8 | 4,5-Dimethyl | H | 2-Heptyl |
| 9 | 4,5-Diethyl | 2,4,6-Trimethyl | 2-Heptyl |
| 10 | 4,5-Dimethyl | 2,4-6-Trimethoxy | 2-Heptyl |
| 11 | 4,5-bis (trifluoromethyl) | 2-Phenyl | 2-Heptyl |
| 12 | 4,5-Dimethyl | 2-Chloro | 2-Heptyl |
| 13 | 4,5-Diethyl | 2-Nitro | 3-Pentyl |
| 14 | 4,5-Dimethyl | 2,3,4,5,6-pentafluoro | 3-Pentyl |
| 15 | 4,5-Dimethoxy | H | 3-Pentyl |
| 16 | 4,5-Diethoxy | 3-Methyl | Isopropyl |
| 17 | 4,5-Dimethoxy | 3-Methoxy | Isopropyl |
| 18 | 4,5-Diethoxy | 3-Phenyl | Isopropyl |
| 19 | 4,5-Dimethoxy | 3-Chloro | Isobutyl |
| 20 | 4,5-Diethoxy | 3-Nitro | 3-Ethoxypropyl |
| 21 | 4,5-Dimethyl | 2,3,4,5,6-pentafluoro | Isoamyl |
| 22 | 4,5-Diphenyl | H | n-Butyl |
| 23 | 4,5-Bis (perfluoropheny) | 4-Trifuluoromethyl | sec-Butyl |
| 24 | 4,5-Diphenyl | 4-Methoxy | Cyclohexyl |
| 25 | Bis (4,5-perfluoropheny) | 4-Phenyl | 2-Ethylhexyl |
| 26 | 4,5-Difluoro | 4-Chloro | Cyclopentyl |
| 27 | 4,5-Dichloro | 4-Nitro | Phenyl |

TABLE 1-continued (1)

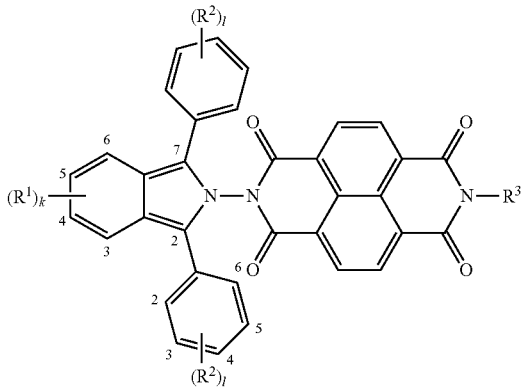

| No. | $R^1$ | $R^2$ | $R^3$ |
|---|---|---|---|
| 28 | 4,5-Difluoro | 4-(4-trifluoromethyl) phenyl | 3,5-Dimethylphenyl |
| 29 | 4,5-Diethyl | H | 2-Ethyl-6-methylphenyl |
| 30 | 4,5-Dimethyl | 4-Trifuluoromethyl | 2,4-Dimethylphenyl |
| 31 | 4,5-bis (trifluoromethyl) | 4-Methoxy | 1,2-Dimethylpropyl |
| 32 | 4,5-Dimethyl | 4-Phenyl | 4-Methylphenyl |
| 33 | 4,5-Diethyl | 4-Chloro | 2,4,6-Trimethylphenyl |

Next, naphthalimide-isoindol derivative represented by the chemical structure 2 contained in the photosensitive layer is described in detail.

Chemical structure 2

(2)

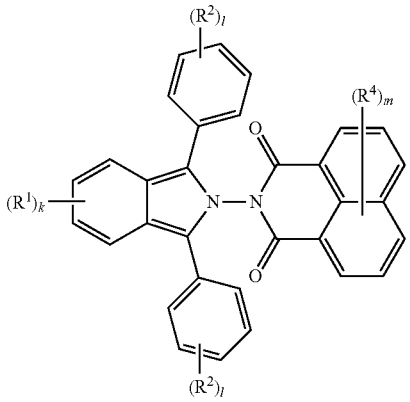

In the chemical structure 2, $R^1$, $R^2$, and $R^4$ independently represent a hydrogen atom, a substituted or non-substituted alkyl group, an alkoxy group, a substituted or non-substituted aromatic hydrocarbon group, a halogen atom, and nitro group. "k" represents an integer of 1 to 4, "l" represents an integer of from 1 to 5, and "m" represents an integer of 1 to 6.

Naphthalimide-isoindol derivative represented by the chemical structure 2 can be manufactured by an application method of the method described in Journal of the Chemical Society, Perkin Transactions 1: Organic and Bio-Organic Chemistry, 21, 2728 (1972), authored by D. W. Jones.

To be specific, for example, naphthalimide-isoindol derivative represented by the chemical structure 2 can be manufactured by reacting N-amino-4,5-dimethyl-2,7-diphenyl isoindol derivative and an anhydride derivative of naphthalic acid in the first process.

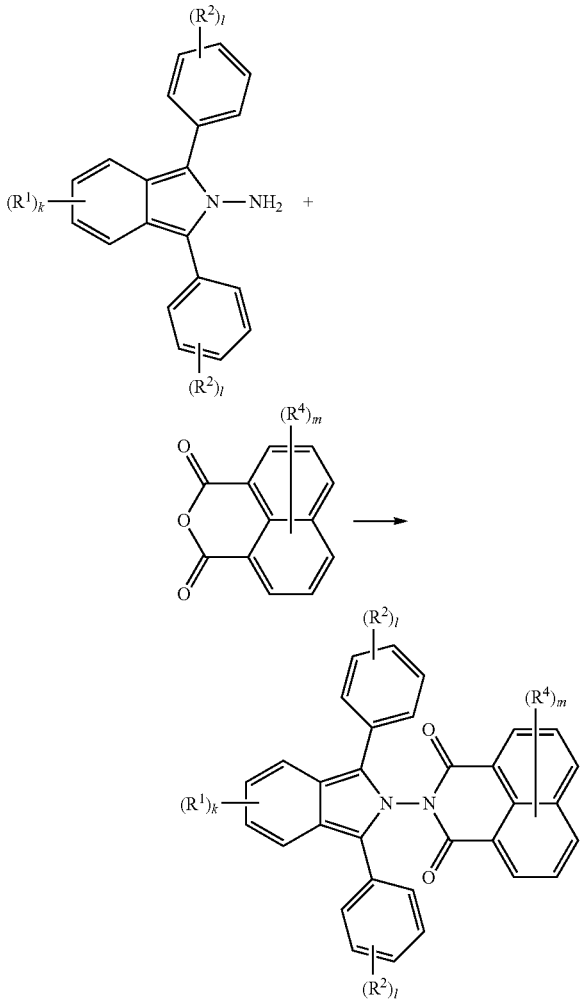

Although there is no specific limit to the selection of the solvents, benzene, toluene, xylene, chloronaphthalene, acetic acid, pyridine, methylpyridine, N,N-dimethylformamide, N,N-dimethylacetoamide, and ocarbon tetrachloride are specifically suitable.

The heating temperature is preferably 100° C. or higher.

Specific examples of alkyl group contained in the chemical structure 2 include, but are not limited to, methyl group, ethyl group, propyl group, butyl group, hexyl group, and undecanyl group. Specific examples of the aromatic hydrocarbons include, but are not limited to, aromatic ring groups such as benzene, biphenyl, naphthalene, anthracene, fluorene, and pyrene and aromatic heterocyclic ring groups such as pyridine, quinoline, thiophene, furan, oxazole, oxadiazole, and carbazole. Specific examples of halogen atoms include, but are not limited to, fluorine atom, chlorine atom, bromine atom, and iodine atom.

Specific examples of the substitution groups for these include, but are not limited to, alkyl groups specified above, alkoxy groups such as methoxy group, ethoxy group, propoxy group, and buthoxy group, or halogen atoms specified above, dialkylamino group, diphenyl amino group, nitro group, aromatic hydrocarbon groups specified above, and heterocyclic ring groups such as pyrrolidine, piperidine, and piperazine.

Preferable specific examples of the compound represented by the chemical structure 2 include the following. However, the present disclosure is not limited thereto.

In Table 2, two $R^{2}$'s in the chemical structure 2 are independently the group specified in Table 2 and substituted just the same.

TABLE 2

Chemical structure 2

(2)

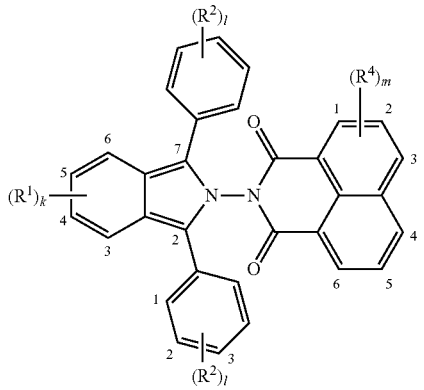

| No. | $R^1$ | $R^2$ | $R^4$ |
|---|---|---|---|
| 1 | H | H | H |
| 2 | H | 4-Methyl | 3,4-Dimethyl |
| 3 | H | 4-Methoxy | 3,4-Dibromo |
| 4 | H | 4-Phenyl | 3-Phenyl |
| 5 | H | 4-Chloro | 3,4-Dimethoxy |
| 6 | H | 4-Nitro | 3-Nitro |
| 7 | H | 2,3,4,5,6-Pentafluoro | 1,2,3,4,5,6-Hexafluoro |
| 8 | 4,5-Dimethyl | H | H |
| 9 | 4,5-Diethyl | 2,4,6-Trimethyl | 3,4-Diethyl |
| 10 | 4,5-Dimethyl | 2,4-6-Trimethoxy | 3,4-Dichloro |
| 11 | 4,5-bis (trifluoromethyl) | 2-Phenyl | 3-Benzyl |
| 12 | 4,5-Dimethyl | 2-Chloro | 2-Diethoxy |
| 13 | 4,5-Diethyl | 2-Nitro | 2-Nitro |
| 14 | 4,5-Dimethyl | 2,3,4,5,6-pentafluoro | 1,2,3,4,5,6-Hexafluoro |
| 15 | 4,5-Dimethoxy | H | H |
| 16 | 4,5-Diethoxy | 3-Methyl | 2,5-Dimethyl |
| 17 | 4,5-Dimethoxy | 3-Methoxy | 2,5-Dibromo |
| 18 | 4,5-Diethoxy | 3-Phenyl | 3-Cyclohexyl |
| 19 | 4,5-Dimethoxy | 3-Chloro | 2-Trifluoromethyl |
| 20 | 4,5-Diethoxy | 3-Nitro | 2,5-Dinitro |
| 21 | 4,5-Dimethyl | 2,3,4,5,6-pentafluoro | 2,5-Diphenyl |
| 22 | 4,5-Diphenyl | H | H |
| 23 | 4,5-Bis(perfluorophenyl) | 4-Trifuluoromethyl | 1,6-Dimethyl |
| 24 | 4,5-Diphenyl | 4-Methoxy | 1,6-Pentafluoroethoxy |
| 25 | Bis(4,5-perfluorophenyl) | 4-Phenyl | 3-(2,4,6-Trimethyl)-phenyl |
| 26 | 4,5-Difluoro | 4-Chloro | 2,5-Bromo |
| 27 | 4,5-Dichloro | 4-Nitro | 2,5-Dihexyl |
| 28 | 4,5-Dinitro | 4-(4-trifluoromethyl) phenyl | 1,2,3,4,5,6-Hexafluoro |
| 29 | 4,5-Diethyl | H | H |
| 30 | 4,5-Dimethyl | 4-Trifuluoromethyl | 3,4-Dimethyl |
| 31 | 4,5-bis (trifluoromethyl) | 4-Methoxy | 3,4-Diiodo |
| 32 | 4,5-Dimethyl | 4-Phenyl | 2-Biphenyl |
| 33 | 4,5-Diethyl | 4-Chloro | 3,4-Dimethoxy |

Next, triphenyl amine-isoindol derivative represented by the chemical structure 3 contained in the photosensitive layer is described in detail.

Chemical structure 3

(3)

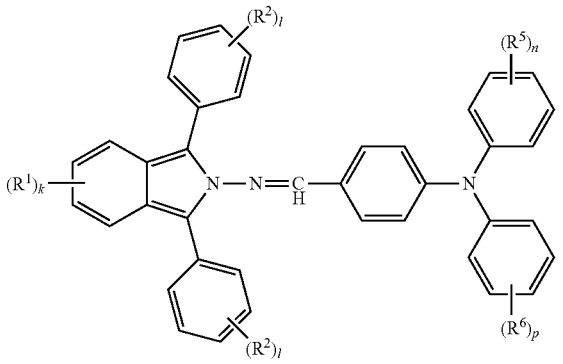

In the chemical structure 3, $R^1$, $R^2$, $R^5$, and $R^6$ independently represent a hydrogen atom, a substituted or non-substituted alkyl group, an alkoxy group, a substituted or non-substituted aromatic hydrocarbon group, a halogen atom, and nitro group. "k" represents an integer of 1 to 4, "l", "n", and "p" independently represent integer of from 1 to 5.

Triphenyl amine-isoindol derivative represented by the chemical structure 3 can be manufactured by the following method.

To be specific, for example, triphenyl amine-isoindol derivative represented by the chemical structure 3 can be manufactured by reacting N-aminodiphenyl isoindoland triphenyl amine aldehyde.

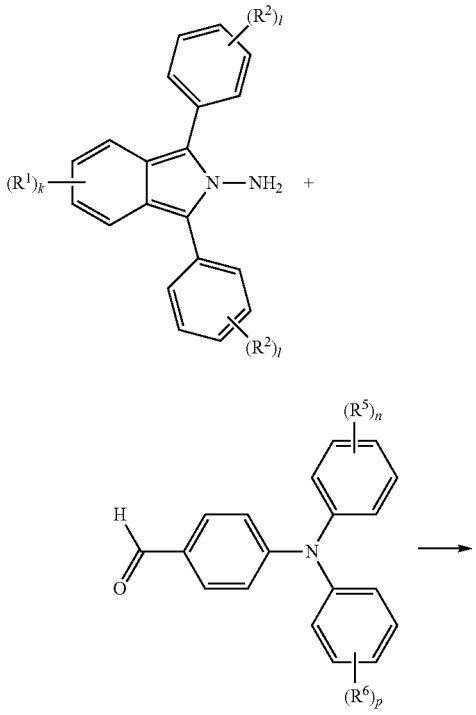

-continued

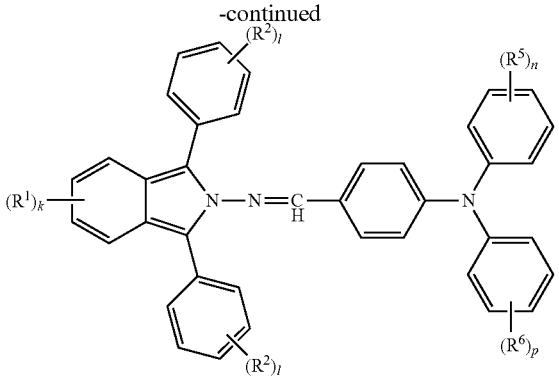

Although there is no specific limit to the selection of the solvents, benzene, toluene, xylene, chloronaphthalene, acetic acid, pyridine, methylpyridine, N,N-dimethylformamide, N,N-dimethylacetoamide, carbon tetrachloride, chloroform, and dichloromethane are specifically suitable.

The heating temperature is preferably from room temperature to 100° C.

Specific examples of alkyl group contained in the chemical structure 3 include, but are not limited to, methyl group, ethyl group, propyl group, butyl group, hexyl group, and undecanyl group.

Specific examples of the aromatic hydrocarbons include, but are not limited to, aromatic ring groups such as benzene, biphenyl, naphthalene, anthracene, fluorene, and pyrene and aromatic heterocyclic ring groups such as pyridine, quinoline, thiophene, furan, oxazole, oxadiazole, and carbazole. Specific examples of halogen atoms include, but are not limited to, fluorine atom, chlorine atom, bromine atom, and iodine atom.

Specific examples of the substitution groups for these include, but are not limited to, alkyl groups specified above, alkoxy groups such as methoxy group, ethoxy group, propoxy group, and buthoxy group, or halogen atoms specified above, dialkylamino group, diphenyl amino group, nitro group, aromatic hydrocarbon groups specified above, and heterocyclic ring groups such as pyrrolidine, piperidine, and piperazine.

Preferable specific examples of the compound represented by the chemical structure 3 include the following. However, the present disclosure is not limited thereto

TABLE 3-1

1

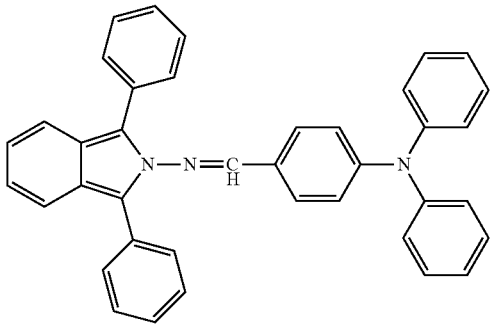

TABLE 3-1-continued
2
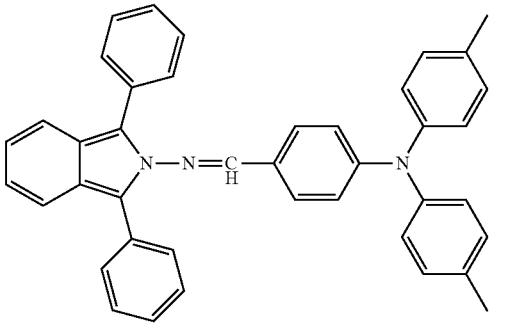
3
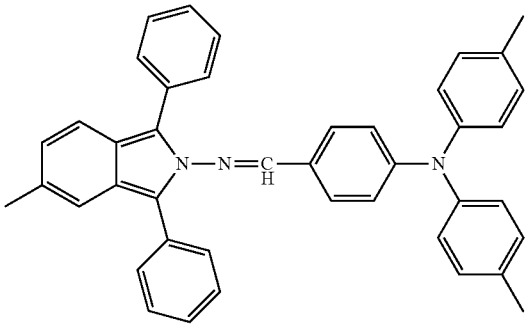
4
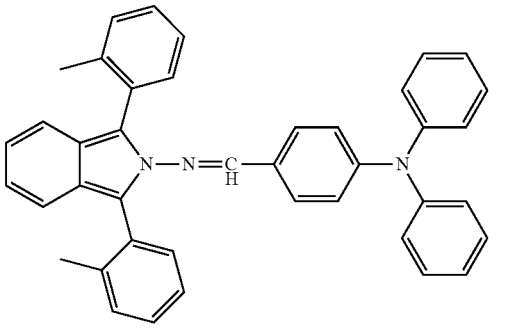
5
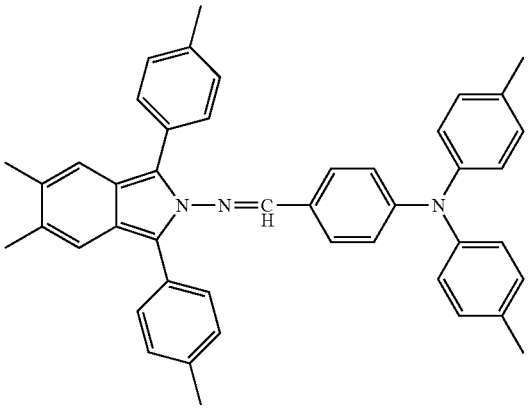
TABLE 3-2
6
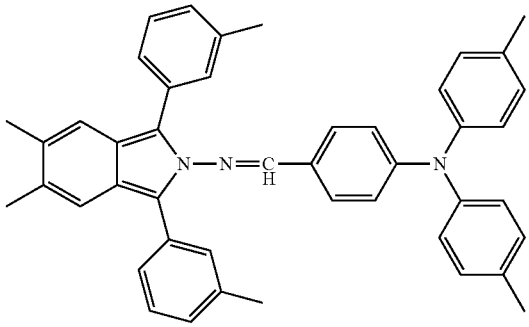
7
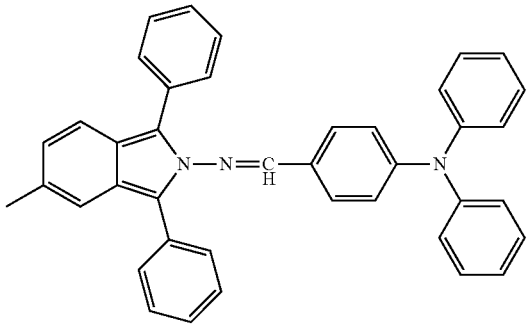
8
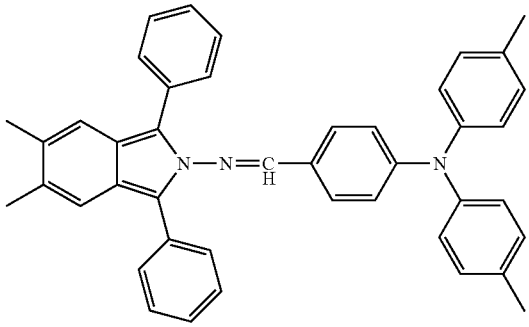
9
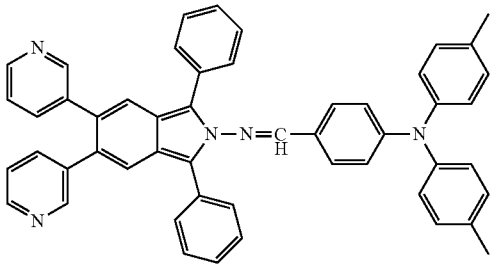
10
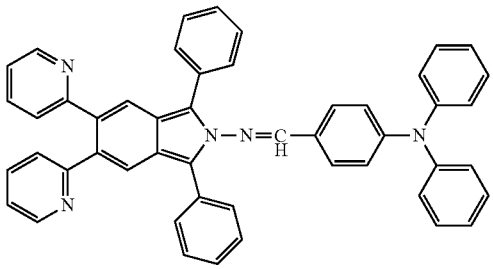

TABLE 3-3
11
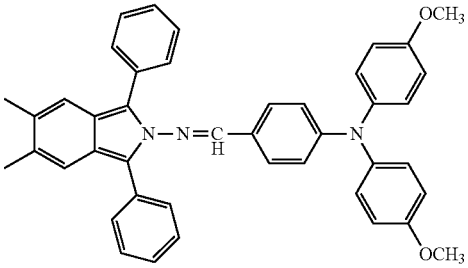
12
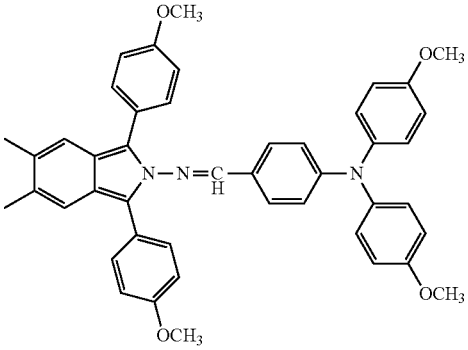
13
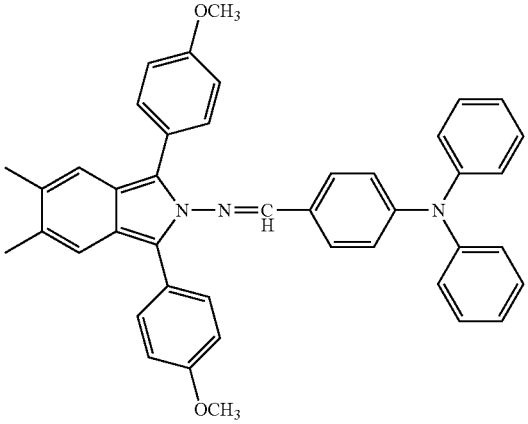
14
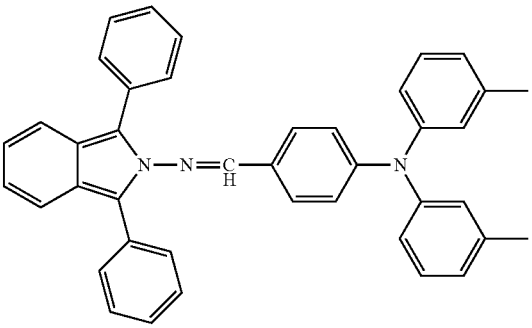
TABLE 3-4
15
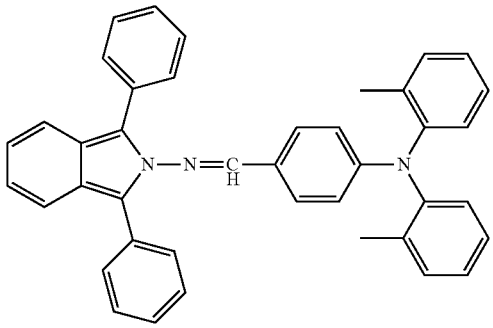
16
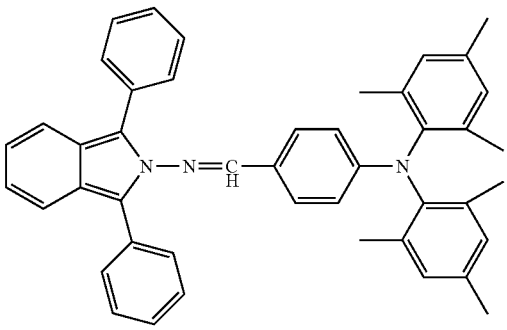
17
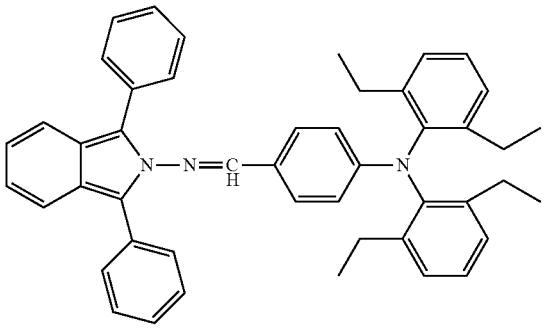
18
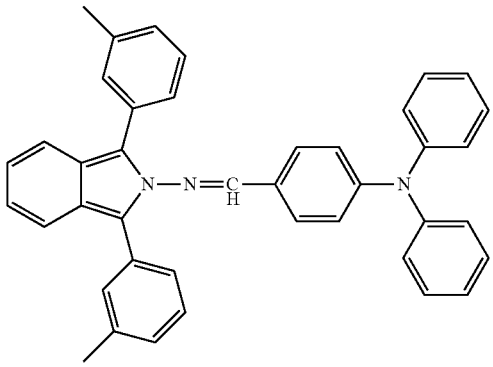

TABLE 3-5
19
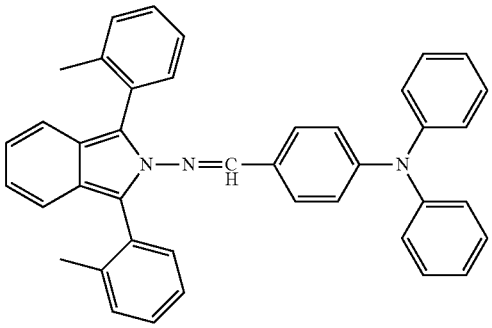
20
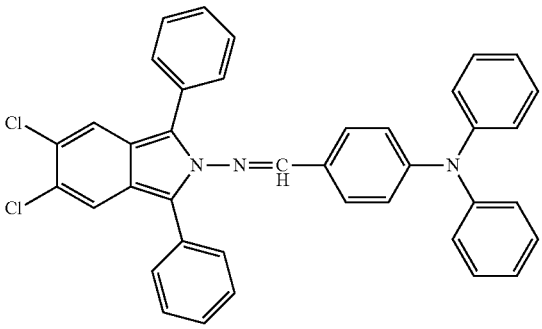
21
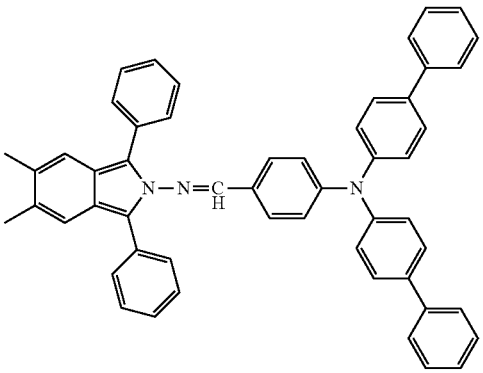
22
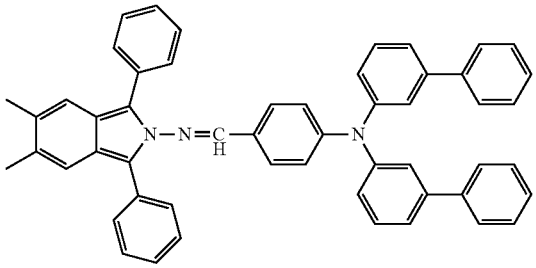
TABLE 3-6
23
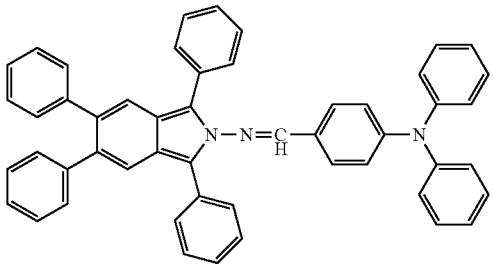
24
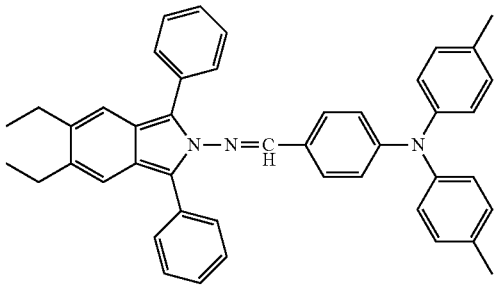
25
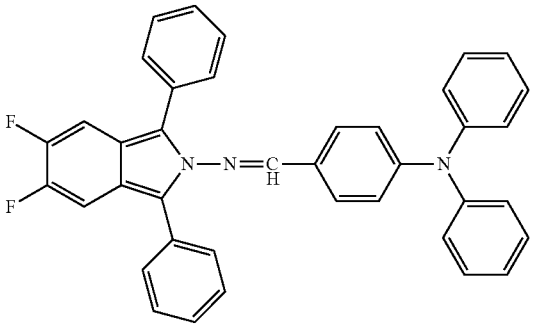
26
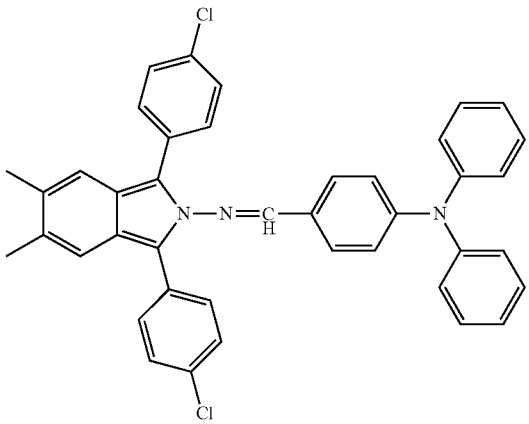

TABLE 3-7

27

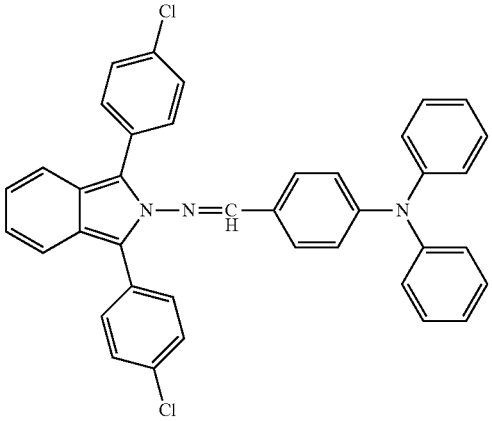

28

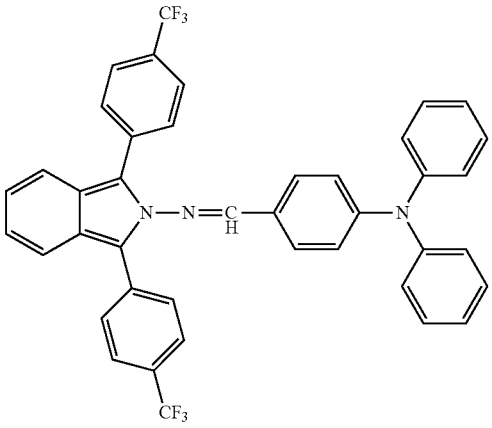

29

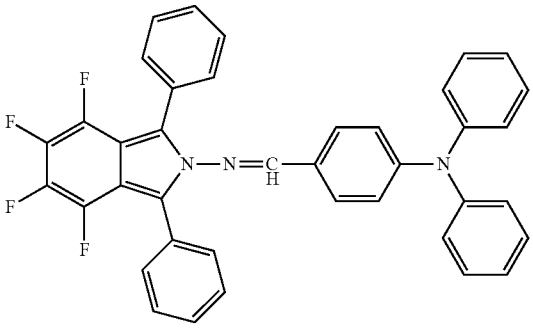

30

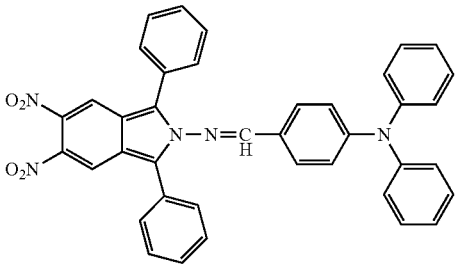

TABLE 3-8

31

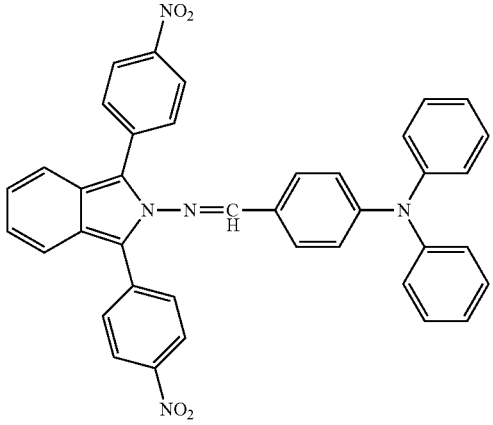

32

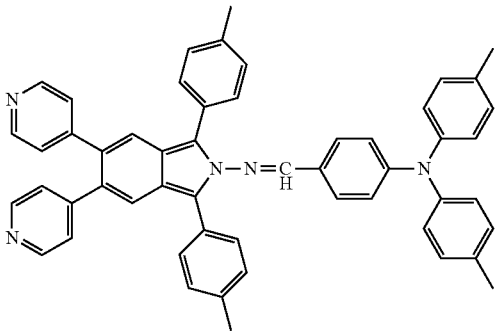

33

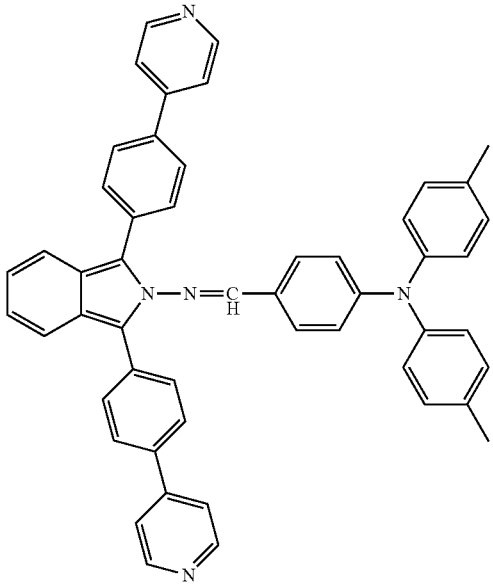

The layer structure of the image bearing member is described next.

FIG. 1 is a diagram illustrating a cross section of an example of the image bearing member of the present disclosure, in which a photosensitive layer 33 mainly made of a charge generation material and a charge transport material is provided on an electroconductive substrate 31.

In this case, the photosensitive layer 33 contains at least one compound selected from the group consisting of naphthalene tetracarboxylic acid diimide-isoindol derivative, naphthalimide-isoindol derivative, and triphenyl amine-isoindol derivative.

Figure 2:
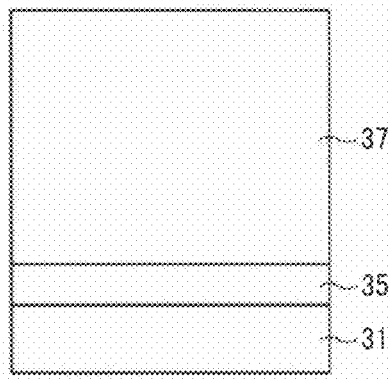
FIG. 2 is a diagram illustrating a cross section of another example of the image bearing member of the present invention.

In FIG. 2, a charge generation layer 35 mainly made of a charge generation material and a charge transport layer 37 mainly made of a charge transport material are laminated in that order on the electroconductive substrate 31.

In this case, the charge transport layer 37 preferably contains at least one compound selected from the group consisting of naphthalene tetracarboxylic acid diimide-isoindol derivative, naphthalimide-isoindol derivative, and triphenyl amine-isoindol derivative.

Figure 3:
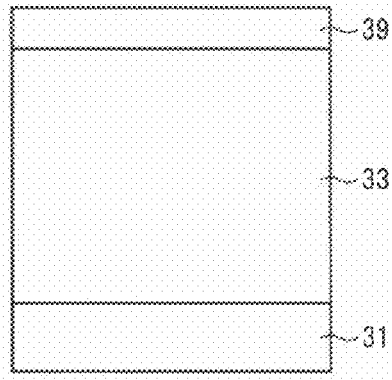
FIG. 3 is a diagram illustrating a cross section of another example of the image bearing member of the present invention.

In FIG. 3, the photosensitive layer 33 mainly made of a charge generation material and a charge transport material is provided on the electroconductive substrate 31 and a protection layer 39 is provided on the surface of the photosensitive layer.

In this case, the photosensitive layer 33 contains at least one compound selected from the group consisting of naphthalene tetracarboxylic acid diimide-isoindol derivative, naphthalimide-isoindol derivative, and triphenyl amine-isoindol derivative. In addition, the protection layer 39 may contain at least one compound selected from the group consisting of naphthalene tetracarboxylic acid diimide-isoindol derivative, naphthalimide-isoindol derivative, and triphenyl amine-isoindol derivative.

Figure 4:
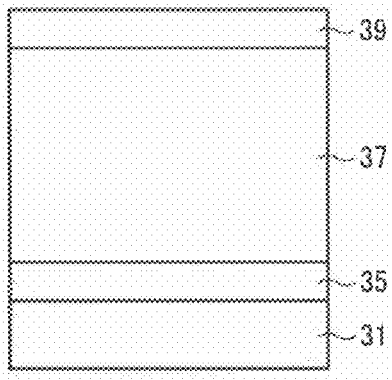
FIG. 4 is a diagram illustrating a cross section of another example of the image bearing member of the present invention.

In FIG. 4, the charge generation layer 35 mainly made of a charge generation material and the charge transport layer 37 mainly made of a charge transport material are laminated on the electroconductive substrate 31 in that order. Furthermore, the protection layer 39 is provided on the charge transport layer 37.

In this case, the charge transport layer 37 preferably contains at least one compound selected from the group consisting of naphthalene tetracarboxylic acid diimide-isoindol derivative, naphthalimide-isoindol derivative, and triphenyl amine-isoindol derivative. In addition, the protection layer 39 may contain at least one compound selected from the group consisting of naphthalene tetracarboxylic acid diimide-isoindol derivative, naphthalimide-isoindol derivative, and triphenyl amine-isoindol derivative.

Figure 5:
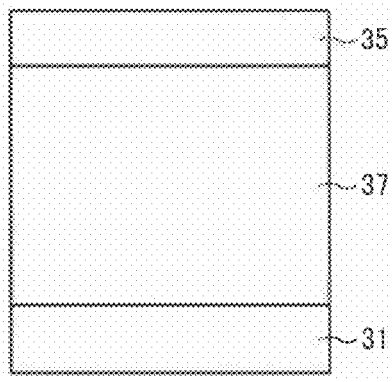
FIG. 5 is a diagram illustrating a cross section of another example of the image bearing member of the present invention.

In FIG. 5, the charge transport layer 37 mainly made of a charge transport material and a charge generation layer 35 mainly made of a charge generation material are laminated on the electroconductive substrate 31 in that order. In this case, the charge transport layer 37 preferably contains at least one compound selected from the group consisting of naphthalene tetracarboxylic acid diimide-isoindol derivative, naphthalimide-isoindol derivative, and triphenyl amine-isoindol derivative.

Figure 6:
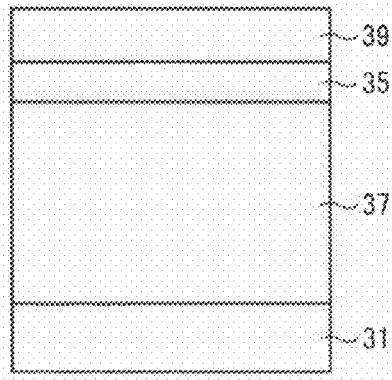
FIG. 6 is a diagram illustrating a cross section of another example of the image bearing member of the present invention.

In FIG. 6, the charge transport layer 37 mainly made of a charge transport material and the charge generation layer 35 mainly made of a charge generation material are laminated in that order on the electroconductive substrate 31. Furthermore, the protection layer 39 is provided on the charge generation layer 35. In this case, the charge transport layer 37 preferably contains at least one compound selected from the group consisting of naphthalene tetracarboxylic acid diimide-isoindol derivative, naphthalimide-isoindol derivative, and triphenyl amine-isoindol derivative. In addition, the protection layer 39 may contain at least one compound selected from the group consisting of naphthalene tetracarboxylic acid diimide-isoindol derivative, naphthalimide-isoindol derivative, and triphenyl amine-isoindol derivative.

The electroconductive substrate 31 can be formed by using material having a volume resistance of not greater than $10^{10}\Omega\cdot$cm. For example, there can be used plastic or paper having a film form or cylindrical form covered with metal such as aluminum, nickel, chrome, nichrome, copper, gold, silver, and platinum, or a metal oxide such as tin oxide and indium oxide by depositing or sputtering. Also a board formed of aluminum, an aluminum alloy, nickel, and a stainless metal can be used. Furthermore, a tube which is manufactured from the board mentioned above by a crafting technique such as extruding and extracting and surface-treatment such as cutting, super finishing and grinding is also usable. In addition, an endless nickel belt and an endless stainless belt described in JP-S52-36016-A can be used as the electroconductive substrate 31.

An electroconductive substrate formed by applying to the substrate mentioned above a liquid application in which electroconductive powder is dispersed in a suitable binder resin can be used as the electroconductive substrate 31 for use in the present disclosure.

Specific examples of such electroconductive powders include, but are not limited to, carbon black, acetylene black, metal powder, such as powder of aluminum, nickel, iron, nichrome, copper, zinc and silver, and metal oxide powder, such as electroconductive tin oxide powder and ITO powder.

Specific examples of the binder resins which are used in combination with the electroconductive powder include, but are not limited to, thermoplastic resins, thermosetting resins, and optical curing resins, such as a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acrylic resin, a silicone resin, an epoxy resin, a melamine resin, an urethane resin, a phenol resin, and an alkyd resin. Such an electroconductive layer can be formed by dispersing the electroconductive powder and the binder resins mentioned above in a suitable solvent, for example, tetrahydrofuran (THF), dichloromethane (MDC), methyl ethyl ketone (MEK), and toluene and applying the resultant to an electroconductive substrate.

In addition, an electroconductive substrate formed by providing a heat contraction tube as an electroconductive layer on a suitable cylindrical substrate can be suitably used as the electroconductive substrate 31 of the present disclosure. The heat contraction tube is formed of material such as polyvinyl chloride, polypropylene, polyester, polystyrene, polyvinylidene chloride, polyethylene, chloride rubber, and TEFLON®, which includes the electroconductive powder mentioned above.

Next, the photosensitive layer is described.

The photosensitive layer can employ a single layer structure or a laminate structure. A structure of the charge generation layer 35 and the charge transport layer 37 are described later for convenience.

The charge generation layer 35 is a layer mainly formed of a charge generation material. Any known charge generation material can be contained in the charge generation material 35. Specific examples thereof include, but are not limited to, azo pigments such as C.I Pigment Blue 25 (Color Index (=CI) 21180), C.I Pigment Red 41 (CI-21200), C.I Acid Red 52 (CI 45100), C.I Basic Red 52 (CI 45210), azo pigment having a carbazole skeleton (JP-S53-95033-A), azo pigment having a distyryl benzene skeleton (JP-S53-133445-A), azo pigment having a triphenyl amine skeleton (JP-S53-132347-A), azo pigment having a dibenzothiophene skeleton (JP-S54-21728-A), azo pigment having a oxadiazole skeleton (JP-S54-12742-A), azo pigment having a fluorenone skeleton (JP-S54-22834-A), azo pigment having a bisstilbene skeleton (JP-S54-17733-A), azo pigment having a distyryl oxadiazole skeleton (JP-S54-2129-A), azo pigment having a distyryl carbazole skeleton (JP-S54-14967-A), and azo pigment having a benzanthrone skeleton, phthalocyanine-based pigments such as C.I. Pigment Blue (CI 74100), Y type oxotitanum phthaocyanine (JP-S64-17066-A), A (β) type oxotitanum phthaocyanine, B (α) type oxotitanum phthaocyanine, I type oxotitanum phthaocyanine (JP-H11-21466-A), II type chlorogallium phthaocyanine (67th Spring Annual Meeting of the Chemical Society of Japan, IB4, 04 (1994), authored by Iijima, etc.), V type hydroxy gallium phthalocyanine (67th Spring Annual Meeting of the Chemical Society of Japan, IB4, 05 (1994), authored by Daimon, etc.), and X type non-metal phthalocyanine (U.S. Pat. No. 3,816,118), indigo-based pigments such as C.I. Bat Brown 5 (CI 73410) and C.I. Bat Dye (CI 73030), and perylene pigments such as Argoscarlet B (manufactured by Bayer Company) and Indanthrene Scarlet R (manufactured by Bayer Company).

These materials can be used alone or in combination.

The charge generation layer 35 can be formed by dispersing a charge generation material and an optional binder resin in a suitable solvent using a ball mill, an attritor, a sand mill, a bead mill, or ultrasonic, applying the liquid dispersion to the electroconductive substrate 31 followed by drying.

Specific examples of the binder resin optionally used in the charge generation layer 35 include, but are not limited to, polyamides, polyurethanes, epoxy resins, polyketones, polycarbonates, silicone resins, acrylic resins, polyvinylbutyrals, polyvinylformals, polyvinylketones, polystyrenes, polysulfone, poly-N-vinylcarbazoles, polyacrylamides, polyvinyl benzale, polyester, phenoxy resin, copolymer of vinylchloride and vinyl acetate, polyvinyl acetate, polyphenylene oxide, polyamide, polyvinylpyridine, cellulose-based resin, casein, polyvinyl alcohol, and polyvinyl pyrolidone.

The content of the binder resin is from 0 to 500 parts by weight and preferably from 10 to 300 parts by weight based on 100 parts by weight of the charge generation material. The binder resin can be added before or after dispersion of the charge generation material.

Specific examples of the solvents include, but are not limited to, isopropanol, acetone, methylethylketone, cyclohexanone, tetrahydrofuran, dioxane, ethylcellosolve, ethyl acetate, methylacetate, dichloromethane, dichloroethane, monochlorobenzene, cyclohexane, toluene, xylene, and ligroin. Among these, ketone based solvents, ester based solvents, and ether based solvents are preferably used.

These can be used alone or as a mixture of two or more.

The liquid application of the charge generation layer 35 is mainly formed of a charge generation material, a solvent, and a binder resin and may also contain any additives such as a sensitizer, a dispersion agent, a surface active agent, and silicone oil.

Known methods such as a dip coating method, a spray coating method, a bead coating method, a nozzle coating method, a spinner coating method, and a ring coating method can be used as the application method of the liquid application.

The thickness of the charge generation layer 35 is suitably from about 0.01 to about 5 μm and preferably from 0.1 to 2 μm.

The charge transport layer 37 is a layer mainly formed of a charge transport material.

The charge transport material is typified into a positive hole transport material, an electron transport material, and a charge transport polymer, each of which is described below.

Specific examples of the positive hole transport materials include, but are not limited to, poly-N-carbazole and derivatives thereof, poly-γ-carbazolyl ethyl glutamate and derivatives thereof, condensation products of pyrene-formaldehyde and derivatives thereof, polyvinypyrene, polyvinyl phenanthrene, oxazole derivatives, imidazole derivatives, triphenyl amine derivatives, and compounds represented by the following chemical structures 4, 8, 9, 12, 18 to 23, 26 to 34, and 36. Among these, the compounds represented by chemical structures 4, 8, 9, and 12 are preferably used.

Chemical structure 4

(4)

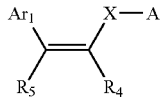

In the chemical structure 4, X represents a single bond or a vinylene group. $R_4$ represents a hydrogen atom, a substituted or non-substituted alkyl group, or a substituted or non-substituted aromatic hydrocarbon group, $Ar_1$ represents a substituted or non-substituted aromatic hydrocarbon group, $R_5$ represents a hydrogen atom, a substituted or non-substituted alkyl group, or a substituted or non-substituted aromatic hydrocarbon group, and $Ar_1$ and $R_5$ optionally share bond connectivity to form a ring. "A" represents a compound represented by the chemical structure 5, a compound represented by the chemical structure 6,9-anthryl group, or a substituted or non-substituted carbazolyl group.

Chemical structure 5

(5)

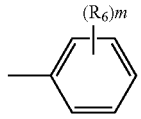

Chemical structure 6

(6)

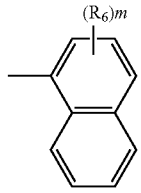

$R_6$ represents a hydrogen atom, an alkyl group, an alkoxy group, a halogen atom, or a compound represented by the chemical structure 7.

Chemical structure 7

(7)

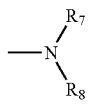

$R_7$ and $R_8$ represent a substituted or non-substituted alkyl group or a substituted or non-substituted aromatic hydrocarbon group, and optionally share bond connectivity to form a ring. "m" represents an integer of from 1 to 3 and when "m" is 2 or 3, $R_6$ can be the same or different from each other.

Specific examples of the compounds represented by the chemical structure 4 include, but are not limited to, 4'-diphenylamino-α-phenylstilbene and 4'-bis(4-methylphenyl) amino-α-phenyl stilbene.

Chemical structure 8

(8)

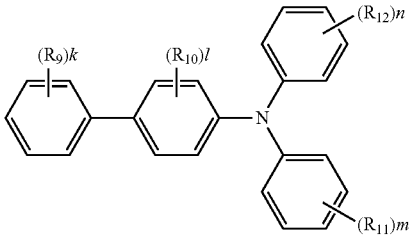

In the chemical structure 8, $R_9$, $R_{11}$, and $R_{12}$ represent a hydrogen atom, amino group, an alkoxy group, a thioalkoxy group, an aryloxy group, methylene dioxy group, a substituted or non-substituted alkyl group, a halogen atom, or a substituted or non-substituted aromatic hydrocarbon group, $R^{10}$ represent a hydrogen atom, an alkoxy group, a substituted or non-substituted alkyl group, or a halogen atom.

In addition, "k", "l", "m", and "n" represent integers of from 1, 2, 3, or 4. When each of them is 2, 3, or 4, $R_9$, $R_{10}$, $R_{11}$, and $R_{12}$ can be the same or different from each other.

Specific examples of biphenyl amine compounds represented by the chemical structure 8 include, but are not limited to, 4'-methoxy-N,N-diphenyl-[1,1'-biphenyl]-4-amine, 4'-methyl-N,N-bis(4-methylphenyl)[1,1'-biphenyl]-4-amine, 4'-methoxy-N,N-bis(4-methylphenyl)-[1,1'-biphenyl]-4-amine, and N,N-bis(3,4-dimethylphenyl)-[1,1'-biphenyl]-4-amine.

Chemical structure 9

(9)

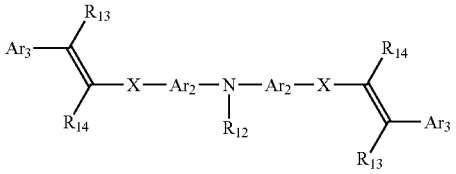

In the chemical structure 9, X represents a single bond or a vinylene group. $R_{13}$ represents a hydrogen atom, a substituted or non-substituted alkyl group, or a substituted or non-substituted aromatic hydrocarbon group, $Ar_3$ represents a substituted or non-substituted aromatic hydrocarbon group, $R_{14}$ represents a hydrogen atom, a substituted or non-substituted alkyl group, or a substituted or non-substituted aromatic hydrocarbon group, and $Ar_3$ and $R_{13}$ optionally share bond connectivity to form a ring. $Ar_2$ represents a compound represented by the chemical structure 10 or 11.

Chemical structure 10

(10)

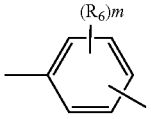

-continued

Chemical structure 11

(11)

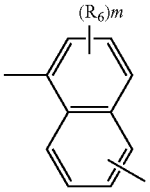

$R_6$ represents a hydrogen atom, an alkyl group, an alkoxy group, or a halogen atom. "m" represents an integer of from 1 to 3 and $R_6$ can be the same or different from each other when "m" is 2 or 3. $R^{12}$ represents a substituted or non-substituted alkyl group, or a substituted or non-substituted aromatic hydrocarbon group.

Specific examples of the compounds represented by the chemical structure 9 are the following represented by the chemical structure 12.

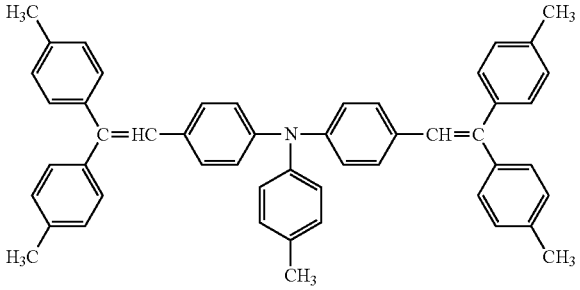

Chemical structure 12

(12)

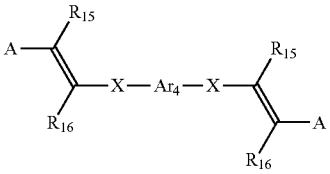

In the chemical structure 12, X represents a single bond or a vinylene group. $R_{15}$ represents a hydrogen atom, a substituted or non-substituted alkyl group, or a substituted or non-substituted aromatic hydrocarbon group, $Ar_4$ represents a substituted or non-substituted divalent aromatic hydrocarbon group, $R_{16}$ represents a hydrogen atom, a substituted or non-substituted alkyl group, or a substituted or non-substituted aromatic hydrocarbon group, and A represents a compound represented by the chemical structure 5, a compound represented by the chemical structure 6, 9-anthryl group, or a substituted or non-substituted carbazolyl group.

Chemical structure 5

(5)

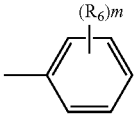

-continued

Chemical structure 6

(6)

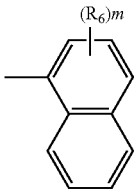

$R_6$ represents a hydrogen atom, an alkyl group, an alkoxy group, a halogen atom, or a compound represented by the chemical structure 7.

Chemical structure 7

(7)

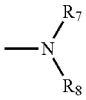

$R_7$ and $R_8$ represent a substituted or non-substituted alkyl group or a substituted or non-substituted aromatic hydrocarbon group, and optionally share bond connectivity to form a ring. "m" represents an integer of from 1 to 3 and when "m" is 2 or 3, $R_6$ can be the same or different from each other.

Specific examples of the compounds represented by the chemical structure 12 are the following represented by the chemical structure 18.

In the chemical structure 18, $R_{26}$ represents methyl group, ethyl group, 2-hydroxy ethyl group, or 2-chloroethyl group, $R_{29}$ represents methyl group, ethyl group, benzyl group, or phenyl group, $R_{28}$ represents a hydrogen atom, chlorine atom, bromine atom, an alkyl group having 1 to 4 carbon atoms, an alkoxy group having 1 to 4 carbon atoms, and dialkyl amino group, or nitro group.

Specific examples of the compounds represented by the chemical structure 18 include, but are not limited to, 9-ethylcarbazole-3-carboaldehyde 1-methyl-1-phenylhydrozone, 9-ethylcarbazole-3-carboaldehyde 1-benzyl-1-phenylhydrozone, and 9-ethylcarbazole-3-carbpaldehyde 1,1-diphenyl hydrazone.

Chemical structure 19

(19)

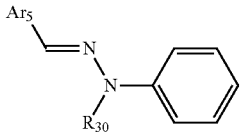

In the chemical structure 19, $Ar_5$ represents a naphthalene ring, an anthracene ring, a pyrene ring, or a substitution product thereof, a pyridine ring, a furan ring, a thiophene ring, and $R_{30}$ represents an alkyl group, phenyl group, or benzyl group.

Specific examples of the compounds represented by the chemical structure 19 include, but are not limited to, 4-diethylaminostyryl-8-carboaldehyde 1-methyl-1-phenylhydrozone and 4-methoxynaphthalene-1-carboaldehyde 1-benzyl-1-phenylhydrozone.

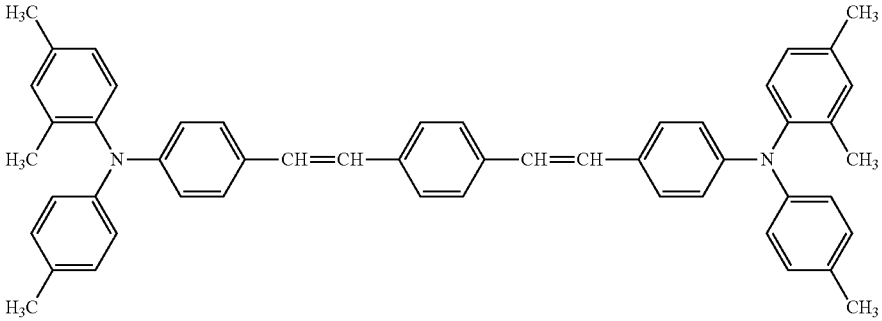

Chemcial structure 18

(18)

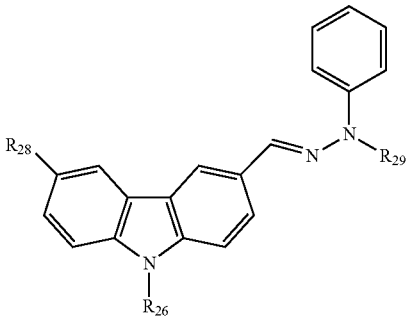

Chemical structure 20

(20)

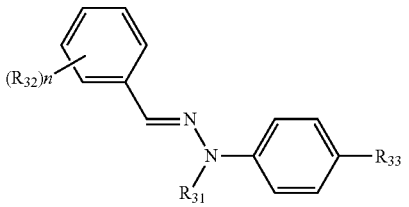

In the chemical structure 20, $R_{31}$ represents an alkyl group, benzyl group, phenyl group, or naphtyl group, $R_{32}$ represents a hydrogen atom, an alkyl group having a1 to 3 carbon atoms, an alkoxy group having a1 to 3 carbon atoms, dialkylamino group, diaralkyl group, or diaryl amino group. "n" represents an integer of from 1 to 4. $R_{32}$ can be the same or different from each other when "n" is 2 or greater.

$R_{33}$ represents a hydrogen atom or methoxy group.

Specific examples of the compounds represented by the chemical structure 20 include, but are not limited to, 4-methoxybenzaldehyde 1-methyl-1-phenylhydrazone, 2,4-dimethoxybenzaldehyde 1-benzyl-1-phenyl hydrozone, 4-diethylaminobenzaldehyde 1,1-diphenyl hydrazone, 4-methoxybenzaldehyde 1-(4-methoxy)phenylhydrozone, 4-diphenylaminobenzaldehyde 1-benzyl-1-phenylhydrozone, and 4-dibenzylaminobenzaldehyde 1,1-diphenyl hydrazone.

Chemical structure 21

(21)

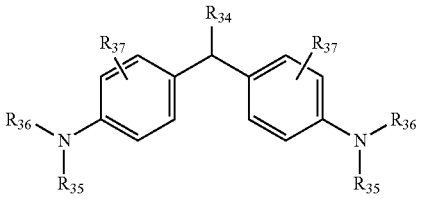

In the chemical structure 21, $R_{34}$ represents an alkyl group having 1 to 11 carbon atoms, or a substituted or non-substituted phenyl group or heterocyclic group, $R_{35}$ and $R_{36}$ independently hydrogen atom, an alkyl group having 1 to 4 carbon atoms, hydroxy alkyl group, chloroalkyl group, or a substituted or non-substituted aralkyl group, and optionally share bond connectivity to share a heterocyclic ring containing nitrogen.

$R_{37}$, each, independently represents a hydrogen atom, an alkyl group having 1 to 4 carbon atoms, alkoxy group, or a halogen atom. Specific e) diethylaminophenyl)methane, and 2,2'-dimethyl-4,4'-bis(diethylamino)-triphenyl methane.

Chemical structure 22

(22)

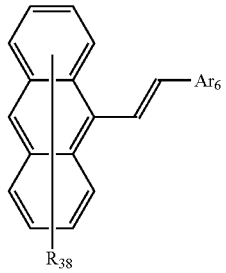

In the chemical structure 22, $R_{38}$ represents a hydrogen atom or halogen atom, $Ar_6$ represents a substituted or non-substituted phenyl group, naphtyl group, anthryl group, or carbazolyl group.

Specific examples of the compounds represented by the chemical structure 22 include, but are not limited to, 9-(4-diethylaminostyryl)anthracene and 9-bromo-10-(4-diethylaminostyryl)anthracene.

Chemical structure 23

(23)

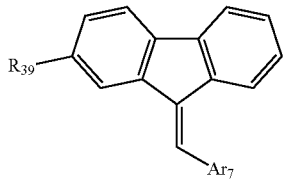

In the chemical structure 23, $R_{39}$ represents a hydrogen atom, a halogen atom, cyano group, an alkoxy group having 1 to 4 carbon atoms, or an alkyl group having 1 to 4 carbon atoms, and $Ar_7$ represents a compound represented by the chemical structure 24 or 25.

Chemical structure 24

(24)

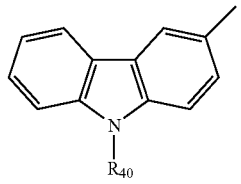

$R_{40}$ represents an alkyl group having 1 to 4 carbon atoms.

Chemical structure 25

(25)

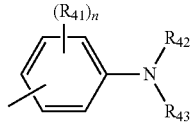

$R_{41}$ represents a hydrogen atom, a halogen atom, an alkyl group having 1 to 4 carbon atoms, an alkoxy group having 1 to 4 carbon atoms, or dialkyl amino group, "n" represents 1 or 2, $R_{41}$, each, can be the same or different from each other when "n" is 2. $R_{42}$ and $R_{43}$ independently represent a hydrogen atom, a substituted or non-substituted alkyl group having 1 to 4 carbon atoms, or a substituted or non-substituted benzyl group having 1 to 4 carbon atoms.

Specific examples of the compounds represented by the chemical structure 23 include, but are not limited to, 9-(4-dimethylaminobenzylidene)fluorene and 3-(9-fluorenylidene)-9-ethylcarbazole.

Chemical structure 26

(26)

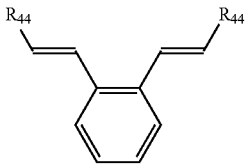

In the chemical structure 26, $R_{44}$ represents carbazolyl group, pyridine group, thienyl group, indolyl group, or furyl group, or each of $R_{44}$ independently represents a substituted or non-substituted phenyl group, styryl group, naphtyl group, or anthryl group. The substitution group represents a group selected from the group consisting of an alkylamino group, alkyl group, alkoxy group, carboxy group, or esters thereof, halogen atom, cyano group, aralkyl amino group, N-alkyl-N-aralkyl amino group, amino group, nitro group, and acetylamino group.

Specific examples of the compounds represented by the chemical structure 26 include, but are not limited to, 1,2-bis(4-diethylaminostyryl)benzene and 1,2-bis(2,4-dimethoxystyryl)benzene.

Chemical structure 27

(27)

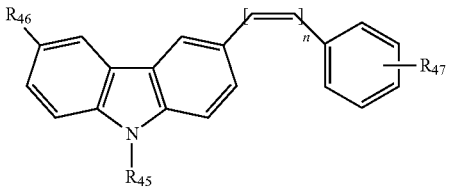

In the chemical structure 27, $R_{45}$ represents a lower alkyl group, a substituted or non-substituted phenyl group, or benzyl group, $R_{46}$ and $R_{47}$ represent a hydrogen atoms, lower alkyl groups, lower alkoxy groups, halogen atoms, nitro groups, amino groups, or amino groups substituted by a lower alkyl group or benzyl group, and n represents 1 or 2.

Specific examples of the compounds represented by the chemical structure 27 include, but are not limited to, 3-styryl-9-ethylcarbazole and 3-(4-methoxystyryl)-9-ethylcarbazole.

Chemical structure 28

(28)

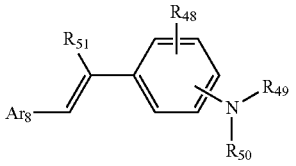

In the chemical structure 28, $R_{48}$ represents a hydrogen atom, an alkyl group, an alkoxy group, or a halogen atom and $R_{49}$ and $R_{50}$ represent substituted or non-substituted aryl groups. $R_{51}$ represents a hydrogen atom, a lower alkyl group, or a substituted or non-substituted phenyl group, or a naphtyl group.

Specific examples of the compounds represented by the chemical structure 28 include, but are not limited to, 4-diphenylaminostilbene, 4-dibenzylaminostilbene, 4-ditolylaminostilbene, and 1-(4-diphenylaminostryryl)naphthalene.

Chemical structure 29

(29)

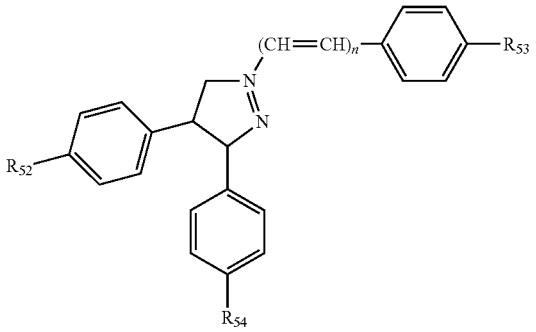

In the chemical structure 29, $R_{52}$, $R_{53}$, and $R_{54}$ represent a hydrogen atoms, lower alkyl groups, lower alkoxy groups, halogen atoms, or dialkylamino groups, and n represents 0 or 1.

A specific example of the compounds represented by the chemical structure 29 includes, but are not limited to, 1-phenyl-3-(4-diethylaminostyryl)-5-(4-diethylaminophenyl) pyrazoline.

Chemical structure 30

(30)

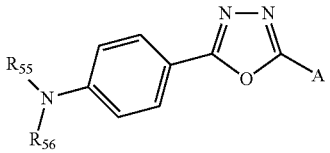

In the chemical structure 30, $R_{55}$ and $R_{56}$ represent alkyl groups including substituted alkyl groups or a substituted or non-substituted aryl group, A represents a substituted amino group, a substituted or non-substituted aryl group, a substituted or non-substituted aryl group, or an allyl group.

Specific examples of the compounds represented by the chemical structure 30 include, but are not limited to, 2,5-bis(4-diethylaminophenyl)-1,3,4-oxadiazole, 2-N,N-diphenylamino-5-(4-diethylaminophenyl)-1,3,4-oxadiazole, and 2-(4-dimethylaminophenyl)-5-(4-diethylaminophenyl)-1,3,4-oxadiazole.

Chemical structure 31

(31)

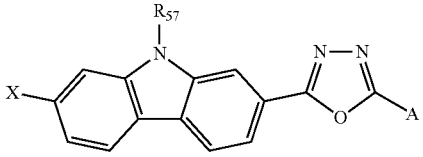

In the chemical structure 31, X represents a hydrogen atom, a lower alkyl group, or a halogen atom, $R_{57}$ represents a substituted or non-substituted alkyl group, a substituted or non-substituted aryl group, and A represents a substituted amino group or a substituted or non-substituted aryl group.

Specific examples of the compounds represented by the chemical structure 31 include, but are not limited to, 2-N,N-diphenylamino-5-(N-ethylcarbazole-3-yl)-1,3,4-oxadiazole and 2-(4-diethylaminophenyl)-5-(N-ethylcarbazole-3-yl)-1,3,4-oxadiazole.

Chemical structure 32

(32)

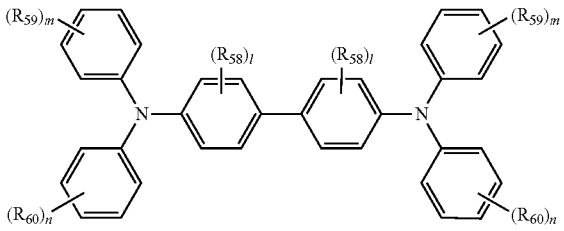

In the chemical structure 32, $R_{58}$ represents a lower alkyl group, a lower alkoxy group, or a halogen atom, $R_{59}$ and $R_{60}$ independently represent a hydrogen atom, a lower alkyl group, a lower alkoxy group, or a halogen atom, "l", "m", and "n" represent 0 or integers of from 1 to 4.

Specific examples of bendidine compounds represented by the chemical structure 32 include, but are not limited to, N,N'-diphenyl-N,N'-bis(3-methylphenyl)-[1,1'-biphenyl]-4,4'-diamine and 3,3'-dimethyl-N,N,N',N'-tetrakis(4-methylphenyl)-[1,1'-biphenyl]-4,4'-diamine.

Chemical structure 33

(33)

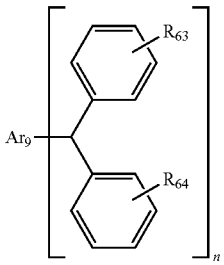

In the chemical structure 33, Arg represents a substituted or non-substituted condensed polycyclic hydrocarbon group and $R_{63}$ and $R_{64}$ independently represent a hydrogen atoms, substituted or non-substituted alkyl groups, alkoxy groups, and substituted or non-substituted phenyl groups. "n" represents 1 or 2.

Specific examples of triaryl amine compounds represented by the chemical structure 32 include, but are not limited to, N,N-diphenyl-pyrene-1-amine, N,N-di-p-tolyl-pyrene-1-amine, N,N-di-p-tolyl-1-naphtyl amine, N,N-di(p-tolyl)-1-phenanrolyl amine, 9,9-dimethyl-2-(di-p-tolylamino)fluorene, N,N,N',N'-tetrakis(4-methylphenyl)-phenanthrene-9,10-diamine, and N,N,N',N'-tetrakis(3-methylphenyl)-m-phenylenediamine.

Chemical structure 34

$$A—CH{=}CH—Ar_{10}—CH{=}CH—A \quad (34)$$

In the chemical structure 34, $Ar_{10}$ represents a substituted or non-substituted aromatic hydrocarbon group and A represents a group represented by the chemical structure 35.

Chemical structure 35

(35)

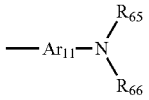

$Ar^{11}$ represents a substituted or non-substituted aromatic hydrocarbon group and $R_{65}$ and $R_{66}$ independently represent a substituted or non-substituted alkyl group or a substituted or non-substituted aryl group.

Specific examples of the compounds represented by the chemical structure 34 include, but are not limited to, 1,4-bis(4-diethylaminostyryl)benzene and 1,4-bis[4-di(p-tolyl)aminostyryl)benzene.

Chemical structure 36

(36)

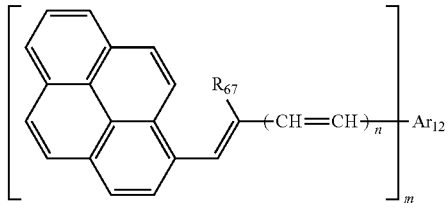

In the chemical structure 36, $Ar^{12}$ represents a substituted or non-substituted aromatic hydrocarbon group and $R^{67}$ represents a hydrogen atom, a substituted or non-substituted alkyl group, and a substituted or non-substituted aryl group.

"n" represents 0 or 1, "m" represents 1 or 2. When n is 0 and m is 1, $Ar_{12}$ and $R_{67}$ optionally share bond connectivity to form a ring.

Specific examples of the compounds represented by the chemical structure 36 include, but are not limited to, 1-(4-diphenylaminostyryl)pyrene and 1-(N,N-p-tolyl-4-aminostyryl)pyrene.

Suitable specific examples of such electron transport material include, but are not limited to, chloranil, bromanil, tetracyano ethylene, tetracyanoquino dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-indeno-4H-indeno[1,2-b]thiophene-4-one, and 1,3,7-trinitrodibenzothhiophene-5,5-dioxide. Also, the charge transport materials represented by the chemical structures 13, 14, 16, 17, 37, and 38 can be suitably used.

These charge transport materials may be used alone or in combination.

Chemical structure 13

(13)

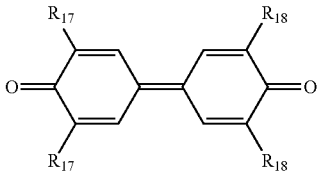

In the chemical structure 13, $R^{17}$ and $R_{18}$ independently represent a hydrogen atom, a substituted or non-substituted alkyl group, or a substituted or non-substituted aromatic hydrocarbon groups.

Chemical structure 14

(14)

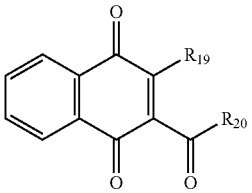

In the chemical structure 14, $R_{19}$ represents a hydrogen atom, a substituted or non-substituted alkyl group, or a substituted or non-substituted aryl group and $R_{20}$ represent a substituted or non-substituted alkyl group, a substituted or non-substituted aromatic hydrocarbon group, or a group represented by the chemical structure 15.

Chemical structure 15

$$—O—R_{21} \quad (15)$$

In the chemical structure 15, $R_{21}$ represents a substituted or non-substituted alkyl group or a substituted or non-substituted aryl group.

Chemical structure 16

(16)

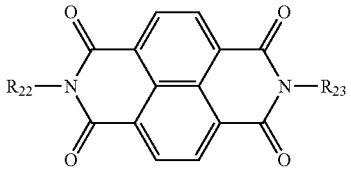

In the chemical structure 16, $R_{22}$ and $R_{23}$ independently represent a hydrogen atom, a substituted or non-substituted alkyl group, or a substituted or non-substituted aromatic hydrocarbon group.

Chemical structure 17

(17)

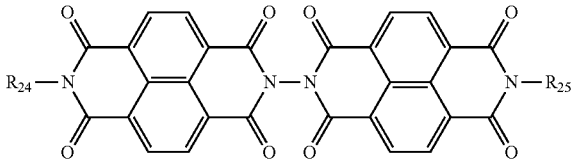

In the chemical structure 17, $R_{24}$ and $R_{25}$ independently represent a hydrogen atom, a substituted or non-substituted alkyl group, or a substituted or non-substituted aromatic hydrocarbon group.

Specific examples of the compounds represented by the chemical structures 13, 14, 16, and 17 are the following compounds.

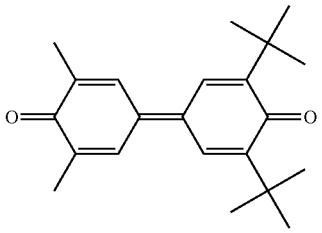

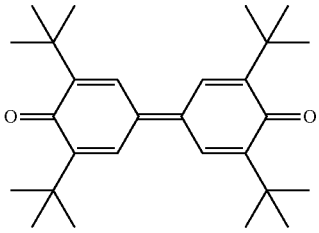

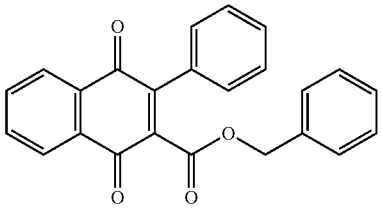

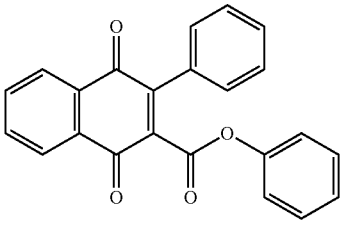

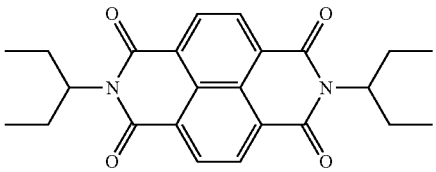

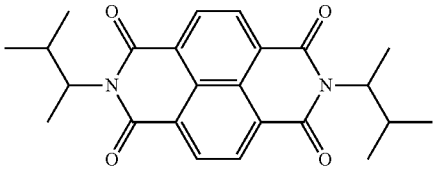

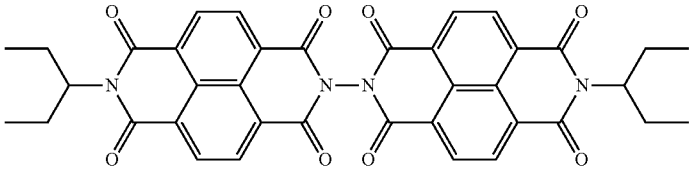

-continued

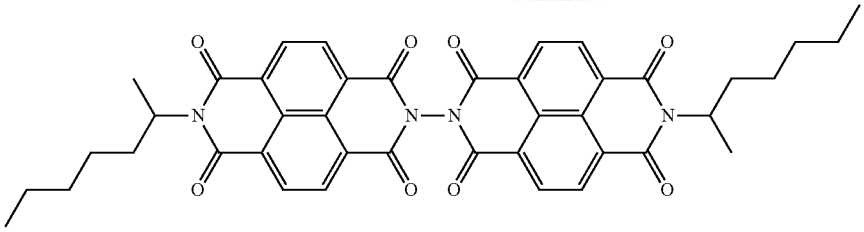

Chemical structure 37

(37)

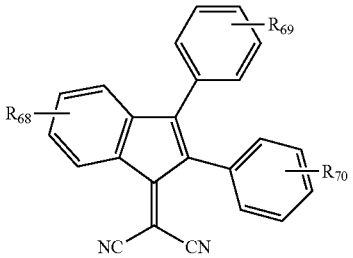

In the chemical structure 37, $R_{68}$, $R_{69}$, and $R_{70}$ independently represent a hydrogen atom, a halogen atom, a substituted or non-substituted alkyl group, an alkoxy group, or a substituted or non-substituted phenyl group.

Chemical structure 38

(38)

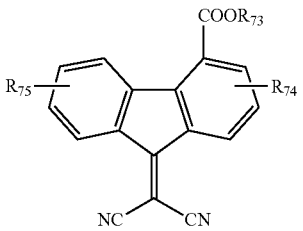

In the chemical structure 38, $R_{73}$, $R_{74}$, and $R_{75}$ independently represent a hydrogen atom, a halogen atom, a substituted or non-substituted alkyl group, an alkoxy group, or a substituted or non-substituted phenyl group.

Specific examples of the binder resin include, but are not limited to, thermoplastic resins or thermocuring resins, for example, polystyrene, copolymers of styrene and acrylonitrile, copolymers of styrene and butadiene, copolymers of styrene and maleic anhydrate, polyesters, polyvinyl chlorides, copolymers of a vinyl chloride and a vinyl acetate, polyvinyl acetates, polyvinylidene chloride, polyarylate resins, phenoxy resins, polycarbonate reins, cellulose acetate resins, ethyl cellulose resins, polyvinyl butyral, polyvinyl formal, polyvinyl toluene, poly-N-vinylcarbozole, acrylic resin, silicone resins, epoxy resins, melamine resins, urethane resins, phenol resins, and alkyd resins.

In the case in which the charge transport material and at least one compound of naphthalene tetracarboxylic acid diimide-isoindol derivative, naphthalimide-isoindol derivative, and triphenyl amine-isoindol derivative are contained in the charge transport layer, the total amount thereof is from 20 to 30 parts by weight and preferably from 40 to 150 parts by weight based on 100 parts by weight of the binder resin.

The thickness of the charge transport layer is preferably 25 μm or less in terms of the resolution and responsiveness. Although depending on the property (charging voltage in particular) of the system used, the lower limit is preferably 5 μm or more.

In addition, the total content of the at least one compound selected from the group consisting of naphthalene tetracarboxylic acid diimide-isoindol derivative, naphthalimide-isoindol derivative, and triphenyl amine-isoindol derivative is preferably from 0.01 to 150% by weight based on the amount of the charge transport material.

When the total amount is too small, the layer tends to be easily damaged by oxidizing gases and when the total amount is too large, the residual voltage easily rises over repetitive use.

Specific examples of the solvent for use in the liquid application for the charge transport layer include, but are not limited to, tetrahydrofuran, dioxane, toluene, dichloromethane, monochlorobenzene, dichloroethane, cyclohexanone, methylethylketone, and acetone.

These charge transport materials can be used alone or in combination.

Any known anti-oxidizing agents, which are described later, can be suitably used. (c) Hydroquinone-based compounds and (f) hindered amine-based compounds are particularly preferable.

Different from the purpose described later, the anti-oxidizing agents is to protect the at least one compound selected from the group consisting of naphthalene tetracarboxylic acid diimide-isoindol derivative, naphthalimide-isoindol derivative, and triphenyl amine-isoindol derivative from deteriorating.

Therefore, these anti-oxidizing agents are preferably contained in the liquid application of the photosensitive layer before the process of containing the at least one compound selected from the group consisting of naphthalene tetracarboxylic acid diimide-isoindol derivative, naphthalimide-isoindol derivative, and triphenyl amine-isoindol derivative in the liquid application. The content of the anti-oxidizing agents is suitably 0.1 to 200% by weight based on the total content of the at least one compound selected from the group consisting of naphthalene tetracarboxylic acid diimide-isoindol derivative, naphthalimide-isoindol derivative, and triphenyl amine-isoindol derivative.

Charge transport polymers having both functions of the charge transport material and the binder resin can be suitably contained in the charge transport layer.

The charge transport layer formed of such charge transport polymers has excellent durability.

Any known charge transport polymers can be used. Polycarbonates having a triaryl amine structure in the main chain and/or in the side chain are particularly suitably used.

Among these, the charge transport polymers represented by the chemical structures (I) to (XIII) are particularly preferable. These are illustrated below with specific examples.

Chemical structure I (I)

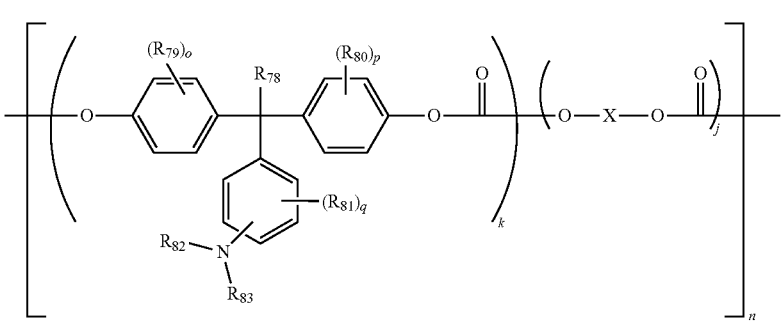

In the chemical structure I, $R_{79}$, $R_{80}$, and $R_{81}$ independently represent a substituted or non-substituted alkyl group or halogen atom, $R_{78}$ represents a hydrogen atom or a substituted or non-substituted alkyl group, $R_{82}$ and $R_{83}$ independently represent a substituted or non-substituted aryl group, "o", "p", and "q" independently 0 or integers of 2 to 4, "k" represents from 0.1 to 1.0, "j" represents from 0 to 0.9, and "n" represents an integer of the number of repeating units of from 5 to 5,000.

"X" represents a divalent aliphatic group, a divalent alicyclic group, or a divalent group represented by the following structure II.

Chemical structure II (II)

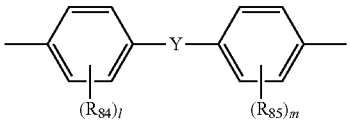

$R_{84}$ and $R_{85}$ independently represent a substituted or non-substituted alkyl group, an aryl group, or a halogen atom.

"l" and "m" independently represent 0 or an integer of from 1 to 4, Y represents a single bond, an alkylene group having a straight chain, a branch chain, or a ring chain with 1 to 12 carbon atoms, —O—, —S—, —SO—, —$SO_2$—, —CO—, —CO—O—Z—O—CO— (Z represents a divalent aliphatic group), or a group represented by the Chemical structure III.

Chemical structure III

III

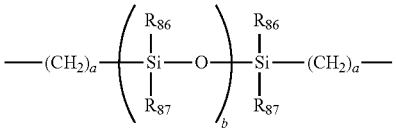

In the chemical structure III, a represents an integer of from 1 to 20, b represents an integer of from 1 to 200, and $R_{86}$ and $R_{87}$ independently represent a substituted or non-substituted alkyl group or an aryl group.

Chemical structure IV (IV)

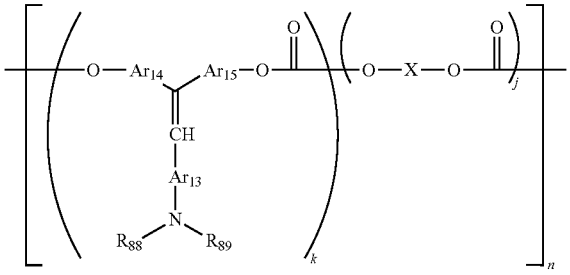

In the chemical structure IV, $R_{88}$ and $R_{89}$ independently represent a substituted or non-substituted aryl group and Ar_, $Ar_{14}$, and $Ar_{15}$ independently represent an arylene group. "X", "k", "j", and "n" represent the same in the case of the chemical structure I.

Chemical structure V (V)

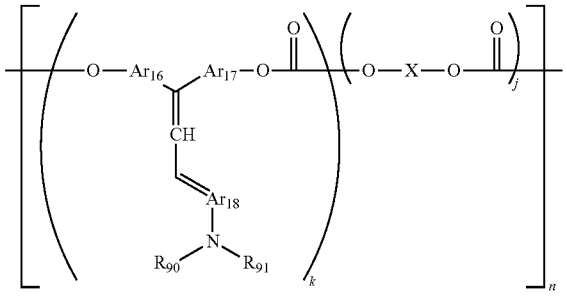

In the chemical structure V, $R_{90}$ and $R_{91}$ independently represent a substituted or non-substituted aryl group and $Ar_{16}$, $Ar_{17}$, and $Ar_{18}$ independently represent an arylene group. "X", "k", "j", and "n" represent the same in the case of the chemical structure I.

Chemical structure VI (VI)

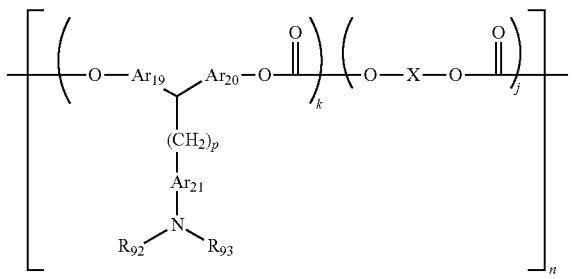

In the chemical structure VI, $R_{92}$ and $R_{93}$ independently represent a substituted or non-substituted aryl group, $Ar_{19}$, $Ar_{20}$, and $Ar_{21}$ independently represent an arylene group, and "p" represents an integer of from 1 to 5. "X", "k", "j", and "n" represent the same in the case of the chemical structure I.

Chemical structure VII (VII)

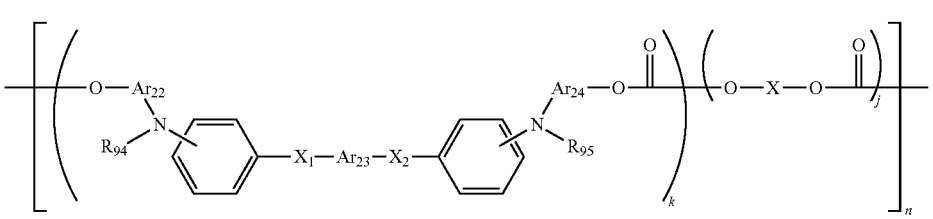

In the chemical structure VII, $R_{94}$ and $R_{95}$ independently represent a substituted or non-substituted aryl group, $Ar_{22}$, $Ar_{23}$, and $Ar_{24}$ independently represent a substituted or non-substituted ethylene group or a substituted or non-substituted vinylene group. "X", "k", "j", and "n" represent the same in the case of the chemical structure I.

Chemical structure VIII (VIII)

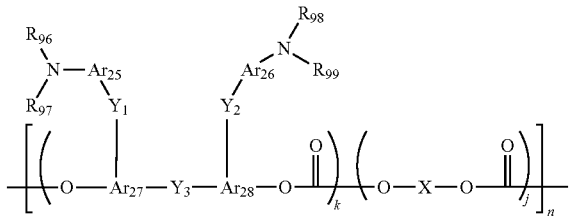

In the chemical structure VIII, $R_{96}$, $R_{97}$, $R_{98}$ and $R_{99}$ independently represent a substituted or non-substituted aryl group, $Ar_{25}$, $Ar_{26}$, $Ar_{27}$, and $Ar_{28}$ independently represent a substituted or non-substituted arylene group, $Y_1$, $Y_2$, and $Y_3$ independently represent a single bond, a substituted or non-substituted alkylene group, substituted or non-substituted cycloalkylene group, substituted or non-substituted alkylene ether group, oxygen atom, sulfur atom, or vinylene group. "X", "k", "j", and "n" represent the same in the case of the chemical structure I.

Chemical structure IX (IX)

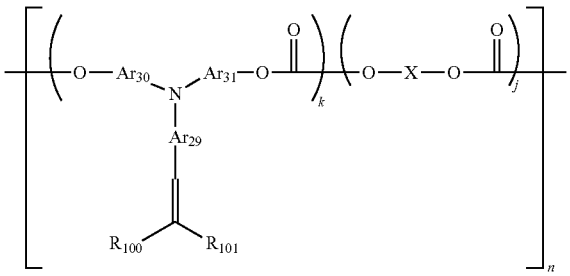

In the chemical structure IX, $R_{100}$ and $R_{101}$ independently represent a hydrogen atom or a substituted or non-substituted aryl group and may optionally share bond connectivity to share a ring. $Ar_{29}$, $Ar_{30}$, and $Ar_{31}$ independently represent an arylene group. "X", "k", "j", and "n" represent the same in the case of the chemical structure I.

Chemical structure X (X)

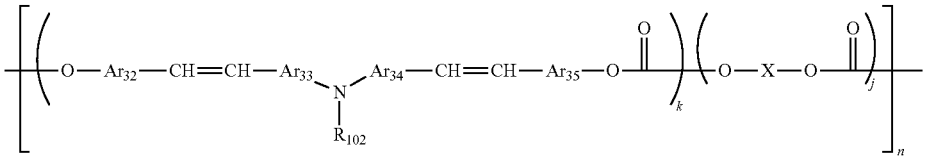

In the chemical structure X, $R_{102}$ represents a substituted or non-substituted aryl group and $Ar_{32}$, $Ar_{33}$, $Ar_{34}$, and $Ar_{35}$ independently represent an arylene group. "X", "k", "j", and "n" represent the same in the case of the chemical structure I.

Chemical structure XI (IX)

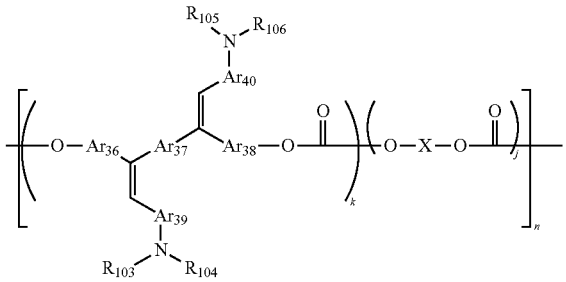

In the chemical structure XI, $R_{103}$, $R_{104}$, $R_{105}$, and $R_{106}$ independently represent a substituted or non-substituted aryl group and $Ar_{36}$, $Ar_{37}$, $Ar_{38}$, $Ar_{39}$, and $Ar_{40}$ independently represent an arylene group. "X", "k", "j", and "n" represent the same in the case of the chemical structure I.

Chemical structure XII (XII)

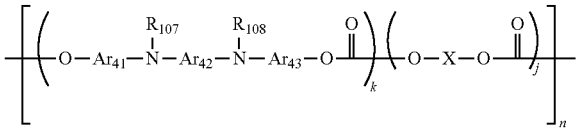

In the chemical structure XII, $R_{107}$ and $R_{108}$ independently represent a substituted or non-substituted aryl group and $Ar_{41}$, $Ar_{42}$, and $Ar_{43}$ independently represent an arylene group. "X", "k", "j", and "n" represent the same in the case of the chemical structure I.

In the chemical structure XIII, $Ar_{44}$, $Ar_{45}$, $Ar_{46}$, $Ar_{47}$, and $Ar_{48}$ independently represent an aromatic cyclic group and Z represents an aromatic cyclic group, or —$Ar_{49}$—Za—$Ar_{49}$—. $Ar_{49}$ represents an aromatic cyclic group, Za represents O, S, or an alkylene group, and $R_{109}$ and $R_{110}$ independently represent a straight or branch chain alkylene group. "m" represents 0 or 1. "k", "j", and "n" represent the same in the case of the chemical structure I.

The charge transport layer 37 is formed by applying to the charge generation layer a liquid dispersion in which the at least one compound selected from the group consisting of naphthalene tetracarboxylic acid diimide-isoindol derivative, naphthalimide-isoindol derivative, and triphenyl amine-isoindol derivative, the charge transport material, and an optional binder resin are dissolved or dispersed in a suitable solvent followed by drying.

In addition, a plasticizing agent, a leveling agent, an anti-oxidizing agent, etc. can be added, if desired. These can be used alone or in combination.

Known methods such as a dip coating method, a spray coating method, a bead coating method, a nozzle coating method, a spinner coating method, and a ring coating method can be used as the application method to apply the liquid application obtained as above.

The case in which the photosensitive layer is of a single structure type is described next.

An image bearing member in which the charge generation material described above is dispersed in a binder resin can be used.

The photosensitive layer is formed by application and drying of a liquid dispersion in which the at least one compound selected from the group consisting of naphthalene tetracarboxylic acid diimide-isoindol derivative, naphthalimide-isoindol derivative, and triphenyl amine-isoindol derivative, the charge transport material, and an optional binder resin are dissolved or dispersed in a suitable solvent.

In addition, a plasticizing agent, a leveling agent, an anti-oxidizing agent, etc. can be added, if desired.

In addition to the binder resin specified for the charge transport layer 37, the binder resin specified for the charge generation layer 35 can be mixed for use.

The charge transport polymer specified above can be also used.

Chemical structure XIII (XIII)

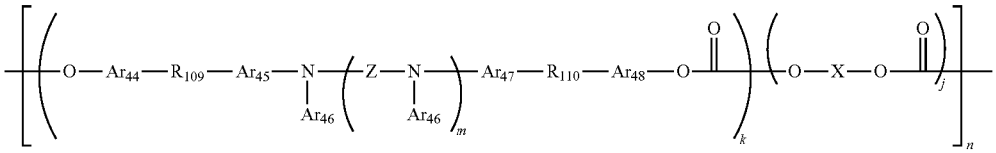

The total content of the at least one compound selected from the group consisting of naphthalene tetracarboxylic acid diimide-isoindol derivative, naphthalimide-isoindol derivative, and triphenyl amine-isoindol derivative is preferably from 20 to 300 parts by weight and more preferably from 40 to 150 parts by weight based on 100 parts by weight of the binder resin.

The content of the charge generation material is preferably from 5 to 40 parts by weight and the content of the charge transport material is preferably from 0 to 190 parts by weight and more preferably from 50 to 150 parts by weight based on 100 parts by weight of the binder resin.

The photosensitive layer is formed by application of a liquid dispersion in which the at least one compound selected from the group consisting of naphthalene tetracarboxylic acid diimide-isoindol derivative, naphthalimide-isoindol derivative, and triphenyl amine-isoindol derivative, the charge generation material, the charge transport material, and the binder resin are dissolved or dispersed in a suitable solvent such as tetrahydrofuran, dioxane, dichloroethane, and cyclohexane using a dip coating method, a spray coating method, a bead coating method, a ring coating method, etc.

The thickness of the photosensitive layer is suitably from about 5 to about 25 μm.

In the image bearing member of the present disclosure, an undercoating layer can be provided between the electroconductive substrate 31 and the photosensitive layer.

Typically, such an undercoating layer is mainly made of a resin. Considering that a photosensitive layer is applied to such an undercoating layer (i.e., resin) in a form of solvent, the resin is preferably hardly soluble in a known organic solvent.

Specific examples of such resins include, but are not limited to, water soluble resins, such as polyvinyl alcohol, casein, and sodium polyacrylate, alcohol soluble resins, such as copolymerized nylon and methoxymethylized nylon and curing resins which form a three dimension mesh structure, such as polyurethane, melamine resins, phenol resins, alkyd-melamine resins and epoxy resins. In addition, fine powder pigments of metal oxide, such as titanium oxides, silica, alumina, zirconium oxides, tin oxides and indium oxides can be added to the undercoating layer to prevent moiré and reduce the residual voltage.

The undercoating layer described above can be formed by using a suitable solvent and a suitable coating method as described for the photosensitive layer.

Silane coupling agents, titanium coupling agents, and chromium coupling agents can be used in the undercoating layer. Furthermore, the undercoating layer can be formed by using a material formed by anodizing $Al_2O_3$, or an organic compound, such as polyparaxylylene (parylene) or an inorganic compound, such as $SiO_2$, $SnO_2$, $TiO_2$, ITO, and $CeO_2$ by a vacuum thin-film forming method. Any other known methods can be also available.

The thickness of the undercoating layer is suitably from 0 to 5 μm.

In the image bearing member of the present disclosure, the protection layer 39 is provided on the photosensitive layer to protect the photosensitive layer.

Specific examples of materials for use in the protection layer 39 include, but are not limited to, ABS resins, ACS resins, olefin-vinyl monomer copolymers, chlorinated polyether, aryl resins, phenolic resins, polyacetal, polyamide, polyamideimide, polyallylsulfone, polybutylene, polybutylene terephthalate, polycarbonate, polyethersulfone, polyethylene, polyethylene terephthalate, polyimide, acrylic resins, polymethylpentene, polypropylene, polyphenyleneoxide, polysulfone, polystyrene, polyarylate, AS resins, butadiene-styrene copolymers, polyurethane, polyvinyl chloride, polyvinylidene chloride, and epoxy resins.

In terms of the dispersion property of fillers, the residual voltage, and layer application deficiency, polycarbonate or polyarylate is preferable.

In addition, filler materials are added to the protection layer 39 to improve the abrasion resistance.

Any solvent that can be used to form the charge generation layer 37 is suitably used. Specific examples of the solvent include, but are not limited to, tetrahydrofuran, dioxane, toluene, dichloromethane, monochlorobenzene, dichloroethane, cyclohexanone, methylethylketone, and acetone.

However, a solvent having a high viscosity is preferable during dispersion and a solvent having a high volatility is preferable during application.

Unless there is a solvent that satisfies these conditions, solvents can be mixed to satisfy these conditions, thereby having a great effect on the dispersion property or the residual voltage.

In addition, the protection layer may contain the at least one compound selected from the group consisting of naphthalene tetracarboxylic acid diimide-isoindol derivative, naphthalimide-isoindol derivative, and triphenyl amine-isoindol derivative.

Furthermore, addition of the charge transport materials or the charge transport polymers specified for the charge transport material 37 is preferable to reduce the residual voltage and improve the image quality.

Known methods such as a dip coating method, a spray coating method, a bead coating method, a nozzle coating method, a spinner coating method, and a ring coating method can be used as the method of forming the protection layer. Among these, the spray coating method is preferable in terms of uniformity of the applied layer.

In the image bearing member of the present disclosure, an intermediate layer can be provided between the photosensitive layer and the protection layer.

Generally, the intermediate layer is mainly formed of a binder resin. Specific examples of the binder resins include, but are not limited to, polyamide, alcohol soluble nylon, water soluble polyvinylbutyral, polyvinyl butyral, and polyvinyl alcohol.

The intermediate layer can be formed by any application method described above.

The thickness of the intermediate layer is suitably from about 0.05 to about 2 μm.

In the present disclosure, an anti-oxidizing agent, a plasticizer, a lubricant, an ultraviolet absorber, a leveling agent, etc. can be added to each of the protection layer, the charge generation layer, the charge transport layer, the undercoating layer, and the intermediate layer to improve the environmental resistance, particularly to prevent the degradation of sensitivity and the rise in residual potential.

The following materials are typically used for these compounds.

Specific examples of the anti-oxidizing agents that can be added to each layer include, but are not limited to, the following. (a) Phenol-based Compounds 2,6-di-t-butyl-p-cresol, butylated hydroxyanisol, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(4-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3', 5'-di-t-butyl-4'-hydroxyphenyl)propionate]methane, bis[3,3'-bis(4'-hydroxy-3'-t-butylphenyl)butyric acid]glycol ester, and tocopherols.

(b) Paraphenylene Diamines N-phenyl-N'-isopropyl-p-phenylene diamine, N,N'-di-sec-butyl-p-phenylene diamine, N-phenyl-N-sec-butyl-p-phenylene diamine, N,N'-di-isopropyl-p-phenylene diamine, and N,N'-dimethyl-N,N'-di-t-butyl-p-phenylene diamine.

(c) Hydroquinones 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

(d) Organic Sulfur Compounds dilauryl-3,3-thiodipropionate, distearyl-3,3'-thiodipropionate, and ditetradecyle-3,3'-thiodipropionate.

(e) Organic Phosphorine Compounds triphenyl phosphine, tri(nonylphenyl)phosphine, tri(dinonylphenyl)phosphine, tricresyl phosphine, and tri(2,4-dibutylphenoxy)phosphine.

(f) Hinderedamines (HALS)

Specific examples of the plasticizers that can be added to each layer include, but are not limited to, the following.

(a) Phosphate-Based Plasticizers triphenyl phosphate, tricresyl phosphate, trioctyl phosphate, octyldiphenyl phosphate, trichloroethyl phosphate, cresyl diphenyl phosphate, tributyl phosphate, tri-2-ethylhexyl phosphate, and triphenyl phosphate.

(b) Phthalate-Based Plasticizers dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzil phthalate, butyllauryl phthalate, methyloleyl phthalate, octyldecyl phthalate, dibutyl fumarate, and dioctyl fumarate.

(c) Aromatic Carbonate-based Plasticizers trioctyl trimellitic acid, tri-n-octyl trimellitic acid, and octyl oxybenzoate.

(d) Aliphatic Dibasic Acid Ester-based Plasticizers dibutyl adipate, n-hexyl adipate, di-2-ethylhexyl adipate, di-n-octyl adipate, n-octyl-n-decyl adipate, diisodecyl adipate, dicapryl adipate, di-2-ethyl-ethylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophyalate, and di-n-octyl tetrahydrophtalate.

(e) Aliphatic acid Ester Derivatives butyl oleate, glycerin monoloeic acid ester, methyl acetyl ricinolate, pentaerythritol ester, dipentaerythritol hexaester, and triacetine, and tributyrin.

(f) Oxyic Acid Ester-Based Plasticizers methyl acetyl ricinoleate, butyl acetyl ricinoleate, butylphthalyl butyl glicolate, and tributyl acetyl citrate.

(g) Epoxy Plasticizers epoxidized soy bean oil, epoxidized linseed oil, butyl epoxy stearate, decyl epoxy stearate, octyl epoxy stearate, benzyl epoxy stearate, dioctyl epoxy hexahydrophthalate, and didecyl epoxyhexahydrophyalate.

(h) Dicicohol Ester-Based Plasticizers diethylene glycol dibenzoate, and triethylene glycol di-2-ethyl butylate.

(i) Chlorinated Plasticizers chlorinated paraffin, chlorinated diphenyl, chlorinated aliphatic methyl, and methoxychlorinated aliphatic methyl.

(j) Polyester-Based Plasticizers polypropylene adipate, polypropylene cebacate, polyester, and acetylized polyester.

(k) Sulfonic Acid Derivative p-toluene sulfone amide, o-toluene sulfone amide, p-toluene sulfone ethyl amide, o-toluene sulfone ethyl amide, toluene sulfone-N-ethyl amide, and p-toluene sulfone-N-cyclohexyl amide.

(l) Citric Acid Derivatives triethyl citrate, triethyl acetyl citrate, tributyl citrate, tributyl acetyl citrate, tri-2-ethyl hexyl acetyl citrate, and acetyl citrate-n-octyl decyl.

(m) Others terphenyl, partially hydrogenerated terphenyl, camphort, 2-nitrodiphenyl, dinonyl naphthaline, and methyl abietate.

Specific examples of the lubricants that can be added to each layer include, but are not limited to, the following.

(a) Hydrocarbon-Based Compounds

Liquid paraffin, paraffin wax, microwax, and low polymerized polyethylene. Liquid paraffin, paraffin wax, microwax, and low polymerized polyethylene.

(b) Aliphatic-Based Compounds

Lauric acid, myristic acid, paltimic acid, stearic acid, arachidic acid, and behenic acid.

(c) Aliphatic Amide-Based Compounds

Stearyl amide, palmitic amide, oleic amide, methylene bisstearoamide, and ethylene bisstaroamide.

(d) Ester Compounds

Lower alcohol ester of an aliphatic acid, multi-valent alcohol ester of an aliphatic acid, and aliphatic acid polyglycol esters.

(e) Alcohol-Based Compounds

Cetyl alcohol, stearyl alcohol, ethylene glycol, polyethylene glycol, and polyglycerol.

(f) Metal Soap

Lead stearate, cadmium stearate, barium stearate, calcium stearate, zinc stearate, and magnesium stearate.

(g) Natural Waxes

Carnauba wax, candelila wax, bees wax, whale wax, insect wax and montan wax (h) Others Silicone Compounds, and Fluorinated Compounds Specific examples of the ultraviolet absorber that can be added to each layer include, but are not limited to, the following. (a) Benzophenone-based Compounds 2-hydrosybenzophenone, 2,4-dihydroxybenzophenone, 2,2',4-trihydroxybenzophenone, 2,2',4,4'-tetrahydroxy benzophenone, and 2,2'-dihydroxy-4-methoxy dibenzophenone.

(b) Salcylate-Based Compounds

Phenylsalicylate, and 2,4-di-t-butylphenyl-3,5-di-t-butyl-4-hydroxybenzoate. Phenylsalicylate, and 2,4-di-t-butylphenyl-3,5-di-t-butyl-4-hydroxybenzoate.

(c) Benzotriazole-Based Compounds (2'-hydroxyphenyl)benzotriazole, (2'-hydroxy-5'-methylphenyl)benzotriazole, (2'-hydroxy-5'-methyl phenyl)benzotriazole, and (2'-hydroxy-3'-tertiary butyl-5'-methylphenyl)-5-chlorobenzotriazole. (2'-hydroxyphenyl) benzotriazole, (2'-hydroxy-5'-methylphenyl)benzotriazole, (2'-hydroxy-5'-methyl phenyl)benzotriazole, and (2'-hydroxy-3'-tertiary butyl-5'-methylphenyl)-5-chlorobenzotriazole.

(d) Cyanoacylate-Based Compounds

Ethyl-2-cyano-3,3-diphenylacrylate, and methyl-2-carbomethoxy-3-(paramethoxy)acrylate.

(e) Quencher (Metal Complex-Based Compounds)

Nickel (2,2'-thiobis(4-t-octyl)phenolate)normalbutyl amine, nickeldibutyldithiocarbamate, nickel dibutyldithiocarbamate, and cobalt dicyclohexyldithiophosphate.

(f) HALS (Hindered Amines)

Bis(2,2,6,6-tetramethyl-4-piperidyl)cebacate, bis(1,2,2,6,6-pentamethyl-4-piperidyl)cebacate, 1-[2-[3-(3,5-di-t-butyl-4-hydroxyphenyl)propionyloxy]ethyl]-4-[3-(3,5-di-t-butyl-4-hydroxyphenyl)propionyloxy-2,2,6,6-tetramethylpyridine, 8-benzil-7,7,9,9-tetramethyl-3-octyl-1,3,8-triazaspiro[4,5]undecane-2,4-dione, and 4-benzoyloxy-2,2,6,6-tetramethyl piperidine The image formation method and the image forming apparatus of the present disclosure are described next with reference to the accompanying drawings.

Figure 7:
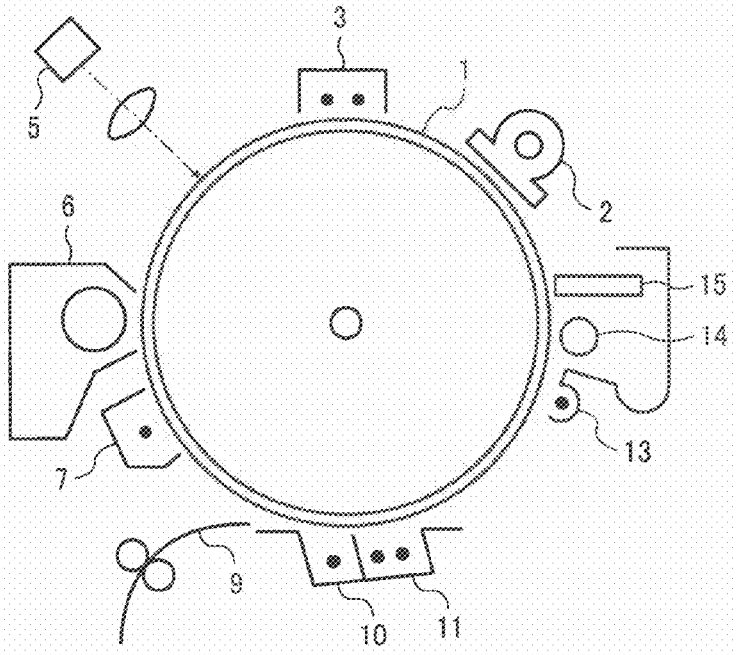
FIG. 7 is a schematic diagram illustrating an electrophotography process and an image forming apparatus.

FIG. 7 is a schematic diagram illustrating the electrophotography process and the image forming apparatus and the following examples are within the scope of the present disclosure.

Although an image bearing member 1 has a drum form in FIG. 7, it may employ a sheet or endless belt form. A sorotron, a scorotron, a solid state charger, a charging roller, and any other known chargers can be used as a charger (charging device) 3, a pre-transfer charger 7, a transfer charger 10, a separation charger 11, and a pre-cleaning charger 13.

Typically, the chargers described above can be used as the transfer device. A combinational use of the transfer charger and the separation charger as illustrated in FIG. 7 is preferable.

Typical illumination devices, for example, a fluorescent lamp, a tungsten lamp, a halogen lamp, a mercury lamp, a sodium lamp, a light emitting diode (LED), a semiconductor laser (LD), and electroluminescence (EL) can be used as the light source for the irradiator 5 and a discharging lamp 2.

Various kinds of optical filters, for example, a sharp cut filter, a band-pass filter, a near infrared filter, a dichroic filter, a coherent filter and a color conversion filter, can be used to irradiate an image bearing member with light having only a particular wavelength.

The light source, etc. also irradiates the image bearing member 1 in processes in which irradiation is used in combination with processes such as the transfer process, the discharging process, and the cleaning process or a process such as a pre-irradiation process in addition to the process illustrated in FIG. 7.

Toner for use in developing a latent electrostatic image formed on the image bearing member 1 by a development unit 6 is transferred to a transfer sheet 9. In this process, not all the toner is transferred but part of the toner remains on the image bearing member 1.

Such remaining toner is removed from the image bearing member 1 by a cleaner such as a fur brush 14 or a blade 15.

Cleaning is performed only by a known cleaning brush (e.g., the fur brush 14, a magfur brush).

When the image bearing member 1 is positively (or negatively) charged and irradiated according to image data, a positive (or negative) latent electrostatic image is formed on the image bearing member 1.

When the latent electrostatic image is developed with a negatively (or positively) charged toner (volt-detecting fine particles), a positive image is formed. When the latent electrostatic image is developed using a positively (or negatively) charged toner, a negative image is formed.

Any known method can be applied to such a development device and also a discharging device.

Figure 8:
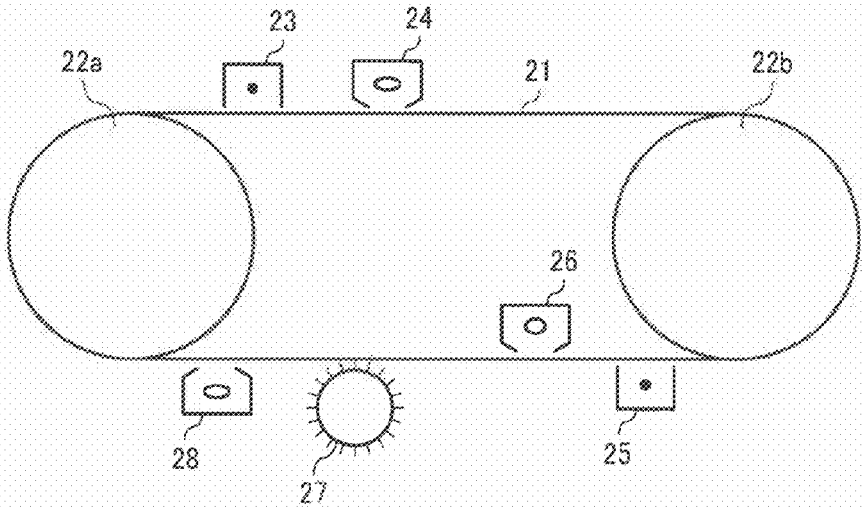
FIG. 8 is a diagram illustrating another example of electrophotography process of the present disclosure.

FIG. 8 is a diagram illustrating another example of electrophotography process of the present disclosure.

An image bearing member 21 has at least a photosensitive layer, is driven by a driving rollers 22*a* and 22*b*, charged by a charger 23, and irradiated by a light source 24 to form a latent electrostatic image thereon. The latent electrostatic images are developed by a development device (not shown) to visualize the image. The visualized image is transferred by a transfer charger 25. The image bearing member 21 is irradiated with a pre-cleaning irradiator 26 before cleaning. A brush 27 cleans the surface of the image bearing member 21. A discharging light source 28 discharges the image bearing member 21. These processes are repeated when images are formed.

In FIG. 8, the pre-cleaning irradiator 26 irradiates the image bearing member 21 from the substrate side thereof because the image bearing member 21 is transmissive in this example.

The electrophotography processes described above are for the illustration purpose only and the present disclosure is not limited thereto.

For example, in FIG. 8, the pre-cleaning irradiator 26 irradiates the image bearing member 21 from the substrate side thereof. The pre-cleaning irradiator 26 can also irradiates it from the photosensitive layer side. In addition, image irradiation and discharging irradiation can be conducted from the substrate side.

Although image irradiation, pre-cleaning irradiation, and discharging irradiation are illustrated as the light irradiation processes, other irradiation processes such as pre-transfer irradiation process, pre-image irradiation process, and other known irradiation processes can be provided to irradiate the image bearing member 21.

Although the image formation device as described above can be assembled into a photocopier, a facsimile machine, or a printer in a fixed manner, each image formation element can be incorporated into such an apparatus in a form of a process cartridge.

The process cartridge is a device (part) including an image bearing member and at least one device selected from other optional devices such as a charger, an irradiator, a development device, a transfer device, a cleaner and a discharging device.

Figure 9:
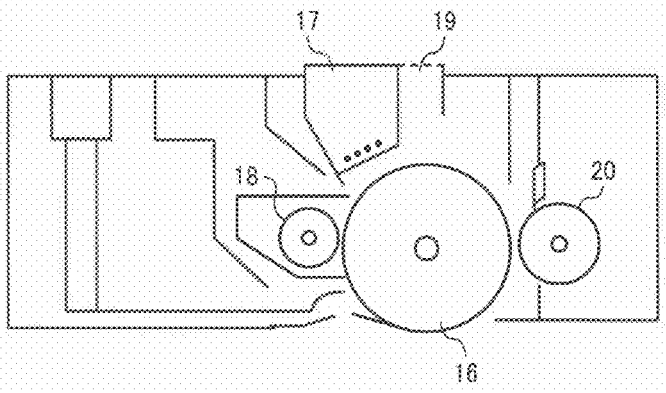
FIG. 9 is a schematic diagram illustrating an example of the process cartridge of the present disclosure.

There is no specific limit to the form of the process cartridge but a typical form thereof is as illustrated in FIG. 9.

An image bearing member 16 has a photosensitive layer on the electroconductive substrate. The reference numerals 17, 18, 19, and 20 represent a charger, a cleaning brush, an irradiator, and a charging roller, respectively.

Manufacturing Example 1

Manufacturing of naphthalene tetracarboxylic acid diimide-isoindol derivative (illustrated compound no. 8 in Table 1

No. 8

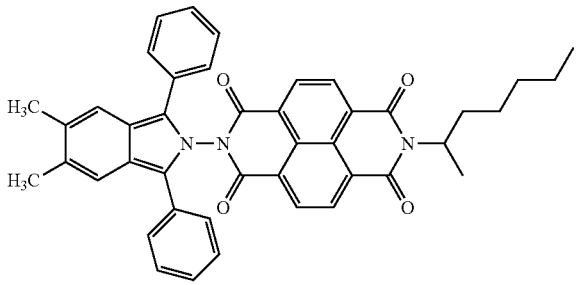

0.937 g (3 mmol) of N-amino-1,3-diphenyl-5,6-diaminoisoindol, 1.096 g (3 mmol) of naphthalene tetracarboxylic imide derivative, 50 ml of N,N-dimethylformamide (dehydrated), and 1 ml of acetic acid are added to a flask and heated and refluxed for two hours.

Subsequent to another 1 ml of acetic acid, the system is heated and refluxed for another two hours. Subsequent to cooling down, the solvent is removed with a reduced pressure.

After the residual is dissolved in toluene, the system is refined by silica gel chromatography.

Furthermore, a liquid mixture of ethanol and toluene is used for re-crystallization to obtain 1.02 g (yield ratio: 51.5%) of naphthalene tetracarboxylic acid diimide-isoindol derivative.

Figure 11:
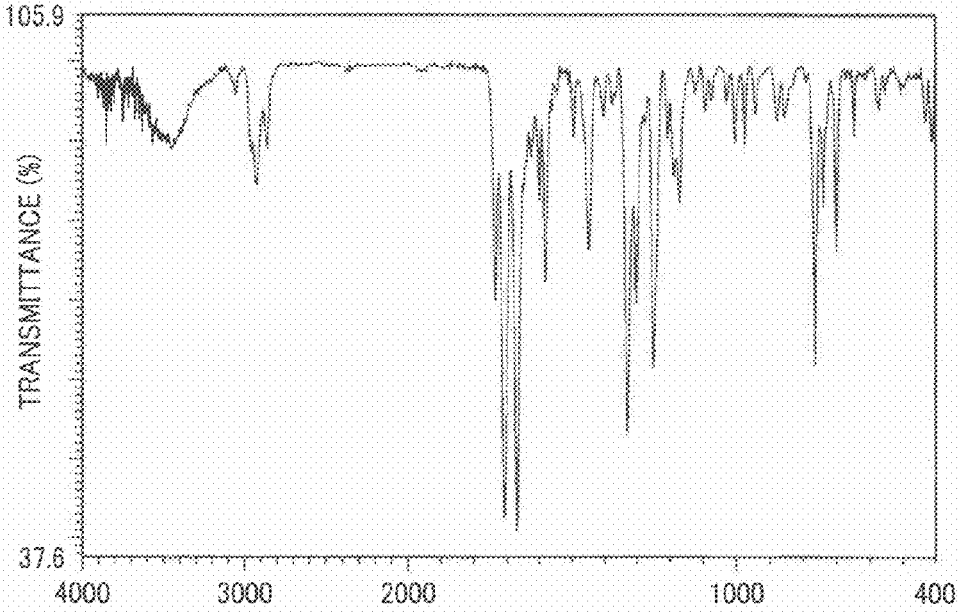
FIG. 11 is an graph illustrating an infra red absorption spectrum of naphthalene tetracarboxylic acid diimide-isoindol derivative (illustrated compound no. 8 illustrated later) manufactured in Manufacturing Example 1 described later.

The melting point thereof is 194.5° C. to 196.0° C. The infra-red absorption spectrum graph is shown as FIG. 11.

Manufacturing Example 2

Manufacturing of naphthalimide-isoindol derivative (illustrated compound no. 8 in Table 2)

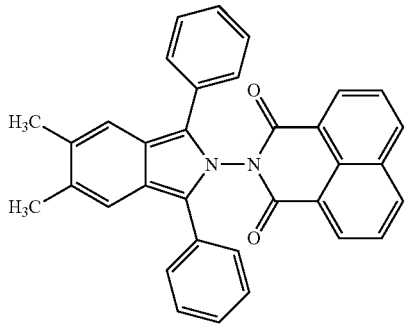

3.12 g (10 mmol) of 2-amino-1,3-diphenyl-5,6-diaminoisoindol, 4.36 g (22 mmol) of anhydride of 1,8-naphthalic acid, 100 ml of N,N-dimethylformamide (dehydrated), and 4 ml of phosphoric acid are added to a flask and heated and refluxed for six hours. Subsequent to cooling down, the solvent is removed with a reduced pressure.

The residual is dissolved in a liquid mixture of ethanol/dichloromethane/N,N-dimethylformamide for re-crystallization to obtain 1.90 g (yield ratio: 38.5%) of naphtalic acid imide-isoindol derivative as red prism crystal.

Manufacturing Example 3

Manufacturing of triphenyl amine-isoindol derivative (illustrated compound no. 8 in Table 3)

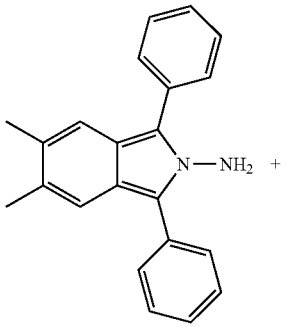

-continued

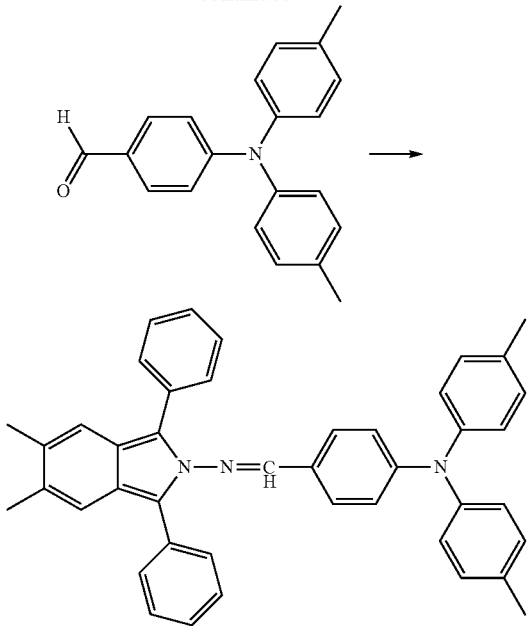

3.12 g (10 mmol) of 2-amino-1,3-diphenyl-5,6-diaminoisoindol, 3.16 g (10.5 mmol) of dimethyl triphenylamine aldehyde, 100 ml of N,N-dimethyl formamide (dehydrated), and 3 ml of acetic acid are added to a flask and heated and refluxed for one hour. Thereafter, 10 ml of acetic acid is added thereto in five hours in five separate occasions.

Subsequent to cooling down, the solvent is removed with a reduced pressure. After the residual is dissolved in toluene, the system is coarsely-fined by alumina column chromatography followed by refinement by silica gel chromatography with a solvent mixture of toluene and cyclohexane with a volume ratio of 1 to 1.

Then, the resultant is re-crystallized by a solvent mixture of toluene and methanol to obtain 0.37 g (yield ratio of 6.2%) of orange needle-like crystal of triphenyl amine-iso indol derivative.

Figure 12:
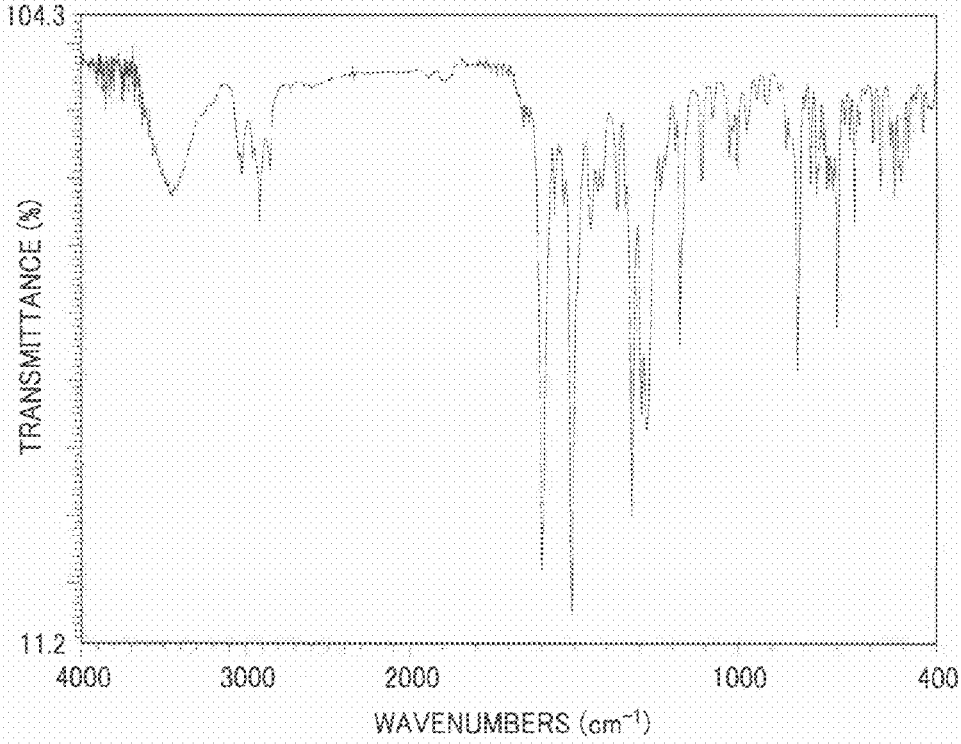
FIG. 12 is a graph illustrating an infra red absorption spectrum of triphenyl amine-isoindol derivative (illustrated compound no. 8 illustrated later) manufactured in Manufacturing Example 3 described later.

The infra-red absorption spectrum graph is shown as FIG. 12.

Having generally described (preferred embodiments of) this invention, further understanding can be obtained by reference to certain specific examples which are provided herein for the purpose of illustration only and are not intended to be limiting. In the descriptions in the following examples, the numbers represent weight ratios in parts, unless otherwise specified

EXAMPLES

Example 1

A liquid application for undercoating layer, a liquid application for charge generation layer, and a liquid application for charge transport layer having the following compositions are sequentially applied to an aluminum cylinder by dip-coating followed by drying to obtain an undercoating layer having a thickness of 3.5 μm, a charge generation layer having a thickness of 0.2 μm, and a charge transport layer having a thickness of 23 μm that form an image bearing member no. 1.

Liquid Application for Undercoating Layer

Titanium dioxide powder (TIPAQUE CR-EL, manufactured by Ishihara Sangyo Kaisha Ltd.): 400 parts Melamine resin (SUPERBECKAMINE G821-60, manufactured by DIC Corporation): 65 parts Alkyd resin (BECKOLITE M6401-50, manufactured by DIC Corporation): 120 parts 2-butanone: 400 parts Liquid Application for Charge Generation Layer Fluorenone-based bisazo pigment represented by the following chemical structure: 12 parts

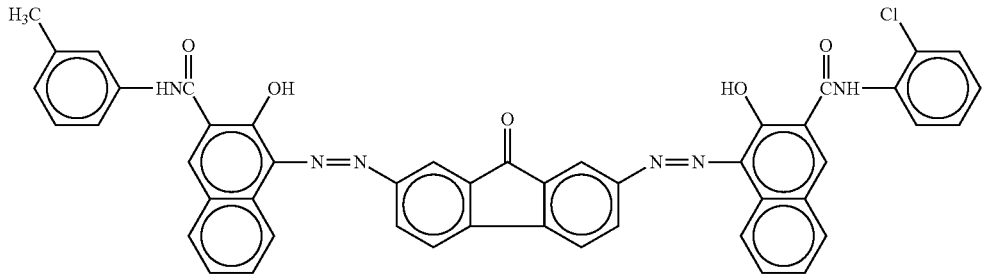

Polyvinyl butyral (XYHL, manufactured by Union Carbide Corporation): 5 parts 2-butanone: 200 parts Cyclohexanone: 400 parts Liquid Application for Charge Transport Layer Polycarbonate resin (Z POLIKA, manufactured by TEIJIN CHEMICALS LTD.): 10 parts Naphthalene tetracarboxylic acid diimide-isoindol derivative (illustrated compound no. 8): 10 parts Tetrahydrofuran: 100 parts The thus manufactured image bearing member is installed into a process cartridge, which is then attached to a machine remodeled based on imagio MF 2200 (manufactured by Ricoh Co., Ltd.) with a positive corona charging system and an irradiation light source of a semiconductor laser having a wavelength of 655 nm. With a voltage at a dark portion of 800 V, the machine continuously prints images on about 100,000 sheets as a repetition test.

The voltage (V) at a bright portion and the image are evaluated at the initial stage and after the repetition test.

In addition, with regard to the image blur (dot definition), dot images having a pixel density of 600 dpi×600 dpi with an image density of 5% are continuously printed on 10 sheets. The dot forms are observed by a stereoscopic microscope and evaluated according to the following criteria with regard to the sharpness of the contour.

Dot Image Evaluation Criteria 5 (Excellent): Cleat contour 4 (Good): Extremely slight blur of contour observed 3 (Fair): Slight blur of contour observed with no practical problem 2 (Bad): Blur of contour observed. Problematic depending on the kind of images.

1 (Very bad): dots not discernible.

The results are shown in Table 4.

Examples 2 to 15

Image bearing members no. 2 to 15 are manufactured in the same manner as in Example 1 except that illustrated nnaphthalene tetracarboxylic acid diimide-isoindol derivative no. 8 is replaced with illustrated nnaphthalene tetracarboxylic acid diimide-isoindol derivatives nos. shown in Table 4 and evaluated.

The results are shown in Table 4.

TABLE 4

| | Image | Illustrated | Initial | | After 100,00 prints | |
|---|---|---|---|---|---|---|
| Example no. | bearing no. | derivative no. | Voltage at bright portion (V) | Dot definition | Voltage at bright portion (V) | Dot definition |
| 1 | 1 | 8 | 100 | 5 | 125 | 5 |
| 2 | 2 | 1 | 105 | 5 | 120 | 5 |
| 3 | 3 | 3 | 105 | 5 | 120 | 5 |
| 4 | 4 | 5 | 110 | 5 | 125 | 5 |
| 5 | 5 | 7 | 95 | 5 | 115 | 5 |
| 6 | 6 | 9 | 100 | 5 | 125 | 5 |
| 7 | 7 | 11 | 115 | 5 | 125 | 5 |
| 8 | 8 | 13 | 115 | 5 | 145 | 4 |
| 9 | 9 | 15 | 110 | 5 | 125 | 4 |
| 10 | 10 | 17 | 105 | 5 | 135 | 4 |
| 11 | 11 | 21 | 100 | 5 | 130 | 4 |
| 12 | 12 | 23 | 110 | 5 | 120 | 5 |
| 13 | 13 | 25 | 100 | 5 | 125 | 3 |
| 14 | 14 | 27 | 105 | 5 | 125 | 5 |
| 15 | 15 | 29 | 105 | 5 | 135 | 5 |

Example 16

Image bearing member no. 16 is manufactured in the same manner as in Example 1 except that the liquid application for the charge transport layer is changed to the liquid application having the following recipe.

In addition, the repetition test and evaluation are made in the same manner except that the charging system is changed to a negative charging corona discharging (scorotron) and the voltage at dark portion is set to be −800 V.

The results are shown in Table 5.

Liquid Application for Charge Transport Layer

Polycarbonate resin (Z POLIKA, manufactured by TEIJIN CHEMICALS LTD.): 10 parts

Naphthalene tetracarboxylic acid diimide-isoindol derivative (illustrated compound no. 8): 1 part Charge transport material no. 1 represented by the following chemical structure: 9 parts

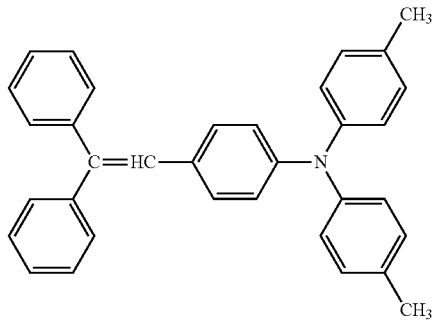

Tetrahydrofuran: 100 parts

Examples 17 to 30

Image bearing members no. 17 to 30 are manufactured in the same manner as in Example 16 except that illustrated nnaphthalene tetracarboxylic acid diimide-isoindol derivative no. 8 is replaced with illustrated nnaphthalene tetracarboxylic acid diimide-isoindol derivatives nos. shown in Table 5 and evaluated.

The results are shown in Table 5.

TABLE 5

| Example no. | Image bearing no. | Illustrated derivative no. | Initial Voltage at bright portion (V) | Initial Dot definition | After 100,00 prints Voltage at bright portion (V) | After 100,00 prints Dot definition |
|---|---|---|---|---|---|---|
| 16 | 16 | 8 | −90 | 5 | −100 | 5 |
| 17 | 17 | 1 | −95 | 5 | −100 | 5 |
| 18 | 18 | 3 | −110 | 5 | −115 | 5 |
| 19 | 19 | 5 | −95 | 5 | −110 | 5 |
| 20 | 20 | 7 | −100 | 5 | −120 | 5 |
| 21 | 21 | 9 | −95 | 5 | −110 | 5 |
| 22 | 22 | 11 | −105 | 5 | −115 | 5 |
| 23 | 23 | 13 | −100 | 5 | −125 | 4 |
| 24 | 24 | 15 | −110 | 5 | −115 | 5 |
| 25 | 25 | 17 | −105 | 5 | −115 | 5 |
| 26 | 26 | 21 | −95 | 5 | −120 | 4 |
| 27 | 27 | 23 | −110 | 5 | −115 | 5 |
| 28 | 28 | 25 | −95 | 5 | −100 | 5 |
| 29 | 29 | 27 | −105 | 5 | −115 | 4 |
| 30 | 30 | 29 | −100 | 5 | −115 | 5 |

Examples 31 to 34

Image bearing members no. 31 to 34 are manufactured and evaluated in the same manner as in Example 16 except that the contents of naphthalene tetracarboxylic acid diimide-isoindol derivative and the charge transport material no. 1 are changed to the following.

The results are shown in Table 6.

Naphthalene tetracarboxylic acid diimide-isoindol derivative: 3 parts

Charge transport material no. 1: 7 parts

TABLE 6

| Example no. | Image bearing no. | Illustrated derivative no. | Initial Voltage at bright portion (V) | Initial Dot definition | After 100,00 prints Voltage at bright portion (V) | After 100,00 prints Dot definition |
|---|---|---|---|---|---|---|
| 31 | 31 | 1 | −95 | 5 | −100 | 5 |
| 32 | 32 | 16 | −110 | 5 | −115 | 4 |

TABLE 6-continued

| Example no. | Image bearing no. | Illustrated derivative no. | Initial Voltage at bright portion (V) | Initial Dot definition | After 100,00 prints Voltage at bright portion (V) | After 100,00 prints Dot definition |
|---|---|---|---|---|---|---|
| 33 | 33 | 20 | −105 | 5 | −120 | 4 |
| 34 | 34 | 30 | −95 | 5 | −115 | 5 |

Examples 35 to 38

Image bearing members no. 35 to 38 are manufactured and evaluated in the same manner as in Examples 31 to 34 except that the charge transport material no. 1 is changed to the charge transport material no. 2.

The results are shown in Table 7.

Charge transport material No. 2

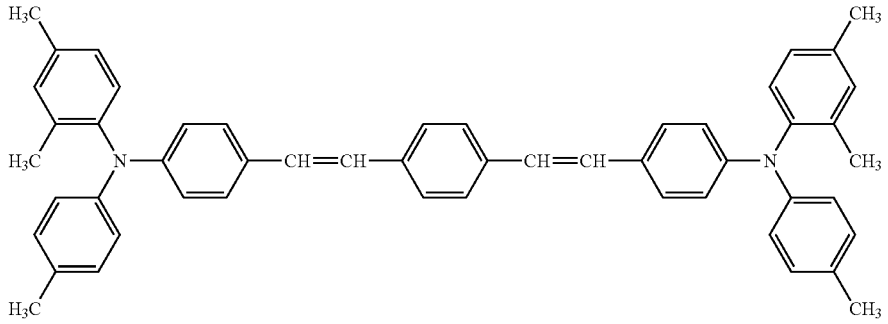

TABLE 7

| Example no. | Image bearing no. | Illustrated derivative no. | Initial Voltage at bright portion (V) | Initial Dot definition | After 100,00 prints Voltage at bright portion (V) | After 100,00 prints Dot definition |
|---|---|---|---|---|---|---|
| 35 | 35 | 1 | −90 | 5 | −100 | 5 |
| 36 | 36 | 16 | −95 | 5 | −110 | 5 |
| 37 | 37 | 20 | −95 | 5 | −105 | 4 |
| 38 | 38 | 30 | −100 | 5 | −115 | 5 |

Examples 39 to 42

Image bearing members no. 39 to 42 are manufactured and evaluated in the same manner as in Examples 31 to 34 except that the charge transport material no. 1 is changed to the charge transport material no. 3.

The results are shown in Table 8.

Charge Transport Material No. 3

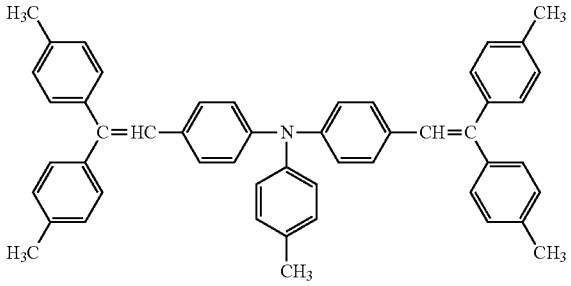

TABLE 8

| Example no. | Image bearing no. | Illustrated derivative no. | Initial Voltage at bright portion (V) | Initial Dot definition | After 100,00 prints Voltage at bright portion (V) | After 100,00 prints Dot definition |
|---|---|---|---|---|---|---|
| 39 | 39 | 1 | −100 | 5 | −110 | 5 |
| 40 | 40 | 16 | −95 | 5 | −105 | 5 |

TABLE 8-continued

| Example no. | Image bearing no. | Illustrated derivative no. | Initial Voltage at bright portion (V) | Initial Dot definition | After 100,00 prints Voltage at bright portion (V) | After 100,00 prints Dot definition |
|---|---|---|---|---|---|---|
| 41 | 41 | 20 | −105 | 5 | −125 | 4 |
| 42 | 42 | 30 | −100 | 5 | −110 | 5 |

Examples 43 to 46

Image bearing members no. 43 to 46 are manufactured and evaluated in the same manner as in Examples 31 to 34 except that the charge transport material no. 1 is changed to the charge transport material no. 4. The results are shown in Table 9.

Charge Transport Material No. 4

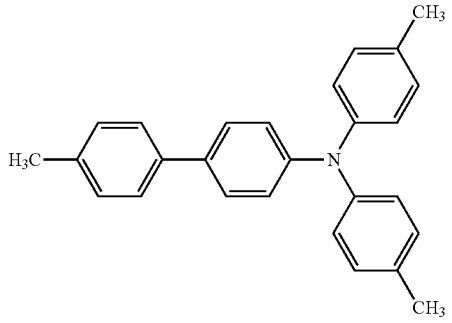

TABLE 9

| Example no. | Image bearing no. | Illustrated derivative no. | Initial Voltage at bright portion (V) | Initial Dot definition | After 100,00 prints Voltage at bright portion (V) | After 100,00 prints Dot definition |
|---|---|---|---|---|---|---|
| 43 | 43 | 1 | −105 | 5 | −115 | 5 |
| 44 | 44 | 16 | −100 | 5 | −120 | 5 |
| 45 | 45 | 20 | −105 | 5 | −125 | 4 |
| 46 | 46 | 30 | −100 | 5 | −115 | 5 |

Examples 47 and 48

Image bearing members no. 47 and 48 are manufactured in the same manner as in Example 16 except that the liquid application for the charge generation layer and the liquid application for the charge transport layer are changed to the liquid applications having the following recipe.

The results are shown in Table 10.

Manufacturing of Oxotitanium Phthalocyanine

As described in the Synthesis Example 4 in JP-2001-019871-A, 29.2 g of 1,3-diiminoisoindoline and 200 ml of sulfolane are mixed and 20.4 g of titanium tetrabutoxido is dropped thereto in nitrogen atmosphere. Thereafter, the temperature is gradually raised to 180° C., and the resultant is stirred to conduct reaction for 5 hours while the reaction temperature is maintained in a range of from 170° C. to 180° C.

Figure 10:
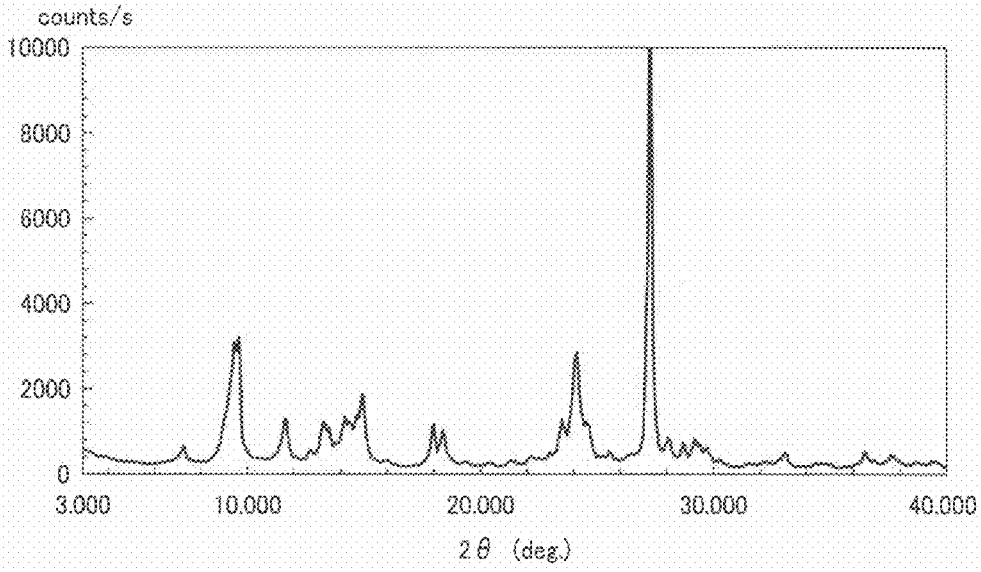
FIG. 10 is a graph illustrating a powder XD spectrum of oxotitanium phthalocyanine.

After the reaction is complete, the resultant is naturally cooled down and the precipitation is filtered. The filtered resultant is washed with chloroform until the obtained powder indicates the color of blue. Next, the resultant powder is washed with methanol several times. Further, the resultant is washed with hot water of 80° C. several times and dried to obtain a coarse titanyl phthalocyanine. The obtained coarse titanyl phthalocyanine is dissolved in strong sulfuric acid the amount of which is 20 times as much as that of the titanyl phthalocyanine. The resultant is dropped to iced water the amount which is 100 times as much as that of the titanyl phthalocyanine. The precipitated crystal is filtered and water-washing is repeated with deionized water until the washing water is neutral to obtain a wet cake (water paste) of titanyl phthalocyanine dye. The X-ray diffraction spectrum of the dried product of this cake is shown in FIG. 10.

2 g of the obtained wet cake is placed in 20 g of carbon disulfide followed by a four-hour stirring.

100 g of methanol is added thereto followed by a one-hour stirring. Subsequent to filtration and drying, crystal powder of oxotitanium is obtained.

Liquid Application for Charge Generation Layer

Oxotitanium phthalocyanine having a powder XD spectrum shown in FIG. 10: 8 parts Polyvinylbutyral (BX-1): 5 parts 2-butanone: 400 parts Liquid Application for Charge Transport Layer Polycarbonate resin (Z POLIKA): 10 parts Naphthalene tetracarboxylic acid diimide-isoindol derivative: 1 part Charge transport material no. 1 represented by the following chemical structure: 7 parts

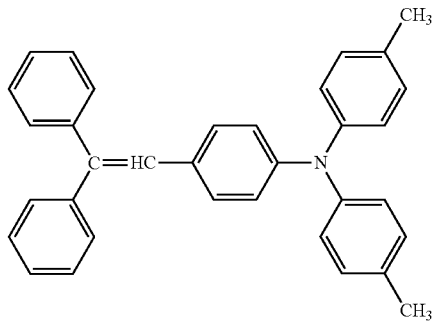

Toluene 70 parts

TABLE 10

| Example no. | Image bearing no. | Illustrated derivative no. | Initial: Voltage at bright portion (V) | Initial: Dot definition | After 100,00 prints: Voltage at bright portion (V) | After 100,00 prints: Dot definition |
|---|---|---|---|---|---|---|
| 47 | 47 | 7 | −105 | 5 | −120 | 4 |
| 48 | 48 | 30 | −100 | 5 | −115 | 5 |

Example 49

A liquid application for photosensitive layer having the following recipe is applied to an aluminum cylinder having a diameter of 100 mm followed by drying to form a single-layered photosensitive layer having a thickness of 30 μm and an image bearing member is obtained (Image bearing member no. 49).

Liquid Application for Photosensitive Layer

X type non-metal phthalocyanine (FastogenBlue 8120B, manufactured by DIC Corporation): 2 parts Charge transport material no. 2 represented by the following chemical structure: 30 parts

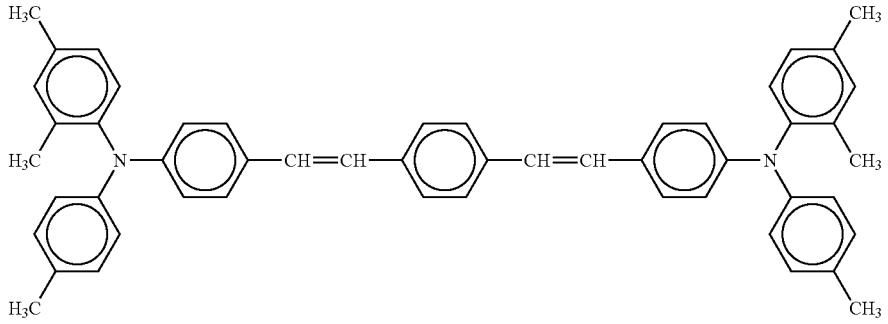

Naphthalene tetracarboxylic acid diimide-isoindol derivative no. 1: 20 part

Bisphenol Z polycarbonate) PanLite TS-2050, manufactured by Teijin Chemicals Ltd.): 50 parts Tetrahydrofuran: 500 parts The thus manufactured image bearing member is installed into a machine remodeled based on imagio Neo 752 (manufactured by Ricoh Co., Ltd.) with a corona charging system (scorotron type) and an irradiation light source of a semiconductor laser having a wavelength of 780 nm. With a surface voltage at a dark portion of 700 V, the machine continuously prints images on about 100,000 sheets as a repetition test.

The voltage (V) at a bright portion and the image are evaluated at the initial stage and after the repetition test.

In addition, the voltage at the bright portion after the repetitive test is measured.

In addition, the images are also evaluated in the same manner as in Example 5 with regard to image blur (dot definition).

The results are shown in Table 11.

Examples 50 to 52

Image bearing members 50 to 52 are manufactured in the same manner as in Example 49 except that naphthalene tetracarboxylic acid diimide-isoindol derivative no. 1 is replaced with naphthalene tetracarboxylic acid diimide-isoindol derivatives of illustrated nos. shown in Table 11 and evaluated.

TABLE 11

| Example no. | Image bearing no. | Illustrated derivative no. | Initial: Voltage at bright portion (V) | Initial: Dot definition | After 100,00 prints: Voltage at bright portion (V) | After 100,00 prints: Dot definition |
|---|---|---|---|---|---|---|
| 49 | 49 | 1 | 105 | 5 | 115 | 5 |
| 50 | 50 | 16 | 100 | 5 | 110 | 5 |
| 51 | 51 | 20 | 95 | 5 | 110 | 5 |
| 52 | 52 | 30 | 100 | 5 | 120 | 4 |

Example 53

A liquid application for photosensitive layer having the same recipe as in Example 49 is applied to an aluminum cylinder having a diameter of 30 mm followed by drying to form a single-layered photosensitive layer having a thickness of 30 μm and an image bearing member no. 53 is obtained.

The image bearing member is evaluated in the same manner as in Example 16.

The results are shown in Table 12.

Examples 54 to 56

Image bearing members 54 to 56 are manufactured in the same manner as in Example 53 except that naphthalene tetracarboxylic acid diimide-isoindol derivative no. 1 is replaced with naphthalene tetracarboxylic acid diimide-isoindol derivatives of illustrated nos. shown in Table 12 and evaluated.

TABLE 12

| Example no. | Image bearing no. | Illustrated derivative no. | Initial: Voltage at bright portion (V) | Initial: Dot definition | After 100,00 prints: Voltage at bright portion (V) | After 100,00 prints: Dot definition |
|---|---|---|---|---|---|---|
| 53 | 53 | 1 | −100 | 5 | −120 | 5 |
| 54 | 54 | 16 | −100 | 5 | −125 | 5 |

TABLE 12-continued

| Example no. | Image bearing no. | Illustrated derivative no. | Initial Voltage at bright portion (V) | Initial Dot definition | After 100,00 prints Voltage at bright portion (V) | After 100,00 prints Dot definition |
|---|---|---|---|---|---|---|
| 55 | 55 | 20 | −105 | 5 | −115 | 4 |
| 56 | 56 | 30 | −110 | 5 | −130 | 4 |

Example 57

Liquid applications for charge transport layer and charge generation layer having the following recipes are applied to an aluminum cylinder having a diameter of 30 mm followed by drying to form a charge transport layer having a thickness of 20 μm and a charge generation layer having a thickness of 0.1 μm and an image bearing member no. 57 is obtained and evaluated in the same manner as in Example 53.

The results are shown in Table 13.

Composition of Liquid Application for Charge Transport Layer

Bisphenol A type polycarbonate resin (PANLITE C-1400, manufactured by Teijin Chemicals Ltd.): 10 parts Toluene: 100 parts Naphthalene tetracarboxylic acid diimide-isoindol derivative no. 1: 10 parts Composition of Liquid Application for Charge Generation Layer Polyvinyl butyral {XYHL, manufactured by Union Carbide Corporation (UCC)}: 0.5 parts Cyclohexanone: 200 parts Methylethylketone: 80 parts X type non-metal phthalocyanine (FastogenBlue 8120B, manufactured by DIC Corporation): 2 parts Examples 58 to 60

Image bearing members 58 to 60 are manufactured in the same manner as in Example 57 except that naphthalene tetracarboxylic acid diimide-isoindol derivative no. 1 is replaced with naphthalene tetracarboxylic acid diimide-isoindol derivatives of illustrated nos. shown in Table 13 and evaluated.

TABLE 13

| Example no. | Image bearing no. | Illustrated derivative no. | Initial Voltage at bright portion (V) | Initial Dot definition | After 100,00 prints Voltage at bright portion (V) | After 100,00 prints Dot definition |
|---|---|---|---|---|---|---|
| 57 | 57 | 1 | −105 | 5 | −110 | 5 |
| 58 | 58 | 16 | −95 | 5 | −110 | 5 |
| 59 | 59 | 20 | −105 | 5 | −120 | 5 |
| 60 | 60 | 30 | −105 | 5 | −115 | 4 |

Example 61

The same repetition test and evaluation are conducted for the image bearing member manufactured in Example 1 except that the charging system is changed to a negative charging corona discharging (scorotron system) and the voltage at dark portion is set to be −800 V.

The results are shown in Table 14.

Examples 62 to 75

The image bearing members no. 2 to 15 that are manufactured in the same manner as in Example 61 except that illustrated nnaphthalene tetracarboxylic acid diimide-isoindol derivative no. 8 is replaced with illustrated nnaphthalene tetracarboxylic acid diimide-isoindol derivatives nos. shown in Table 14 are evaluated in the same manner as in Example 61.

The results are shown in Table 14.

TABLE 14

| Example no. | Image bearing no. | Illustrated derivative no. | Initial Voltage at bright portion (V) | Initial Dot definition | After 100,00 prints Voltage at bright portion (V) | After 100,00 prints Dot definition |
|---|---|---|---|---|---|---|
| 61 | 1 | 8 | −95 | 5 | −120 | 5 |
| 62 | 2 | 1 | −90 | 5 | −115 | 4 |
| 63 | 3 | 3 | −100 | 5 | −105 | 5 |
| 64 | 4 | 5 | −95 | 5 | −115 | 5 |
| 65 | 5 | 7 | −95 | 5 | −115 | 4 |
| 66 | 6 | 9 | −100 | 5 | −115 | 5 |
| 67 | 7 | 11 | −105 | 5 | −120 | 5 |
| 68 | 8 | 13 | −105 | 5 | −135 | 4 |
| 69 | 9 | 15 | −100 | 5 | −115 | 4 |
| 70 | 10 | 17 | −105 | 5 | −120 | 5 |
| 71 | 11 | 21 | −105 | 5 | −135 | 4 |
| 72 | 12 | 23 | −115 | 4 | −135 | 4 |
| 73 | 13 | 25 | −95 | 5 | −120 | 4 |
| 74 | 14 | 27 | −105 | 5 | −115 | 5 |
| 75 | 15 | 29 | −100 | 5 | −135 | 4 |

Example 76

Image bearing member no. 61 is manufactured in the same manner as in Example 16 except that the liquid application for the charge transport layer is changed to the liquid application having the following recipe.

In addition, the repetition test and evaluation are made in the same manner except that the charging system in Example 16 is changed to a positive charging corona discharging (scorotron system) and the voltage at dark portion is set to be 800 V The results are shown in Table 15.

Liquid Application for Charge Transport Layer

Polycarbonate resin (Z POLIKA, manufactured by TEIJIN CHEMICALS LTD.): 10 parts

Naphthalene tetracarboxylic acid diimide-isoindol derivative (illustrated compound no. 8): 1 part Charge Transport Material represented by the following chemical structure: 9 parts

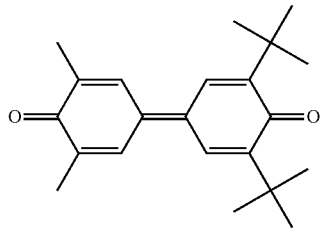

Tetrahydrofuran: 100 parts

Example 77

Image bearing member no. 62 is manufactured in the same manner as in Example 76 except that the charge transport material is changed to the material represented by the following chemical structure.

In addition, the image bearing member no. 62 is evaluated in the same manner as in Example 76.

The results are shown in Table 15.

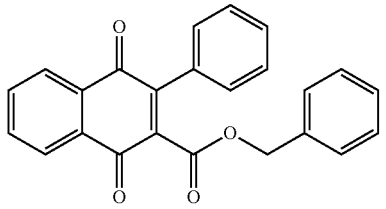

Example 78

Image bearing member no. 63 is manufactured in the same manner as in Example 76 except that the charge transport material is changed to the material represented by the following chemical structure. In addition, the image bearing member no. 63 is evaluated in the same manner as in Example 76.

The results are shown in Table 15.

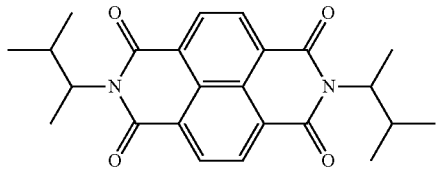

Example 79

Image bearing member no. 64 is manufactured in the same manner as in Example 76 except that the charge transport material is changed to the material represented by the following chemical structure. In addition, the image bearing member no. 64 is evaluated in the same manner as in Example 76.

The results are shown in Table 15.

TABLE 15

| | | | Initial | | After 100,00 prints | |
|---|---|---|---|---|---|---|
| Example no. | Image bearing no. | Illustrated derivative no. | Voltage at bright portion (V) | Dot definition | Voltage at bright portion (V) | Dot definition |
| 76 | 61 | 8 | 105 | 5 | 115 | 5 |
| 77 | 62 | 8 | 95 | 5 | 115 | 5 |
| 78 | 63 | 8 | 90 | 5 | 105 | 5 |
| 79 | 64 | 8 | 95 | 5 | 100 | 5 |

Comparative Example 1

In Example 1, comparative image bearing member no. 1 is manufactured and evaluated in the same manner as in Example 1 except that naphthalene tetracarboxylic acid diimide-isoindol derivative no. 8 is changed to a benzoquinone derivative represented by the following chemical structure.

The results are shown in Table 16.

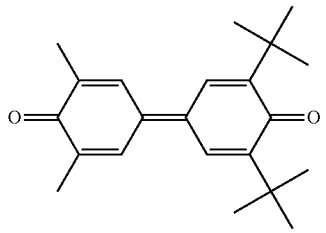

Comparative Example 2

Comparative image bearing member no. 2 is manufactured and evaluated in the same manner as in Example 16 except that no naphthalene tetracarboxylic acid diimide-isoindol derivative is added to the liquid application for charge transport layer and the content of the charge transport material is changed to 10 parts by weight.

The results are shown in Table 16.

Comparative Example 3

Comparative image bearing member no. 3 is manufactured and evaluated in the same manner as in Example 35 except that naphthalene tetracarboxylic acid diimide-isoindol derivative is changed to tetraphenyl methane compound represented by the following chemical structure (refer to JP-2000-231204-A).

The results are shown in Table 16.

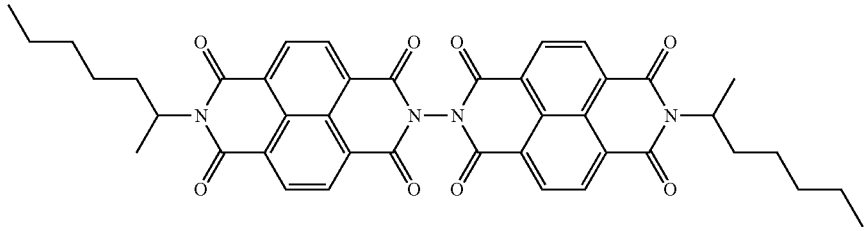

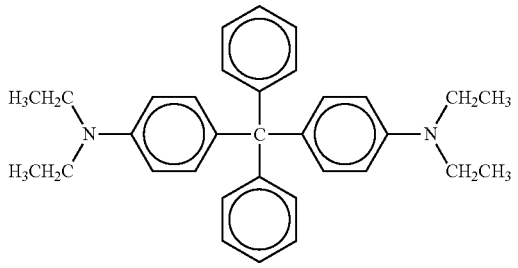

Comparative Example 4

Comparative image bearing member no. 4 is manufactured and evaluated in the same manner as in Example 47 except that naphthalene tetracarboxylic acid diimide-isoindol derivative is changed to a hindered amine-based anti-oxidizing agent represented by the following chemical structure. The results are shown in Table 16.

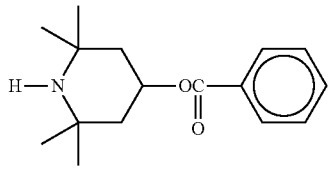

Comparative Example 5

Comparative image bearing member no. 5 is manufactured and evaluated in the same manner as in Example 49 except that 20 parts of naphthalene tetracarboxylic acid diimide-isoindol derivative no. 1 is changed to charge transport materials represented by the following chemical structures.

The results are shown in Table 16.

Charge transport material represented by the following chemical structure: 18 parts

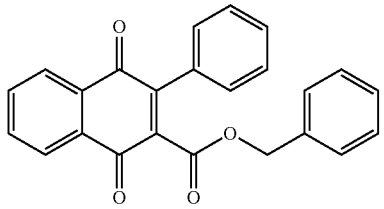

Charge transport material represented by the following chemical structure: 2 parts

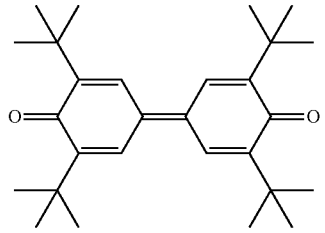

Comparative Example 6

Comparative image bearing member no. 6 is manufactured and evaluated in the same manner as in Example 49 except that 20 parts of naphthalene tetracarboxylic acid diimide-isoindol derivative no. 1 is changed to a charge transport material represented by the following chemical structure.

The results are shown in Table 16.

Charge transport polymer material represented by the following chemical structure: 20 parts

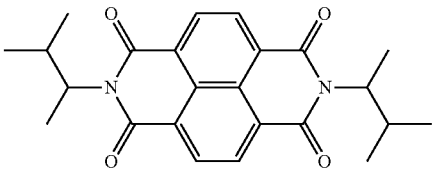

Comparative Example 7

Comparative image bearing member no. 7 is manufactured and evaluated in the same manner as in Example 57 except that 10 parts of naphthalene tetracarboxylic acid diimide-isoindol derivative no. 1 is changed to charge transport materials represented by the following chemical structures.

The results are shown in Table 16.

Charge transport material represented by the following chemical structure: 9 parts

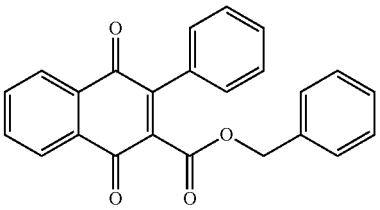

Charge transport material represented by the following chemical structure: 1 part

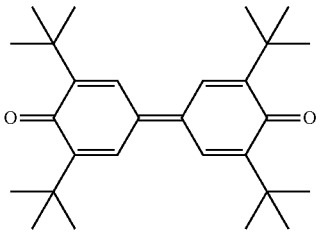

TABLE 16

| | | Initial | | After 100,00 prints | |
|---|---|---|---|---|---|
| Comparative Example no. | Comparative Image bearing no. | Voltage at bright portion (V) | Dot definition | Voltage at bright portion (V) | Dot definition |
| 1 | 1 | +250 | 3 | +440 | 1 |
| 2 | 2 | −100 | 5 | −135 | 2 |

TABLE 16-continued

| Comparative Example no. | Comparative Image bearing no. | Initial: Voltage at bright portion (V) | Initial: Dot definition | After 100,00 prints: Voltage at bright portion (V) | After 100,00 prints: Dot definition |
|---|---|---|---|---|---|
| 3 | 3 | −200 | 4 | −285 | 3 |
| 4 | 4 | −250 | 2 | −480 | 1 |
| 5 | 5 | +105 | 5 | +145 | 1 |
| 6 | 6 | +110 | 4 | +155 | 1 |
| 7 | 7 | −100 | 4 | −120 | 1 |

Judging from the evaluation results, it is confirmed that the voltage at bright portion of the image bearing members of the present disclosure having naphthalene tetracarboxylic acid diimide-isoindol derivative does not rise significantly after outputs of 100,000 images so that quality images can be stably produced.

To the contrary, the comparative image bearing members 1, 3, and 4 have an extremely high voltage at bright portion from the start, resulting in deterioration of the image density and the definition. After the output of 100,000 sheets, graduation extremely deteriorates, causing the images not discernable. Furthermore, as seen in the evaluation results in Tables 4 and 11, the image bearing members of the present disclosure can produce quality images even in the positive charging system. After the output of 100,000 sheets, quality images can be still produced and the evaluation results of the image blur (dot definition) are still good.

In addition, although the voltage at the bright portion of the comparative image bearing members 2, 5, 6, and 7 rises relatively slightly, the definition deteriorates significantly after repetitive use in comparison with the image bearing members of the present disclosure. Examples 80 to 86 and Comparative Example 8

In addition, the image bearing members of the present disclosure shown in Table 17 and the comparative image bearing member no. 2 are left for four days in a desiccator in which nitrogen oxides (NOx) gas density is adjusted to be 50 ppm and the dot images are evaluated before and after the image bearing members are left for four days.

TABLE 17

| Example no. | Image bearing member no. | Initial image quality | Image quality after left for four days |
|---|---|---|---|
| 80 | 1 | 5 | 5 |
| 81 | 17 | 5 | 5 |
| 82 | 33 | 5 | 5 |
| 83 | 37 | 5 | 4 |
| 84 | 48 | 5 | 5 |
| 85 | 49 | 5 | 4 |

TABLE 17-continued

| Example no. | Image bearing member no. | Initial image quality | Image quality after left for four days |
|---|---|---|---|
| 86 | 59 | 5 | 5 |
| Comparative Example no. 8 | Comparative Image bearing member 2 | 5 | 1 |

As seen in the evaluation results shown in Table 17, the image bearing members containing naphthalene tetracarboxylic acid diimide-isoindol derivative has a significantly improved chemical resistance to oxidizing gases, thereby preventing degradation of the definition.

To the contrary, the quality of images produced by the comparative image bearing member 2 is good at the initial stage but deteriorate significantly over time due to oxidizing gasses.

Example 87

A liquid application for undercoating layer, a liquid application for charge generation layer, and a liquid application for charge transport layer having the following compositions are sequentially applied to an aluminum cylinder by dip-coating followed by drying to obtain an undercoating layer having a thickness of 3.5 μm, a charge generation layer having a thickness of 0.2 μm, and a charge transport layer having a thickness of 23 μm that form an image bearing member no. 65.

Liquid Application for Undercoating Layer

Titanium dioxide powder (TIPAQUE CR-EL, manufactured by Ishihara Sangyo Kaisha Ltd.) 400 parts Melamine resin (SUPERBECKAMINE G821-60, manufactured by DIC Corporation): 65 parts Alkyd resin (BECKOLITE M6401-50, manufactured by DIC Corporation): 120 parts 2-butanone: 400 parts Liquid Application for Charge Generation Layer Fluorenone-based bisazo pigment represented by the following chemical structure: 12 parts

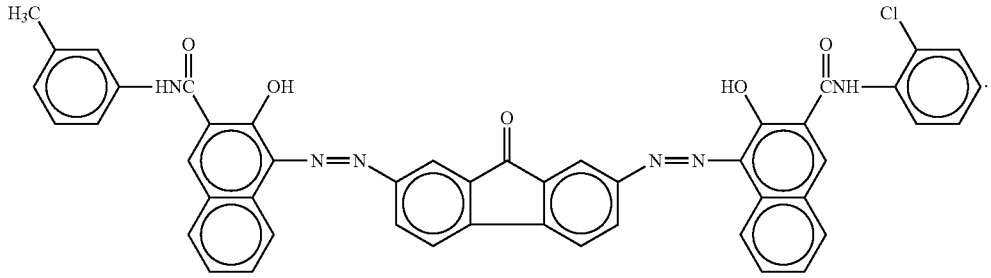

Polyvinyl butyral (XYHL, manufactured by Union Carbide Corporation): 5 parts 2-butanone: 200 parts Cyclohexanone 400 parts Liquid Application for Charge Transport Layer Polycarbonate resin (Z POLIKA, manufactured by TEIJIN CHEMICALS LTD.): 10 parts Naphthalimide-isoindol derivative of illustrated derivative no. 8: 10 parts Tetrahydrofuran: 100 parts The thus manufactured image bearing member is installed into a process cartridge, which is then attached to a machine remodeled based on imagio MF 2200 (manufactured by Ricoh Co., Ltd.) with a positive corona charging system and an irradiation light source of a semiconductor laser having a wavelength of 655 nm. With a voltage at a dark portion of 800 V, the machine continuously prints images on about 100,000 sheets as a repetition test. The voltage (V) at a bright portion and the image at the initial stage and after the repetition test are evaluated. In addition, with regard to the image blur (dot definition), dot images having a pixel density of 600 dpi×600 dpi with an image density of 5% are continuously printed on 10 sheets. The dot forms are observed by a stereoscopic microscope and evaluated according to the following criteria with regard to the sharpness of the contour.

Dot Image Evaluation Criteria 5 (Excellent): Cleat contour 4 (Good): Extremely slight blur of contour observed 3 (Fair): Slight blur of contour observed with no practical problem 2 (Bad): Blur of contour observed. Problematic depending on the kind of images.

1 (Very bad): dots no discernible.

The results are shown in Table 18.

Examples 88 to 101

Image bearing members 66 to 79 are manufactured in the same manner as in Example 87 except that illustrated naphthalimide-isoindol derivative no. 8 is replaced with illustrated naphthalimide-isoindol derivatives nos. shown in Table 18 and evaluated.

The results are shown in Table 18.

TABLE 18

| | | | Initial | | After 100,00 prints | |
|---|---|---|---|---|---|---|
| Example no. | Image bearing no. | Illustrated derivative no. | Voltage at bright portion (V) | Dot definition | Voltage at bright portion (V) | Dot definition |
| 87 | 65 | 8 | 110 | 5 | 120 | 5 |
| 88 | 66 | 1 | 100 | 5 | 125 | 5 |
| 89 | 67 | 3 | 105 | 5 | 125 | 5 |
| 90 | 68 | 5 | 115 | 5 | 130 | 4 |
| 91 | 69 | 7 | 90 | 5 | 110 | 5 |
| 92 | 70 | 9 | 95 | 5 | 105 | 5 |
| 93 | 71 | 11 | 110 | 5 | 120 | 5 |
| 94 | 72 | 13 | 115 | 5 | 145 | 4 |
| 95 | 73 | 15 | 110 | 5 | 125 | 4 |
| 96 | 74 | 17 | 115 | 5 | 130 | 4 |
| 97 | 75 | 21 | 105 | 5 | 135 | 4 |
| 98 | 76 | 23 | 115 | 5 | 125 | 5 |
| 99 | 77 | 25 | 105 | 5 | 125 | 3 |
| 100 | 78 | 27 | 110 | 5 | 120 | 5 |
| 101 | 79 | 29 | 105 | 5 | 135 | 5 |

Example 102

Image bearing member no. 80 is manufactured in the same manner as in Example 87 except that the liquid application for the charge transport layer is changed to the liquid application having the following recipe.

In addition, the repetition test and evaluation are made in the same manner except that the charging system is changed to a negative charging corona discharging (scorotron system) and the voltage at dark portion is set to be −800 V. The results are shown in Table 19.

Liquid Application for Charge Transport Layer

Polycarbonate resin (Z POLIKA, manufactured by TEIJIN CHEMICALS LTD.): 10 parts

Illustrated naphthalimide-isoindol derivative no. 8: 1 part

Charge transport material no. 1 represented by the following chemical structure: 9 parts

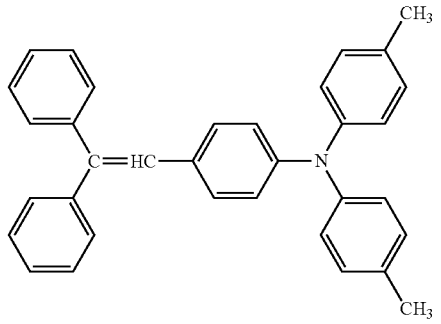

Tetrahydrofuran: 100 parts

Examples 103 to 116

Image bearing members 81 to 94 are manufactured in the same manner as in Example 102 except that illustrated naphthalimide-isoindol derivative no. 8 is replaced with illustrated naphthalimide-isoindol derivatives nos. shown in Table 19 and evaluated.

The results are shown in Table 19.

TABLE 19

| | | | Initial | | After 100,00 prints | |
|---|---|---|---|---|---|---|
| Example no. | Image bearing no. | Illustrated derivative no. | Voltage at bright portion (V) | Dot definition | Voltage at bright portion (V) | Dot definition |
| 102 | 80 | 8 | −90 | 5 | −95 | 5 |
| 103 | 81 | 1 | −90 | 5 | −105 | 5 |
| 104 | 82 | 3 | −115 | 5 | −110 | 5 |
| 105 | 83 | 5 | −100 | 5 | −105 | 5 |
| 106 | 84 | 7 | −105 | 5 | −125 | 5 |
| 107 | 85 | 9 | −95 | 5 | −110 | 5 |
| 108 | 86 | 11 | −105 | 5 | −110 | 5 |
| 109 | 87 | 13 | −115 | 5 | −120 | 4 |
| 110 | 88 | 15 | −115 | 5 | −115 | 5 |
| 111 | 89 | 17 | −100 | 5 | −115 | 5 |
| 112 | 90 | 21 | −95 | 5 | −120 | 4 |
| 113 | 91 | 23 | −100 | 5 | −110 | 5 |
| 114 | 92 | 25 | −90 | 5 | −100 | 5 |
| 115 | 93 | 27 | −100 | 5 | −115 | 4 |
| 116 | 94 | 29 | −105 | 5 | −115 | 5 |

Examples 117 to 120

Image bearing members no. 95 to 98 are manufactured and evaluated in the same manner as in Example 102 except that the contents of naphthalimide-isoindol derivative and the charge transport material no. 1 are changed to the following.

The results are shown in Table 20.

Naphthalimide-isoindol derivative: 3 parts

Charge transport material 7 parts

TABLE 20

| Example no. | Image bearing no. | Illustrated derivative no. | Initial: Voltage at bright portion (V) | Initial: Dot definition | After 100,00 prints: Voltage at bright portion (V) | After 100,00 prints: Dot definition |
|---|---|---|---|---|---|---|
| 117 | 95 | 4 | −90 | 5 | −110 | 5 |
| 118 | 96 | 9 | −100 | 5 | −115 | 4 |
| 119 | 97 | 21 | −115 | 5 | −120 | 5 |
| 120 | 98 | 29 | −90 | 5 | −115 | 5 |

Examples 121 to 124

Image bearing members 99 to 102 are manufactured in the same manner as in Example 117 except that naphthalimide-isoindol derivative is replaced with illustrated naphthalimide-isoindol derivatives nos. shown in Table 21 and the charge transport material no. 1 is changed to the following charge transport material no. 2 and evaluated.

The results are shown in Table 21.

Charge Transport Material No. 2

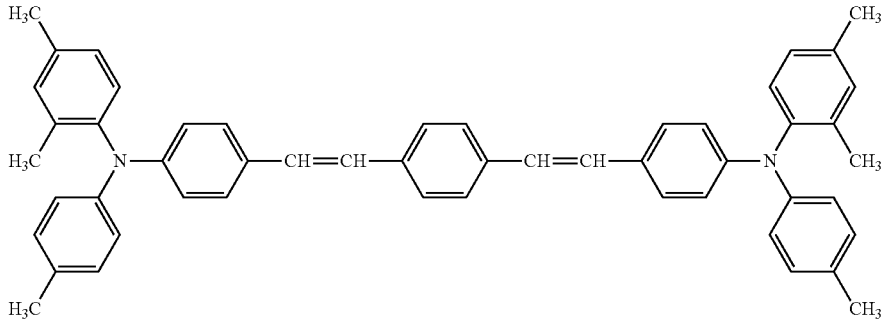

TABLE 21

| Example no. | Image bearing no. | Illustrated derivative no. | Initial: Voltage at bright portion (V) | Initial: Dot definition | After 100,00 prints: Voltage at bright portion (V) | After 100,00 prints: Dot definition |
|---|---|---|---|---|---|---|
| 121 | 99 | 1 | −95 | 5 | −100 | 5 |
| 122 | 100 | 14 | −90 | 5 | −110 | 4 |
| 123 | 101 | 25 | −105 | 5 | −115 | 5 |
| 124 | 102 | 33 | −100 | 5 | −115 | 5 |

Examples 125 to 128

Image bearing members 103 to 106 are manufactured in the same manner as in Example 117 except that naphthalimide-isoindol derivative is replaced with illustrated naphthalimide-isoindol derivatives nos. shown in Table 22 and the charge transport material no. 1 is changed to the following charge transport material no. 3 and evaluated. The results are shown in Table 22.

Charge Transport Material No. 3

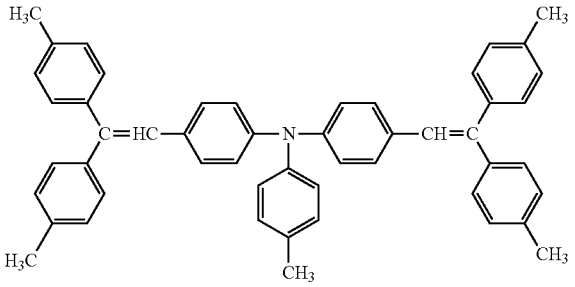

TABLE 22

| Example no. | Image bearing no. | Illustrated derivative no. | Initial: Voltage at bright portion (V) | Initial: Dot definition | After 100,00 prints: Voltage at bright portion (V) | After 100,00 prints: Dot definition |
|---|---|---|---|---|---|---|
| 125 | 103 | 2 | −105 | 5 | −115 | 5 |
| 126 | 104 | 14 | −100 | 5 | −105 | 5 |

TABLE 22-continued

| Example no. | Image bearing no. | Illustrated derivative no. | Initial: Voltage at bright portion (V) | Initial: Dot definition | After 100,00 prints: Voltage at bright portion (V) | After 100,00 prints: Dot definition |
|---|---|---|---|---|---|---|
| 127 | 105 | 22 | −95 | 5 | −110 | 4 |
| 128 | 106 | 30 | −105 | 5 | −115 | 5 |

Examples 129 to 132

Image bearing members 107 to 110 are manufactured in the same manner as in Example 117 except that naphthalimide-isoindol derivative is replaced with illustrated naphthalimide-isoindol derivatives nos. shown in Table 23 and the charge transport material no. 1 is changed to the following charge transport material no. 4 and evaluated.

The results are shown in Table 23.

Charge Transport Material No. 4

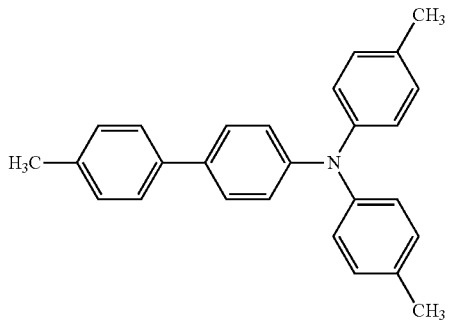

TABLE 23

| Example no. | Image bearing no. | Illustrated derivative no. | Initial: Voltage at bright portion (V) | Initial: Dot definition | After 100,00 prints: Voltage at bright portion (V) | After 100,00 prints: Dot definition |
|---|---|---|---|---|---|---|
| 129 | 107 | 1 | −105 | 5 | −115 | 5 |
| 130 | 108 | 12 | −115 | 5 | −125 | 5 |
| 131 | 109 | 22 | −100 | 5 | −130 | 4 |
| 132 | 110 | 31 | −100 | 5 | −115 | 5 |

Examples 133 and 134

Image bearing members no. 111 and 112 are manufactured in the same manner as in Example 102 except that the liquid application for the charge generation layer and the liquid application for the charge transport layer are changed to the liquid applications having the following recipe. The results are shown in Table 24.

Manufacturing of Oxotitanium Phthalocyanine

As described in the Synthesis Example 4 in JP-2001-019871-A, 29.2 g of 1,3-diiminoisoindoline and 200 ml of sulfolane are mixed and 20.4 g of titanium tetrabutoxido is dropped thereto in nitrogen atmosphere. Thereafter, the temperature is gradually raised to 180° C., and the resultant is stirred to conduct reaction for 5 hours while the reaction temperature is maintained in a range of from 170° C. to 180° C. After the reaction is complete, the resultant is naturally cooled down and the precipitation is filtered. The filtered resultant is washed with chloroform until the obtained powder indicates the color of blue. Next, the resultant powder is washed with methanol several times. Further, the resultant is washed with hot water of 80° C. several times and dried to obtain a coarse titanyl phthalocyanine. The obtained coarse titanyl phthalocyanine is dissolved in strong sulfuric acid the amount of which is 20 times as much as that of the titanyl phthalocyanine. The resultant is dropped to iced water the amount which is 100 times as much as that of the titanyl phthalocyanine. The precipitated crystal is filtrated and water-washing is repeated with deionized water until the washing water is neutral to obtain a wet cake (water paste) of titanyl phthalocyanine dye. The X-ray diffraction spectrum of the dried product of this cake is shown in FIG. 10. 2 g of the obtained wet cake is placed in 20 g of carbon disulfide followed by a four-hour stirring. 100 g of methanol is added thereto followed by a one-hour stirring. Subsequent to filtration and drying, crystal powder of oxotitanium is obtained.

Liquid Application for Charge Generation Layer

Titanium phthalocyanine having a powder XD spectrum shown in FIG. 10: 8 parts Polyvinylbutyral (BX-1): 5 parts 2-butanone: 400 parts Liquid Application for Charge Transport Layer Polycarbonate resin (Z POLIKA): 10 parts Naphthalimide-isoindol derivative: 1 part Charge transport material no. 1 represented by the following chemical structure: 7 parts

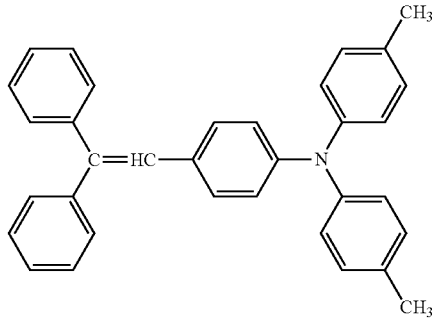

Toluene 70 parts

TABLE 24

| Example no. | Image bearing no. | Illustrated derivative no. | Initial: Voltage at bright portion (V) | Initial: Dot definition | After 100,00 prints: Voltage at bright portion (V) | After 100,00 prints: Dot definition |
|---|---|---|---|---|---|---|
| 133 | 111 | 8 | −100 | 5 | −115 | 5 |
| 134 | 112 | 21 | −105 | 5 | −120 | 4 |

Example 135

A liquid application for photosensitive layer having the following recipe is applied to an aluminum cylinder having a diameter of 100 mm followed by drying to form a single-layered photosensitive layer having a thickness of 30 μm and an image bearing member is obtained.

Image bearing member no. 113 Liquid Application for Photosensitive Layer

X type non-metal phthalocyanine (FastogenBlue 8120B, manufactured by DIC Corporation): 2 parts Charge transport material no. 2 represented by the following chemical structure: 30 parts

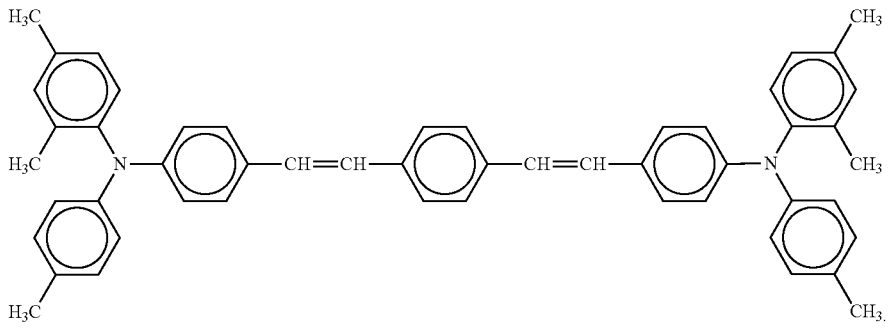

Naphthalimide-isoindol derivative no. 1: 20 part

Bisphenol Z polycarbonate (PanLite TS-2050, manufactured by Teijin Chemicals Ltd.): 50 parts Tetrahydrofuran: 500 parts The thus manufactured image bearing member is installed into a machine remodeled based on imagio Neo 752 (manufactured by Ricoh Co., Ltd.) with a corona charging system (scorotron type) and an irradiation light source of a semiconductor laser having a wavelength of 780 nm. With a surface voltage at a dark portion of 700 V, the machine continuously prints images on about 100,000 sheets as a repetition test. The voltage (V) at a bright portion and the image at the initial stage and after the repetition test are evaluated. In addition, the voltage at the bright portion after the repetitive test is measured. In addition, the images are also evaluated in the same manner as in Example 91 with regard to image blur (dot definition).

The results are shown in Table 25.

Examples 136 to 138

Image bearing members 122 to 124 are manufactured in the same manner as in Example 135 except that naphthalimide-isoindol derivative no. 1 is replaced with illustrated naphthalimide-isoindol derivatives nos. shown in Table 25 and evaluated.

TABLE 25

| | | | Initial | | After 100,00 prints | |
|---|---|---|---|---|---|---|
| Example no. | Image bearing no. | Illustrated derivative no. | Voltage at bright portion (V) | Dot definition | Voltage at bright portion (V) | Dot definition |
| 135 | 113 | 1 | 100 | 5 | 110 | 5 |
| 136 | 114 | 14 | 105 | 5 | 115 | 5 |
| 137 | 115 | 21 | 95 | 5 | 115 | 5 |
| 138 | 116 | 32 | 115 | 5 | 130 | 4 |

Example 139

A liquid application for photosensitive layer having the same recipe as in Example 135 is applied to an aluminum cylinder having a diameter of 30 mm followed by drying to form a single-layered photosensitive layer having a thickness of 30 μm and an image bearing member no. 117 is obtained. The image bearing member no. 117 is evaluated in the same manner as in Example 102.

The results are shown in Table 26.

Examples 140 to 142

Image bearing members 118 to 120 are manufactured in the same manner as in Example 139 except that naphthalimide-isoindol derivative no. 1 is replaced with illustrated naphthalimide-isoindol derivatives nos. shown in Table 26 and evaluated.

TABLE 26

| | | | Initial | | After 100,00 prints | |
|---|---|---|---|---|---|---|
| Example no. | Image bearing no. | Illustrated derivative no. | Voltage at bright portion (V) | Dot definition | Voltage at bright portion (V) | Dot definition |
| 139 | 117 | 1 | −95 | 5 | −110 | 5 |
| 140 | 118 | 14 | −105 | 5 | −125 | 5 |
| 141 | 119 | 25 | −110 | 5 | −135 | 4 |
| 142 | 120 | 31 | −105 | 5 | −130 | 4 |

Example 143

Liquid applications for charge transport layer and charge generation layer having the following recipes are applied to an aluminum cylinder having a diameter of 30 mm followed by drying to form a charge transport layer having a thickness of 20 μm and a charge generation layer having a thickness of 0.1 μm and an image bearing member no. 121 is obtained and evaluated in the same manner as in Example 139.

The results are shown in Table 27.

Composition of Liquid Application for Charge Transport Layer

Bisphenol A type polycarbonate resin (PANLITE C-1400, manufactured by Teijin Chemicals Ltd.): 10 parts Toluene: 100 parts Naphthalimide-isoindol derivative no. 1: 10 parts Component of Liquid Application for Charge Generation Layer Polyvinyl butyral {XYHL, manufactured by Union Carbide Corporation (UCC)}: 0.5 parts Cyclohexanone: 200 parts Methylethylketone: 80 parts X type non-metal phthalocyanine (FastogenBlue 8120B, manufactured by DIC Corporation): 2 parts Examples 144 to 146

Image bearing members 122 to 124 are manufactured in the same manner as in Example 143 except that naphthalimide-isoindol derivative no. 1 is replaced with illustrated naphthalimide-isoindol derivatives nos. shown in Table 27 and evaluated.

TABLE 27

| | | | Initial | | After 100,00 prints | |
|---|---|---|---|---|---|---|
| Example no. | Image bearing no. | Illustrated derivative no. | Voltage at bright portion (V) | Dot definition | Voltage at bright portion (V) | Dot definition |
| 143 | 121 | 1 | −115 | 5 | −125 | 5 |
| 144 | 122 | 15 | −95 | 5 | −110 | 5 |
| 145 | 123 | 28 | −115 | 5 | −120 | 5 |
| 146 | 124 | 30 | −105 | 5 | −135 | 4 |

Example 147

The same repetition test and evaluation are conducted for the image bearing member manufactured in Example 87 except that the charging system is changed to a negative charging corona discharging (scorotron system) and the voltage at dark portion is set to be −800 V.

The results are shown in Table 28.

Examples 148 to 161

Image bearing members 66 to 79 that are manufactured in the same manner as in Example 147 except that illustrated naphthalimide-isoindol derivative no. 8 is replaced with illustrated naphthalimide-isoindol derivatives nos. shown in Table 28 are evaluated in the same manner as in Example 147.

The results are shown in Table 28.

TABLE 28

| | | | Initial | | After 100,00 prints | |
|---|---|---|---|---|---|---|
| Example no. | Image bearing no. | Illustrated derivative no. | Voltage at bright portion (V) | Dot definition | Voltage at bright portion (V) | Dot definition |
| 147 | 65 | 8 | −90 | 5 | −110 | 5 |
| 148 | 66 | 1 | −100 | 5 | −115 | 4 |
| 149 | 67 | 3 | −105 | 5 | −115 | 5 |
| 150 | 68 | 5 | −95 | 5 | −105 | 5 |
| 151 | 69 | 7 | −100 | 5 | −120 | 4 |
| 152 | 70 | 9 | −100 | 5 | −110 | 5 |
| 153 | 71 | 11 | −95 | 5 | −115 | 5 |
| 154 | 72 | 13 | −105 | 5 | −125 | 4 |
| 155 | 73 | 15 | −105 | 5 | −115 | 4 |
| 156 | 74 | 17 | −115 | 5 | −125 | 5 |
| 157 | 75 | 21 | −120 | 5 | −135 | 4 |
| 158 | 76 | 23 | −110 | 4 | −135 | 4 |
| 159 | 77 | 25 | −105 | 5 | −130 | 4 |
| 160 | 78 | 27 | −100 | 5 | −115 | 5 |
| 161 | 79 | 29 | −115 | 5 | −135 | 4 |

Example 162

Image bearing member no. 125 is manufactured in the same manner as in Example 102 except that the liquid application of charge transport layer is changed to the liquid application having the following recipe.

In addition, the repetition test and evaluation are made in the same manner except that the charging system in Example 102 is changed to a positive charging corona discharging (scorotron system) and the voltage at dark portion is set to be 800 V. The results are shown in Table 29.

Liquid Application for Charge Transport Layer

Polycarbonate resin (Z POLIKA, manufactured by TEIJIN CHEMICALS LTD.): 10 parts

Illustrated naphthalimide-isoindol derivative no. 8: 1 part

Charge transport material represented by the following chemical structure: 9 parts

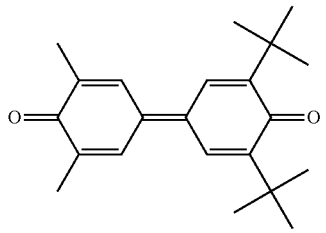

Tetrahydrofuran: 100 parts

Example 163

The image bearing member 126 is manufactured in the same manner as in Example 162 except that the charge transport material is changed to the material represented by the following chemical structure.

In addition, the image bearing member no. 126 is evaluated in the same manner as in Example 162. The results are shown in Table 29.

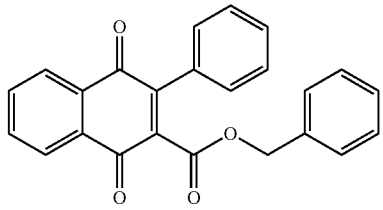

Example 164

The image bearing member 127 is manufactured in the same manner as in Example 162 except that the charge transport material is changed to the material represented by the following chemical structure. In addition, the image bearing member no. 127 is evaluated in the same manner as in Example 162. The results are shown in Table 29.

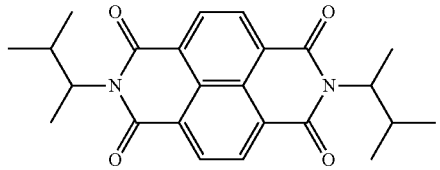

Example 165

The image bearing member 128 is manufactured in the same manner as in Example 162 except that the charge transport material is changed to the material represented by the following chemical structure.

In addition, the image bearing member no. 128 is evaluated in the same manner as in Example 162. The results are shown in Table 29.

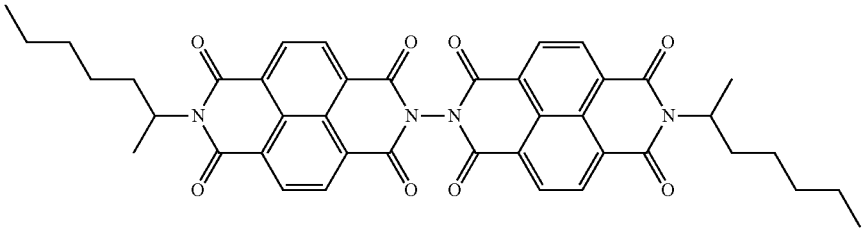

TABLE 29

| Example no. | Image bearing no. | Illustrated derivative no. | Initial: Voltage at bright portion (V) | Initial: Dot definition | After 100,00 prints: Voltage at bright portion (V) | After 100,00 prints: Dot definition |
|---|---|---|---|---|---|---|
| 162 | 125 | 8 | 100 | 5 | 110 | 5 |
| 163 | 126 | 8 | 95 | 5 | 120 | 5 |
| 164 | 127 | 8 | 90 | 5 | 115 | 5 |
| 165 | 128 | 8 | 95 | 5 | 105 | 5 |

Judging from the evaluation results, it is confirmed that the voltage at bright portion of the image bearing members of the present disclosure having naphthalimide-isoindol derivative does not rise significantly after outputs of 100,000 images so that quality images can be stably produced.

Furthermore, as seen in the evaluation results in Tables 18 and 25, the image bearing members of the present disclosure can produce quality images even in the positive charging system. After the output of 100,000 sheets, quality images can be still produced and the evaluation results of the image blur (dot definition) are still good.

Examples 166 to 172

In addition, the image bearing members of the present disclosure shown in Table 31 are left for four days in a desiccator in which nitrogen oxides (NOx) gas density is adjusted to be 50 ppm and the dot images are evaluated before and after the image bearing members are left.

TABLE 30

| Example no. | Image bearing member no. | Initial image quality | Image quality after left for four days |
|---|---|---|---|
| 166 | 65 | 5 | 5 |
| 167 | 81 | 5 | 5 |
| 168 | 97 | 5 | 5 |
| 169 | 101 | 5 | 4 |

TABLE 30-continued

| Example no. | Image bearing member no. | Initial image quality | Image quality after left for four days |
|---|---|---|---|
| 170 | 112 | 5 | 5 |
| 171 | 113 | 5 | 4 |
| 172 | 123 | 5 | 5 |

As seen in the evaluation results shown in Table 30, the image bearing members containing naphthalimide-isoindol derivative has a significantly improved chemical resistance to oxidizing gases, thereby preventing degradation of the definition.

Example 173

A liquid application for undercoating layer, a liquid application for charge generation layer, and a liquid application for charge transport layer having the following compositions are sequentially applied to an aluminum cylinder by dip-coating followed by drying to obtain an undercoating layer having a thickness of 3.5 μm, a charge generation layer having a thickness of 0.2 μm, and a charge transport layer having a thickness of 23 μm that form an image bearing member no. 129.

Liquid Application for Undercoating Layer

Titanium dioxide powder (TIPAQUE CR-EL, manufactured by Ishihara Sangyo Kaisha Ltd.): 400 parts Melamine resin (SUPERBECKAMINE G821-60, manufactured by DIC Corporation): 65 parts Alkyd resin (BECKOLITE M6401-50, manufactured by DIC Corporation): 120 parts 2-butanone: 400 parts Liquid Application for Charge Generation Layer Fluorenone-based bisazo pigment represented by the following chemical structure: 12 parts

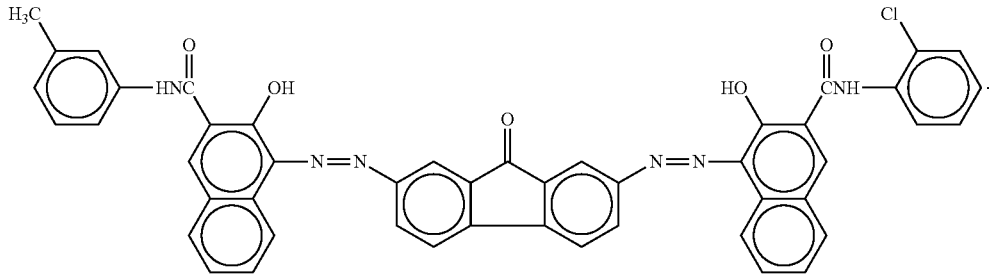

Polyvinyl butyral (XYHL, manufactured by Union Carbide Corporation): 5 parts 2-butanone: 200 parts Cyclohexanone: 400 parts Liquid Application for Charge Transport Layer Polycarbonate resin (Z POLIKA, manufactured by TEIJIN CHEMICALS LTD.): 10 parts Tiphenyl amine-isoindol derivative no. 8: 10 part Tetrahydrofuran: 100 parts The thus manufactured image bearing member is installed into a process cartridge, which is then attached to a machine remodeled based on imagio MF 2200 (manufactured by Ricoh Co., Ltd.) with a negative corona charging system and an irradiation light source of a semiconductor laser having a wavelength of 655 nm. With a voltage at a dark portion of −800 V, the machine continuously prints images on about 100,000 sheets as a repetition test. The voltage (V) at a bright portion and the image at the initial stage and after the repetition test are evaluated. In addition, with regard to the image blur (dot definition), dot images having a pixel density of 600 dpi×600 dpi with an image density of 5% are continuously printed on 10 sheets. The dot forms are observed by a stereoscopic microscope and evaluated according to the following criteria with regard to the sharpness of the contour.

Dot Image Evaluation Criteria 5 (Excellent): Cleat contour 4 (Good): Extremely slight blur of contour observed 3 (Fair): Slight blur of contour observed with no practical problem 2 (Bad): Blur of contour observed. Problematic depending on the kind of images.

1 (Very bad): dots no discernible.

he results are shown in Table 31.

Examples 174 to 187

Image bearing members 130 to 143 are manufactured in the same manner as in Example 173 except that illustrated triphenyl amine-isoindol derivative compound no. 8 is replaced with illustrated triphenyl amine-isoindol derivatives nos. shown in Table 31 and evaluated.

The results are shown in Table 31.

TABLE 31

| | | | Initial | | After 100,00 prints | |
|---|---|---|---|---|---|---|
| Example no. | Image bearing no. | Illustrated derivative no. | Voltage at bright portion (V) | Dot definition | Voltage at bright portion (V) | Dot definition |
| 173 | 129 | 8 | −95 | 5 | −105 | 5 |
| 174 | 130 | 1 | −115 | 5 | −130 | 5 |
| 175 | 131 | 3 | −100 | 5 | −120 | 5 |
| 176 | 132 | 5 | −105 | 5 | −120 | 5 |
| 177 | 133 | 7 | −100 | 5 | −115 | 5 |
| 178 | 134 | 9 | −110 | 5 | −130 | 5 |
| 179 | 135 | 11 | −105 | 5 | −125 | 5 |
| 180 | 136 | 13 | −100 | 5 | −150 | 3 |
| 181 | 137 | 15 | −115 | 5 | −135 | 4 |
| 182 | 138 | 17 | −110 | 5 | −125 | 5 |
| 183 | 139 | 21 | −95 | 5 | −155 | 3 |
| 184 | 140 | 23 | −105 | 5 | −120 | 5 |
| 185 | 141 | 25 | −100 | 5 | −130 | 4 |
| 186 | 142 | 29 | −100 | 5 | −120 | 5 |
| 187 | 143 | 33 | −110 | 5 | −125 | 5 |

Example 188

The image bearing member no. 144 is manufactured in the same manner as in Example 173 except that the liquid application for charge transport layer is changed to the following recipe.

In addition, the image bearing member no. 144 is evaluated in the same manner as in Example 173.

The results are shown in Table 32.

Liquid Application for Charge Transport Layer

Polycarbonate resin (Z POLIKA, manufactured by TEIJIN CHEMICALS LTD.): 10 parts

Illustrated triphenyl amine-isoindol derivative no. 8: 1 part

Charge transport material no. 1 represented by the following chemical structure: 9 parts

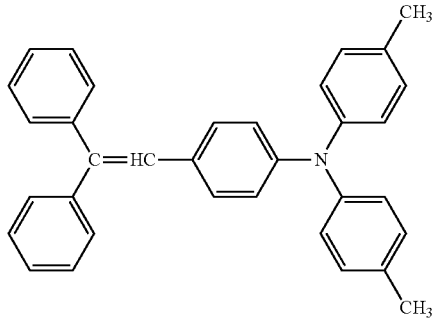

Tetrahydrofuran: 100 parts

Examples 189 to 202

Image bearing members 145 to 158 that are manufactured in the same manner as in Example 188 except that illustrated triphenyl amine-isoindol derivative no. 8 is replaced with illustrated triphenyl amine-isoindol derivatives nos. shown in Table 32 are evaluated in the same manner as in Example 188.

The results are shown in Table 32.

TABLE 32

| | | | Initial | | After 100,00 prints | |
|---|---|---|---|---|---|---|
| Example no. | Image bearing no. | Illustrated derivative no. | Voltage at bright portion (V) | Dot definition | Voltage at bright portion (V) | Dot definition |
| 188 | 144 | 8 | −100 | 5 | −110 | 5 |
| 189 | 145 | 1 | −95 | 5 | −115 | 5 |
| 190 | 146 | 3 | −100 | 5 | −125 | 5 |
| 191 | 147 | 5 | −95 | 5 | −115 | 5 |
| 192 | 148 | 7 | −95 | 5 | −120 | 5 |
| 193 | 149 | 9 | −105 | 5 | −120 | 5 |
| 194 | 150 | 11 | −105 | 5 | −120 | 4 |
| 195 | 151 | 13 | −105 | 5 | −130 | 4 |
| 196 | 152 | 15 | −100 | 5 | −115 | 5 |
| 197 | 153 | 17 | −100 | 5 | −110 | 5 |
| 198 | 154 | 21 | −105 | 5 | −120 | 5 |
| 199 | 155 | 23 | −110 | 5 | −135 | 4 |
| 200 | 156 | 25 | −100 | 5 | −120 | 5 |

TABLE 32-continued

| | | | Initial | | After 100,00 prints | |
|---|---|---|---|---|---|---|
| Example no. | Image bearing no. | Illustrated derivative no. | Voltage at bright portion (V) | Dot definition | Voltage at bright portion (V) | Dot definition |
| 201 | 157 | 29 | −100 | 5 | −130 | 4 |
| 202 | 158 | 33 | −110 | 5 | −135 | 4 |

Examples 203 to 206

Image bearing members no. 159 to 162 are manufactured and evaluated in the same manner as in Example 188 except that the contents of triphenyl amine-isoindol derivative and the charge transport material no. 1 are changed to the following.

The results are shown in Table 33.

Triphenyl amine-isoindol derivative: 3 parts

Charge transport material no. 1: 7 parts

TABLE 33

| | | | Initial | | After 100,00 prints | |
|---|---|---|---|---|---|---|
| Example no. | Image bearing no. | Illustrated derivative no. | Voltage at bright portion (V) | Dot definition | Voltage at bright portion (V) | Dot definition |
| 203 | 159 | 1 | −105 | 5 | −135 | 4 |
| 204 | 160 | 16 | −100 | 5 | −130 | 4 |
| 205 | 161 | 20 | −110 | 5 | −120 | 5 |
| 206 | 162 | 30 | −105 | 5 | −140 | 4 |

Examples 207 to 210

Image bearing members no. 163 to 166 are manufactured and evaluated in the same manner as in Examples 203 to 206 except that the charge transport material no. 1 is changed to the charge transport material no. 2.

The results are shown in Table 34.

Charge Transport Material No. 2

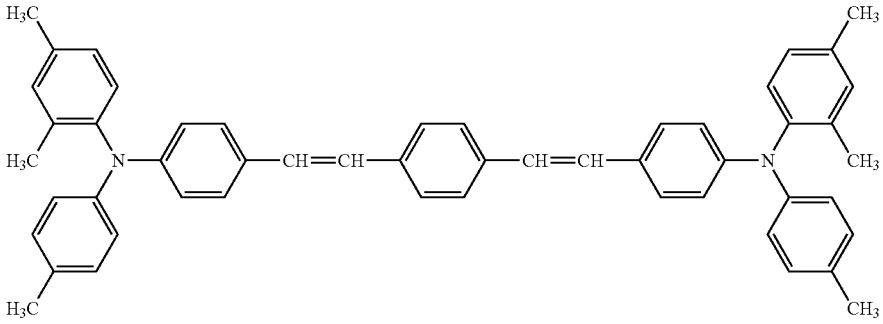

TABLE 34

| Example no. | Image bearing no. | Illustrated derivative no. | Initial: Voltage at bright portion (V) | Initial: Dot definition | After 100,00 prints: Voltage at bright portion (V) | After 100,00 prints: Dot definition |
|---|---|---|---|---|---|---|
| 207 | 163 | 1 | −100 | 5 | −110 | 5 |
| 208 | 164 | 16 | −100 | 5 | −115 | 5 |
| 209 | 165 | 20 | −90 | 5 | −125 | 4 |
| 210 | 166 | 30 | −95 | 5 | −110 | 5 |

Examples 211 to 214

Image bearing members no. 167 to 170 are manufactured in the same manner as in Examples 203 to 206 except that the charge transport material no. 1 is changed to the charge transport material no. 3.

The results are shown in Table 35.

Charge Transport Material No. 3

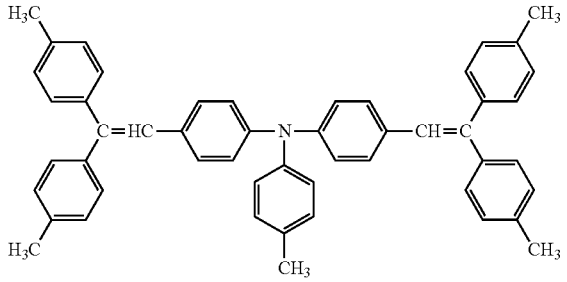

TABLE 35

| Example no. | Image bearing no. | Illustrated derivative no. | Initial: Voltage at bright portion (V) | Initial: Dot definition | After 100,00 prints: Voltage at bright portion (V) | After 100,00 prints: Dot definition |
|---|---|---|---|---|---|---|
| 211 | 167 | 1 | −100 | 5 | −125 | 5 |
| 212 | 168 | 16 | −95 | 5 | −135 | 4 |
| 213 | 169 | 20 | −100 | 5 | −110 | 5 |
| 214 | 170 | 30 | −105 | 5 | −125 | 4 |

Examples 215 to 218

Image bearing members no. 171 to 174 are manufactured and evaluated in the same manner as in Examples 203 to 206 except that the charge transport material no. 1 is changed to the charge transport material no. 4.

The results are shown in Table 36.

Charge Transport Material No. 4

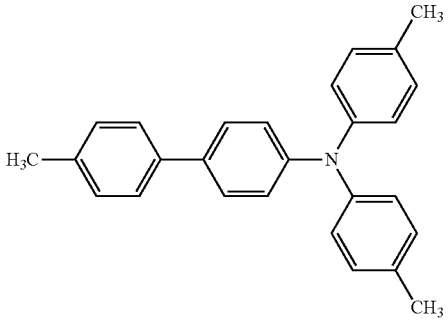

TABLE 36

| Example no. | Image bearing no. | Illustrated derivative no. | Initial: Voltage at bright portion (V) | Initial: Dot definition | After 100,00 prints: Voltage at bright portion (V) | After 100,00 prints: Dot definition |
|---|---|---|---|---|---|---|
| 215 | 171 | 1 | −100 | 5 | −110 | 5 |
| 216 | 172 | 16 | −95 | 5 | −140 | 4 |
| 217 | 173 | 20 | −95 | 5 | −110 | 5 |
| 218 | 174 | 30 | −100 | 5 | −115 | 5 |

Examples 219 and 220

Image bearing members no. 175 and 176 are manufactured in the same manner as in Example 188 except that the liquid application for the charge generation layer and the liquid application for the charge transport layer are changed to the liquid applications having the following recipe.

The results are shown in Table 37.

Manufacturing of Oxotitanium Phthalocyanine

As described in the Synthesis Example 4 in JP-2001-019871-A, 29.2 g of 1,3-diiminoisoindoline and 200 ml of sulfolane are mixed and 20.4 g of titanium tetrabutoxido is dropped thereto in nitrogen atmosphere. Thereafter, the temperature is gradually raised to 180° C., and the resultant is stirred to conduct reaction for 5 hours while the reaction temperature is maintained in a range of from 170° C. to 180° C. After the reaction is complete, the resultant is naturally cooled down and the precipitation is filtered. The filtered resultant is washed with chloroform until the obtained powder indicates the color of blue. Next, the resultant powder is washed with methanol several times. Further, the resultant is washed with hot water of 80° C. several times and dried to obtain a coarse titanyl phthalocyanine. The obtained coarse titanyl phthalocyanine is dissolved in strong sulfuric acid the amount of which is 20 times as much as that of the titanyl phthalocyanine. The resultant is dropped to iced water the amount which is 100 times as much as that of the titanyl phthalocyanine. The precipitated crystal is filtrated and water-washing is repeated with deionized water until the washing water is neutral to obtain a wet cake (water paste) of titanyl phthalocyanine dye. The X-ray diffraction spectrum of the dried product of this cake is shown in FIG. 10. 2 g of the obtained wet cake is placed in 20 g of carbon disulfide followed by a four-hour stirring. 100 g of methanol is added thereto followed by a one-hour stirring. Subsequent to filtration and drying, crystal powder of oxotitanium is obtained.

Liquid Application for Charge Generation Layer

Oxotitanium phthalocyanine having a powder XD spectrum shown in FIG. 10: 8 parts Polyvinylbutyral (BX-1): 5 parts 2-butanone: 400 parts Liquid Application for Charge Transport Layer Polycarbonate resin (Z POLIKA): 10 parts Triphenyl amine-isoindol derivative: 1 part Charge transport material no. 1 represented by the following chemical structure: 7 parts

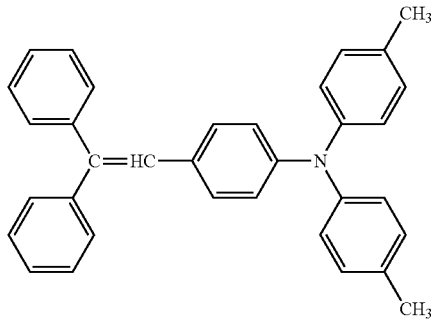

Toluene 70 parts

TABLE 37

| | | | Initial | | After 100,00 prints | |
|---|---|---|---|---|---|---|
| Example no. | Image bearing no. | Illustrated derivative no. | Voltage at bright portion (V) | Dot definition | Voltage at bright portion (V) | Dot definition |
| 219 | 175 | 7 | −100 | 5 | −110 | 5 |
| 220 | 176 | 30 | −95 | 5 | −115 | 5 |

Example 221

A liquid application for photosensitive layer having the following recipe is applied to an aluminum cylinder having a diameter of 100 mm followed by drying to form a single-layered photosensitive layer having a thickness of 30 μm and an image bearing member is obtained (Image bearing member no. 177).

Liquid Application for Photosensitive Layer

X type non-metal phthalocyanine (FastogenBlue 8120B, manufactured by DIC Corporation): 2 parts Charge transport polymer material represented by the following chemical structure: 20 parts

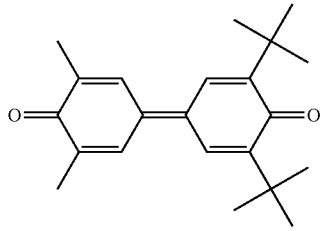

Triphenyl amine-isoindol derivative: 30 part

Bisphenol Z polycarbonate (PanLite TS-2050, manufactured by Teijin Chemicals Ltd.): 50 parts Tetrahydrofuran: 500 parts The thus manufactured image bearing member is installed into a machine remodeled based on imagio Neo 752 (manufactured by Ricoh Co., Ltd.) with a corona charging system (scorotron type) and an irradiation light source of a semiconductor laser having a wavelength of 780 nm. With a surface voltage at a dark portion of 700 V, the machine continuously prints images on about 100,000 sheets as a repetition test.

The voltage (V) at a bright portion and the image at the initial stage and after the repetition test are evaluated. In addition, the voltage at the dark portion after the repetitive test is measured.

In addition, the images are also evaluated in the same manner as in Example 177 with regard to image blur (dot definition).

The results are shown in Table 38.

Examples 222 to 224

Image bearing members 178 to 180 are manufactured in the same manner as in Example 221 except that triphenyl amine-isoindol derivative no. 1 is replaced with illustrated naphthalimide-isoindol derivatives nos. shown in Table 38 and evaluated.

TABLE 38

| | | | Initial | | After 100,00 prints | |
|---|---|---|---|---|---|---|
| Example no. | Image bearing no. | Illustrated derivative no. | Voltage at bright portion (V) | Dot definition | Voltage at bright portion (V) | Dot definition |
| 221 | 177 | 1 | 100 | 5 | 115 | 5 |
| 222 | 178 | 16 | 105 | 5 | 120 | 5 |
| 223 | 179 | 20 | 100 | 5 | 115 | 5 |
| 224 | 180 | 30 | 110 | 5 | 135 | 4 |

Example 225

A liquid application for photosensitive layer having the same recipe as in Example 221 is applied to an aluminum cylinder having a diameter of 30 mm followed by drying to form a single-layered photosensitive layer having a thickness of 30 μm and an image bearing member no. 181 is obtained.

The image bearing member no. 181 is evaluated in the same manner as in Example 188.

The results are shown in Table 39. Examples 226 to 228

Image bearing members 182 to 184 are manufactured in the same manner as in Example 225 except that triphenyl amine-isoindol derivative no. 1 is replaced with illustrated triphenyl amine-isoindol derivatives nos. shown in Table 39 and evaluated.

TABLE 39

| | | | Initial | | After 100,00 prints | |
|---|---|---|---|---|---|---|
| Example no. | Image bearing no. | Illustrated derivative no. | Voltage at bright portion (V) | Dot definition | Voltage at bright portion (V) | Dot definition |
| 225 | 181 | 1 | −90 | 5 | −115 | 5 |
| 226 | 182 | 16 | −105 | 5 | −120 | 5 |
| 227 | 183 | 20 | −100 | 5 | −130 | 4 |
| 228 | 184 | 30 | −110 | 5 | −120 | 5 |

Example 229

Liquid applications for charge transport layer and charge generation layer having the following recipes are applied to an aluminum cylinder having a diameter of 30 mm followed by drying to form a charge transport layer having a thickness of 20 μm and a charge generation layer having a thickness of 0.1 μm and an image bearing member no. 185 is obtained and evaluated in the same manner as in Example 221.

The results are shown in Table 40. Composition of Liquid Application for Charge Transport Layer Bisphenol A type polycarbonate resin (PANLITE C-1400, manufactured by Teijin Chemicals Ltd.): 10 parts Toluene: 100 parts Triphenyl amine-isoindol derivative no. 1: 10 parts Component of Liquid Application for Charge Generation Layer Polyvinyl butyral {XYHL, manufactured by Union Carbide Corporation (UCC)}: 0.5 parts Cyclohexanone: 200 parts Methylethylketone: 80 parts X type non-metal phthalocyanine (FastogenBlue 8120B, manufactured by DIC Corporation): 2 parts Examples 230 to 232

Image bearing members 186 to 188 are manufactured in the same manner as in Example 229 except that triphenyl amine-isoindol derivative no. 1 is replaced with illustrated triphenyl amine-isoindol derivatives nos. shown in Table 40 and evaluated.

TABLE 40

| | | | Initial | | After 100,00 prints | |
|---|---|---|---|---|---|---|
| Example no. | Image bearing no. | Illustrated derivative no. | Voltage at bright portion (V) | Dot definition | Voltage at bright portion (V) | Dot definition |
| 229 | 185 | 1 | 90 | 5 | 110 | 5 |
| 230 | 186 | 16 | 105 | 5 | 135 | 4 |
| 231 | 187 | 20 | 100 | 5 | 130 | 4 |
| 232 | 188 | 30 | 95 | 5 | 110 | 5 |

Example 233

Image bearing member no. 189 is manufactured in the same manner as in Example 188 except that the liquid application for charge transport layer is changed to the following recipe.

In addition, the repetition test and evaluation are made in the same manner except that the charging system in Example 188 is changed to a positive charging corona discharging (scorotron system) and the voltage at bright portions is set to be 800 V.

he results are shown in Table 41.

Liquid Application for Charge Transport Layer

Polycarbonate resin (Z POLIKA, manufactured by TEIJIN CHEMICALS LTD.): 10 parts

Phthalimide-isoindol derivative no. 8: 1 part

Charge Transport Material represented by the following chemical structure: 9 parts

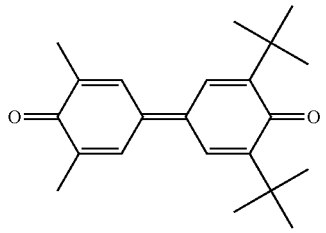

Tetrahydrofuran: 100 parts

Example 234

Image bearing member no. 190 is manufactured in the same manner as in Example 233 except that the charge transport material is changed to the material represented by the following chemical structure.

In addition, the image bearing member no. 190 is evaluated in the same manner as in Example 233.

The results are shown in Table 41.

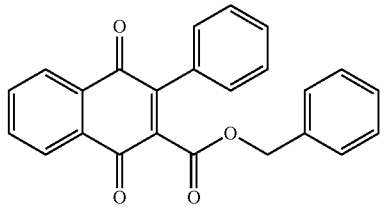

Example 235

Image bearing member no. 191 is manufactured in the same manner as in Example 233 except that the charge transport material is changed to the material represented by the following chemical structure.

In addition, the image bearing member no. 191 is evaluated in the same manner as in Example 233. The results are shown in Table 41.

Chemical Structure 128

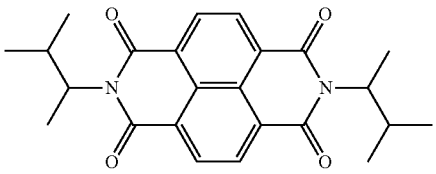

Example 236

Image bearing member no. 192 is manufactured in the same manner as in Example 233 except that the charge transport material is changed to the material represented by the following chemical structure.

In addition, the image bearing member no. 192 is evaluated in the same manner as in Example 233.

The results are shown in Table 41.

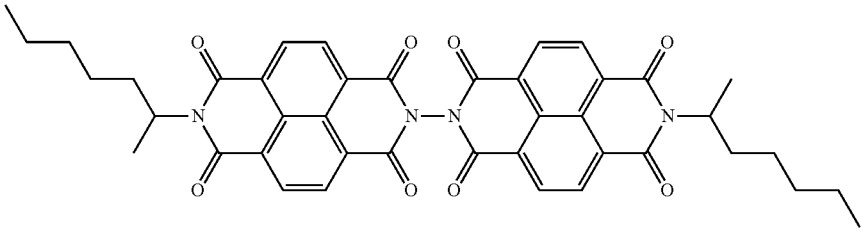

TABLE 41

| | | | Initial | | After 100,00 prints | |
|---|---|---|---|---|---|---|
| Example no. | Image bearing no. | Illustrated derivative no. | Voltage at bright portion (V) | Dot definition | Voltage at bright portion (V) | Dot definition |
| 233 | 189 | 8 | 100 | 5 | 110 | 5 |
| 234 | 190 | 8 | 105 | 5 | 125 | 5 |
| 235 | 191 | 8 | 90 | 5 | 105 | 5 |
| 236 | 192 | 8 | 90 | 5 | 100 | 5 |

Comparative Example 9

In Example 173, comparative image bearing member no. 8 is manufactured and evaluated in the same manner as in Example 173 except that triphenyl amine-isoindol derivative no. 8 is changed to a benzoquinone derivative represented by the following chemical structure.

The results are shown in Table 42.

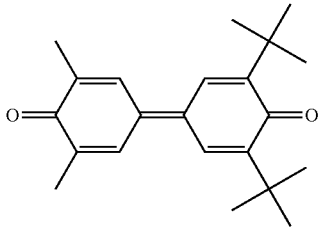

Comparative Example 10

Comparative image bearing member no. 9 is manufactured and evaluated in the same manner as in Example 221 except that 30 parts of triphenyl amine-isoindol derivative no. 1 is changed to charge transport materials represented by the following chemical structures.

The results are shown in Table 42.

Charge transport polymer material represented by the following chemical structure: 18 parts

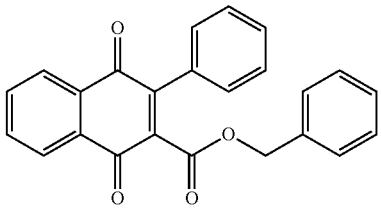

Charge transport material represented by the following chemical structure: 2 parts

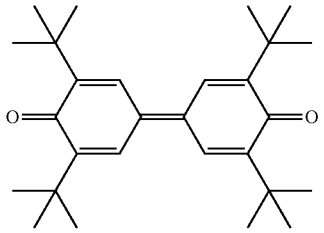

Comparative Example 11

Comparative image bearing member no. 10 is manufactured and evaluated in the same manner as in Example 221 except that 30 parts of triphenyl amine-isoindol derivative no. 1 is changed to a charge transport material represented by the following chemical structures.

The results are shown in Table 42.

Charge transport material represented by the following chemical structure: 20 parts

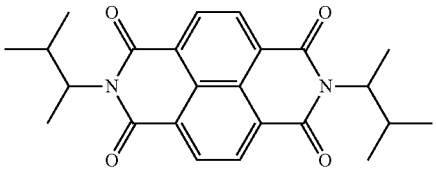

Comparative Example 12

Comparative image bearing member no. 11 is manufactured and evaluated in the same manner as in Example 229 except that 10 parts of triphenyl amine-isoindol derivative no. 1 is changed to charge transport materials represented by the following chemical structures.

The results are shown in Table 42.

Charge transport material represented by the following chemical structure: 9 parts

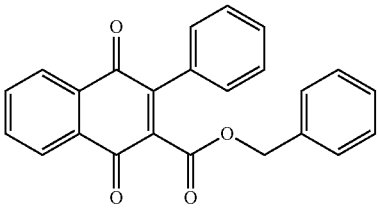

Charge transport material represented by the following chemical structure: 1 part

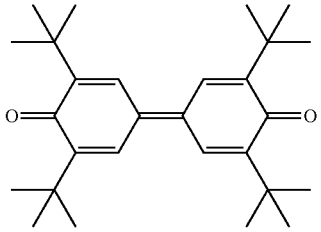

TABLE 42

| | | Initial | | After 100,00 prints | |
|---|---|---|---|---|---|
| Comparative Example no. | Comparative image bearing member no. | Voltage at bright portion (V) | Dot definition | Voltage at bright portion (V) | Dot definition |
| 9 | 8 | −220 | 3 | −500 | 1 |
| 10 | 9 | +115 | 5 | +165 | 1 |
| 11 | 10 | +140 | 4 | +205 | 1 |
| 12 | 11 | +105 | 4 | +135 | 1 |

Judging from the evaluation results, it is confirmed that the voltage at bright portion of the image bearing members of the present disclosure having triphenyl amine-isoindol derivative does not rise significantly after outputs of 100,000 images so that quality images can be stably produced.

To the contrary, the comparative image bearing member 8 has an extremely high voltage at bright portion from the start, resulting in deterioration of the image density and the definition. After the output of 100,000 sheets, graduation extremely deteriorates, causing the images not discernable. Furthermore, as seen in the evaluation results in Tables 38, 40, and 41, the image bearing members of the present disclosure can produce quality images even in the positive charging system. After the output of 100,000 sheets, quality images can be still produced and the evaluation results of the image blur (dot definition) are still good.

In addition, although the voltage at the bright portion of the comparative image bearing members 9, 10, and 11 rises relatively slightly, the definition deteriorates significantly after repetitive use in comparison with the image bearing members of the present disclosure.

Examples 237 to 243

In addition, the image bearing members shown in Table 43 are left for four days in a desiccator in which nitrogen oxides (NOx) gas density is adjusted to be 50 ppm and the dot images are evaluated before and after the image bearing members are left.

TABLE 43

| Example no. | Image bearing member no. | Initial image quality | Image quality after left for four days |
|---|---|---|---|
| 237 | 129 | 5 | 5 |
| 238 | 145 | 5 | 5 |
| 239 | 161 | 5 | 4 |
| 240 | 165 | 5 | 5 |
| 241 | 176 | 5 | 5 |
| 242 | 177 | 5 | 4 |
| 243 | 187 | 5 | 5 |

As seen in the evaluation results shown in Table 43, the image bearing members containing triphenyl amine-isoindol derivative has a significantly improved chemical resistance to oxidizing gases, thereby preventing degradation of the definition.

Therefore, since the image bearing member containing at least one of compounds selected from the group consisting of a naphthalene tetracarboxylic acid diimide-isoindol derivative represented by the chemical structure 1, a naphthalimide-isoindol derivative represented by the chemical structure 2, and a triphenyl amine-isoindol derivative represented by the chemical structure 3, the image bearing member has significantly improved environment resistance against repetitive use and oxidizing gases with no deterioration of sensitivity. Thus, the image bearing member has a high durability so that it stably produces quality images with a high definition. In addition, the image bearing member can be negatively or positively charged. Furthermore, a method of forming images, an image forming apparatus, and a process cartridge using the image bearing member can be provided.

This document claims priority and contains subject matter related to Japanese patent applications nos. 2010-027442 and 2010-164952, filed on Feb. 10, 2010 and Jul. 22, 2010, respectively, the entire contents of which are hereby incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image bearing member comprising:

an electroconductive substrate; and a photosensitive layer provided overlying the electroconductive substrate, the photosensitive layer comprising at least one charge transport materials selected from the group consisting of a naphthalene tetracarboxylic acid diimide-isoindol derivative represented by the following chemical structure 1, a naphthalimide-isoindol derivative represented by the following chemical structure 2, and a triphenyl amine-isoindol derivative represented by the following chemical structure 3, Chemical structure 1

(1)

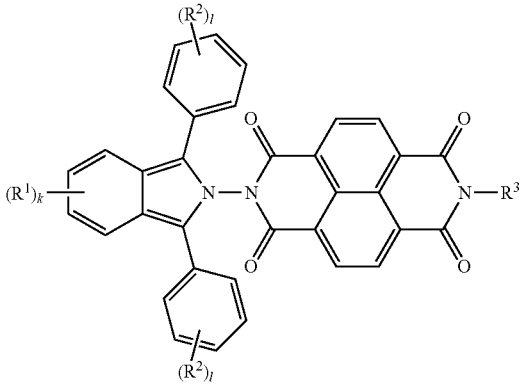

where $R_1$ and $R_2$ independently represent a hydrogen atom, a substituted or non-substituted alkyl group, an alkoxy group, a substituted or non-substituted aromatic hydrocarbon group, a halogen atom, and a nitro group, k represents an integer of 1 to 4, and 1 represents an integer of from 1 to 5, and $R_3$ represents a substituted or non-substituted alkyl group, a substituted or non-substituted cycloalkyl group, and a substituted or non-substituted aromatic hydrocarbon group, Chemical structure 2

(2)

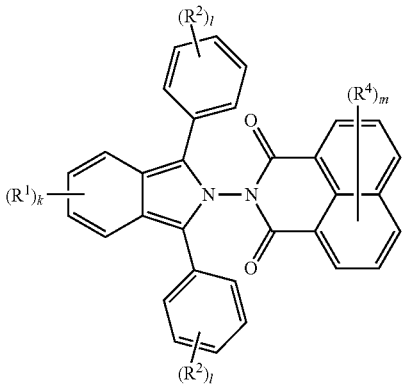

where $R_1$, $R_2$, and $R_4$ independently represent a hydrogen atom, a substituted or non-substituted alkyl group, an alkoxy group, a substituted or non-substituted aromatic hydrocarbon group, a halogen atom, and nitro group, k represents an integer of 1 to 4, 1 represents an integer of from 1 to 5, and m represents an integer of 1 to 6, and Chemical structure 3

(3)

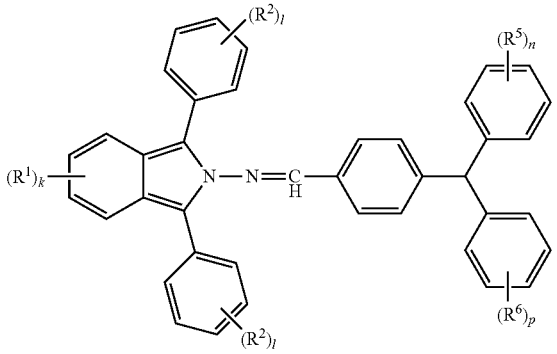

where $R_1$, $R_2$, $R_5$, and $R_6$ independently represent a hydrogen atom, a substituted or non-substituted alkyl group, an alkoxy group, a substituted or non-substituted aromatic hydrocarbon group, a halogen atom, and nitro group, k represents an integer of 1 to 4, and 1, n, and p represent integers of from 1 to 5.

2. The image bearing member according to claim 1, wherein the image bearing member is negatively or positively charged.

3. The image bearing member according to claim 1, wherein the photosensitive layer further comprises an additional charge transport material.

4. The image bearing member according to claim 3, wherein the additional charge transport material is a derivative represented by the following chemical structure 4, Chemical structure 4

(4)

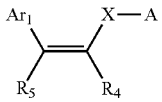

where X represents a single bond or a vinylene group, $R_4$ represents a hydrogen atom, a substituted or non-substituted alkyl group, or a substituted or non-substituted aromatic hydrocarbon group, $Ar_1$ represents a substituted or non-substituted aromatic hydrocarbon group, $R_5$ represents a hydrogen atom, a substituted or non-substituted alkyl group, or a substituted or non-substituted aromatic hydrocarbon group, and $Ar_1$ and $R_5$ optionally share bond connectivity to form a ring, and A represents a compound represented by the following chemical structure 5, a compound represented by the following chemical structure 6,9-anthryl group, or a substituted or non-substituted carbazolyl group, Chemical structure 5

(5)

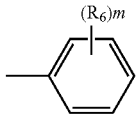

-continued

Chemical structure 6

(6)

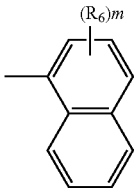

where $R_6$ represents a hydrogen atom, an alkyl group, an alkoxy group, a halogen atom, or a compound represented by the following chemical structure 7, Chemical structure 7

(7)

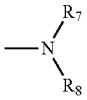

where $R_7$ and $R_8$ represent a substituted or non-substituted alkyl group or a substituted or non-substituted aromatic hydrocarbon group, and optionally share bond connectivity to form a ring, m represents an integer of from 1 to 3, and $R_6$ can be the same or different when m is 2 or 3.

5. The image bearing member according to claim 3, wherein the additional charge transport material is a derivative represented by the following chemical structure 8, Chemical structure 8

(8)

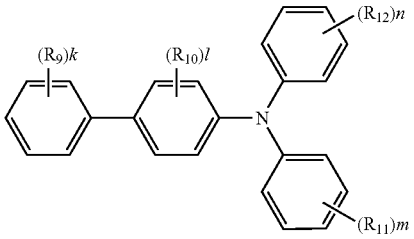

where $R_9$, $R_{11}$, and $R_{12}$ represent a hydrogen atom, amino group, an alkoxy group, a thioalkoxy group, an aryloxy group, methylene dioxy group, a substituted or non-substituted alkyl group, a halogen atom, or a substituted or non-substituted aromatic hydrocarbon group, $R_{10}$ represents a hydrogen atom, an alkoxy group, a substituted or non-substituted alkyl group, or a halogen atom, and k, l, m, and n represent integers of from 1, 2, 3, or 4, and $R_9$, $R_{10}$, $R_{11}$, and $R_{12}$ can be the same or different when each of them is 2, 3, or 4.

6. The image bearing member according to claim 3, wherein the additional charge transport material is a derivative represented by the following chemical structure 9, Chemical structure 9

(9)

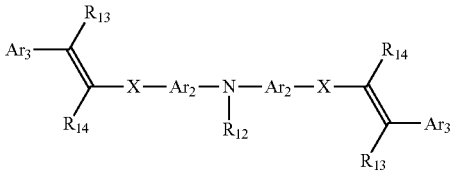

where X represents a single bond or a vinylene group, $R_{13}$ represents a hydrogen atom, a substituted or non-substituted alkyl group, or a substituted or non-substituted aromatic hydrocarbon group, $Ar_3$ represents a substituted or non-substituted aromatic hydrocarbon group, $R_{14}$ represents a hydrogen atom, a substituted or non-substituted alkyl group, or a substituted or non-substituted aromatic hydrocarbon group, $Ar_3$ and $R_{13}$ optionally share bond connectivity to form a ring, and $Ar_2$ represents a compound represented by the following chemical structure 10 or 11, Chemical structure 10

(10)

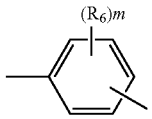

Chemical structure 11

(11)

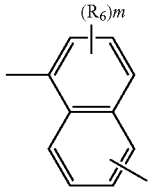

where $R_6$ represents a hydrogen atom, an alkyl group, an alkoxy group, or a halogen atom, m represents an integer of from 1 to 3, $R_6$ can be the same or different when m is 2 or 3, and $R_{12}$ represents a substituted or non-substituted alkyl group, or a substituted or non-substituted aromatic hydrocarbon group.

7. The image bearing member according to claim 3, wherein the additional charge transport material is a derivative represented by the following chemical structure 12, Chemical structure 12

(12)

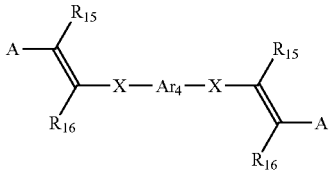

where X represents a single bond or a vinylene group, $R_{15}$ represents a hydrogen atom, a substituted or non-substituted alkyl group, or a substituted or non-substituted aromatic hydrocarbon group, $Ar_4$ represents a substituted or non-substituted divalent aromatic hydrocarbon group, $R_{16}$ represents a hydrogen atom, a substituted or non-substituted alkyl group, or a substituted or non-substituted aromatic hydrocarbon group, and A represents a compound represented by the chemical structure 5, a compound represented by the following chemical structure 6,9-anthryl group, or a substituted or non-substituted carbazolyl group, Chemical structure 5

(5)

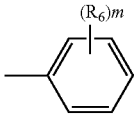

Chemical structure 6

(6)

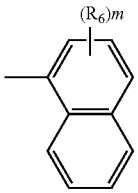

$R_6$ represents a hydrogen atom, an alkyl group, an alkoxy group, a halogen atom, or a compound represented by the following chemical structure 7, Chemical structure 7

(7)

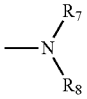

where $R_7$ and $R_8$ independently represent a substituted or non-substituted alkyl group or a substituted or non-substituted aromatic hydrocarbon group and optionally share bond connectivity to form a ring, m represents an integer of from 1 to 3, and $R_6$ can be the same or different when m is 2 or 3.

8. The image bearing member according to claim 3, wherein the additional charge transport material is a derivative represented by the following chemical structure 13, Chemical structure 13

(13)

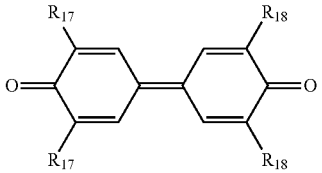

where $R_{17}$ and $R_{18}$ independently represent a hydrogen atom, a substituted or non-substituted alkyl group, or a substituted or non-substituted aromatic hydrocarbon group.

9. The image bearing member according to claim 3, wherein the additional charge transport material is a derivative represented by the following chemical structure 14, Chemical structure 14

(14)

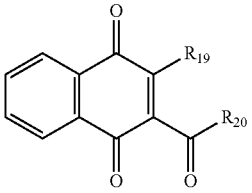

where $R_{19}$ represents a hydrogen atom, a substituted or non-substituted alkyl group, or a substituted or non-substituted aryl group, and $R_{20}$ represents a substituted or non-substituted alkyl group, a substituted or non-substituted aromatic hydrocarbon group, or a group represented by the chemical structure 15, Chemical structure 15

$$—O—R_{21} \quad (15)$$

where $R_{21}$ represents a substituted or non-substituted alkyl group or a substituted or non-substituted aryl group.

10. The image bearing member according to claim 3, wherein the additional charge transport material is a derivative represented by the following chemical structure 16, Chemical structure 16

(16)

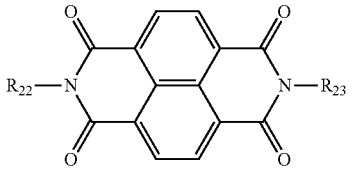

where $R_{22}$ and $R_{23}$ independently represent a hydrogen atom, a substituted or non-substituted alkyl group, or a substituted or non-substituted aromatic hydrocarbon group.

11. The image bearing member according to claim 3, wherein the additional charge transport material is a derivative represented by the following chemical structure 17, Chemical structure 17

(17)

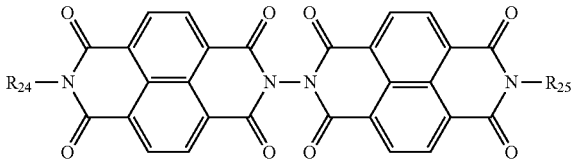

where $R_{24}$ and $R_{25}$ independently represent a hydrogen atom, a substituted or non-substituted alkyl group, or a substituted or non-substituted aromatic hydrocarbon group.

12. The image bearing member according to claim 1, wherein the photosensitive layer comprises a charge transport layer laminated on a charge generation layer.

13. The image bearing member according to claim 1, wherein the photosensitive layer comprises a charge generation layer laminated on a charge transport layer.

14. The image bearing member according to claim 1, wherein the photosensitive layer has a single-layered structure.

15. A method of forming images comprising:

charging the image bearing member of claim 1;

irradiating the image bearing member with light according to image data to form a latent electrostatic image on the image bearing member;

developing the latent electrostatic image with a development agent comprising toner to obtain a visualized image; and transferring the visualized image onto a recording medium.

16. An image forming apparatus comprising:

the image bearing member of claim 1;

a charger that charges the image bearing member of claim 1;

an irradiator that irradiates the image bearing member with light to form a latent electrostatic image on a surface of the image bearing member;

a development device that develops the latent electrostatic image with a development agent comprising toner to obtain a visualized image; and a transfer device that transfers the visualized image onto a recording medium.

17. A process cartridge comprising:

the image bearing member of claim 1; and at least one of a charger, an irradiator, a development device, and a cleaner.

18. The image bearing member of claim 1, wherein the at least one charge transport material is a naphthalene tetracarboxylic acid diimide-isoindol derivative represented by chemical structure 1.

19. The image bearing member of claim 1, wherein the at least one charge transport material is a naphthalimide-isoindol derivative represented by the following chemical structure 2.

20. The image bearing member of claim 1, wherein the at least one charge transport material is a triphenyl amine-isoindol derivative represented by chemical structure 3.

* * * * *